US010872723B2

(12) United States Patent
Sato

(10) Patent No.: US 10,872,723 B2
(45) Date of Patent: Dec. 22, 2020

(54) IGNITION COIL FOR INTERNAL COMBUSTION ENGINE

(71) Applicant: DENSO CORPORATION, Kariya (JP)

(72) Inventor: Yoshitaka Sato, Kariya (JP)

(73) Assignee: DENSO CORPORATION, Kariya (JP)

( * ) Notice: Subject to any disclaimer, the term of this patent is extended or adjusted under 35 U.S.C. 154(b) by 277 days.

(21) Appl. No.: 15/946,925

(22) Filed: Apr. 6, 2018

(65) Prior Publication Data

US 2018/0294092 A1 Oct. 11, 2018

(30) Foreign Application Priority Data

Apr. 7, 2017 (JP) ..... 2017-077002
Feb. 14, 2018 (JP) ..... 2018-024433

(51) Int. Cl.
*H01F 38/12* (2006.01)
*F02P 13/00* (2006.01)
*F02P 3/02* (2006.01)

(52) U.S. Cl.
CPC ..... *H01F 38/12* (2013.01); *F02P 3/02* (2013.01)

(58) Field of Classification Search
CPC ..... F02P 13/00; F02P 3/02; H01F 38/12
See application file for complete search history.

(56) References Cited

U.S. PATENT DOCUMENTS 5,771,870 A * 6/1998 Satou ..... F02F 1/242 123/169 PA
2007/0235013 A1* 10/2007 Maekawa ..... H01F 38/12 123/635
2011/0247600 A1* 10/2011 Anzo ..... F02P 3/02 123/634
2017/0321648 A1* 11/2017 Sano ..... F02P 15/12
2019/0162156 A1* 5/2019 Kondo ..... F02P 3/055

FOREIGN PATENT DOCUMENTS

JP 8-130131 5/1996

* cited by examiner

*Primary Examiner* — Sizo B Vilakazi
(74) *Attorney, Agent, or Firm* — Nixon & Vanderhye P.C.

(57) ABSTRACT

An ignition coil for an internal combustion engine includes a primary coil, a secondary coil, a case, and a joint. The primary and secondary coils are magnetically coupled with each other. The case includes a case body in which the primary and secondary coils are disposed and a cylindrical high-voltage tower which protrudes from a case bottom wall of the case body. The joint is fit on the high-voltage tower and a spark plug. The joint is of a cylindrical shape. A communicating void is formed between the high-voltage tower and the joint to communicate between an inner space of the high-voltage tower and the joint and an outer space disposed outside the high-voltage tower and the joint, thereby facilitating attachment or removal of the joint to or from the spark plug.

18 Claims, 51 Drawing Sheets

IGNITION COIL FOR INTERNAL COMBUSTION ENGINE

CROSS REFERENCE TO RELATED DOCUMENT

The present application claims the benefit of priority of Japanese Patent Application Nos. 2017-77002 filed on Apr. 7, 2017 and 2018-24433 filed on Feb. 14, 2018, disclosures of which are incorporated herein by reference.

TECHNICAL FIELD

This disclosure relates generally to an ignition coil for an internal combustion engine.

BACKGROUND ART

Japanese Patent First Publication No. 8-130131 discloses an ignition coil for an internal combustion engine which includes a primary coil and a secondary coil which are magnetically coupled with each other, a case in which the primary and secondary coils are disposed, and a rubber joint fit on the case. The case is equipped with a cylindrical high-voltage tower extending in an axial direction thereof. The joint is secured to the case to cover the high-voltage tower. The joint has a front end in which a spark plug is fit.

The ignition coil has a plurality of recesses form in a portion of an inner peripheral surface of the joint in which the spark plug is mounted in order to facilitate installation and removal of the spark plug in or from the joint. This results in a decrease in area of contact between the inner peripheral surface of the joint and the spark plug to decrease a degree of force required to install or remove the spark plug in or from the joint.

The ignition coil, as taught in the above publication, however, has room for improvement in terms of the ease of installation or removal of the joint in or from the spark plug.

For example, when the spark plug is pulled out from the joint, it will usually cause the pressure in an internal space of the joint to become negative with the removal of the spark plug from the joint because the joint is generally made of a soft material such as rubber. This causes a degree of force required to pull the spark plug out of the joint to be gradually increased with the removal of the spark plug from the joint. The negative pressure in the joint will cause the diameter of the joint to be decreased, thereby resulting in an enhanced degree by which the joint grasps the spark plug. This also results in an increase in force required to pull the spark plug out of the joint.

Similarly, when the spark plug is inserted into the tip of the joint of the ignition coil, it will cause the internal space of the joint to be compressed with the insertion of the spark plug into the joint. The degree of force required to insert the spark plug into the joint is, therefore, increased with the insertion of the spark plug into the joint of the ignition coil.

In recent years, ignition coils may have been installed in engines with plug holes which are curved, not straight or engines with longer plug holes. For such installation, the joint of the ignition coil may be shaped to be curved or have a longer length. This, however, results in an increase in difficulty in installing or removing the spark plug in or from the joint. The need is, therefore, increased for accomplishing an object to facilitate the installation or removal of the joint on or from the spark plug.

SUMMARY OF THE INVENTION

This disclosure was made in view of the above problem to provide an ignition coil for internal combustion engines which is capable of facilitating installation or removal of a joint on or from a spark plug.

One aspect of this disclosure is an ignition coil for an internal combustion engine which comprises: (a) a primary coil and a secondary coil which are magnetically coupled with each other; (b) a case which includes a case body in which the primary coil and the secondary coil are disposed and a cylindrical high-voltage tower which protrudes from a bottom wall of the case body; and (c) a cylindrical joint which is fit on the high-voltage tower and a spark plug. A communicating void is formed between the high-voltage tower and the joint to communicate between an inner space formed inside the high-voltage tower and the joint and an outer space located outside the high-voltage tower and the joint.

In the ignition coil for the internal combustion engine, the communicating void is formed between the high-voltage tower and the joint, thereby minimizing a change in air pressure within the joint when the joint is mounted on or removed from on a spark plug. This facilitates attachment or removal of the joint to or from the spark plug.

As described above, it is possible to provide an ignition coil for internal combustion engines which is designed to facilitate attachment or removal of a joint to or from a spark plug.

PREFERRED EMBODIMENTS

First Embodiment

The ignition coil 1 for internal combustion engines according to the first embodiment will be described below using FIGS. 1 to 6.

Figure 1:
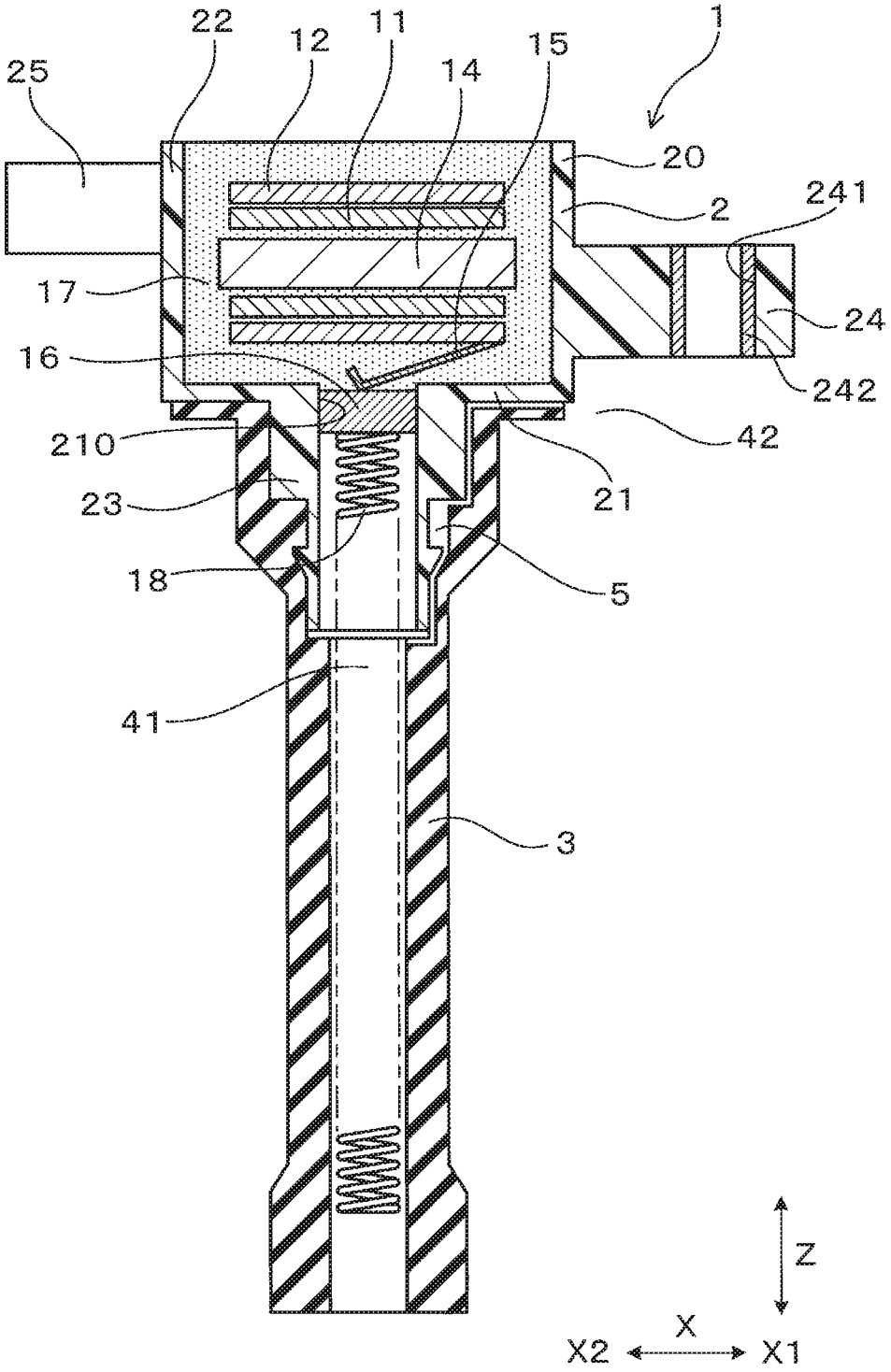
FIG. 1 is a sectional view of an ignition coil in the first embodiment.
Figure 2:
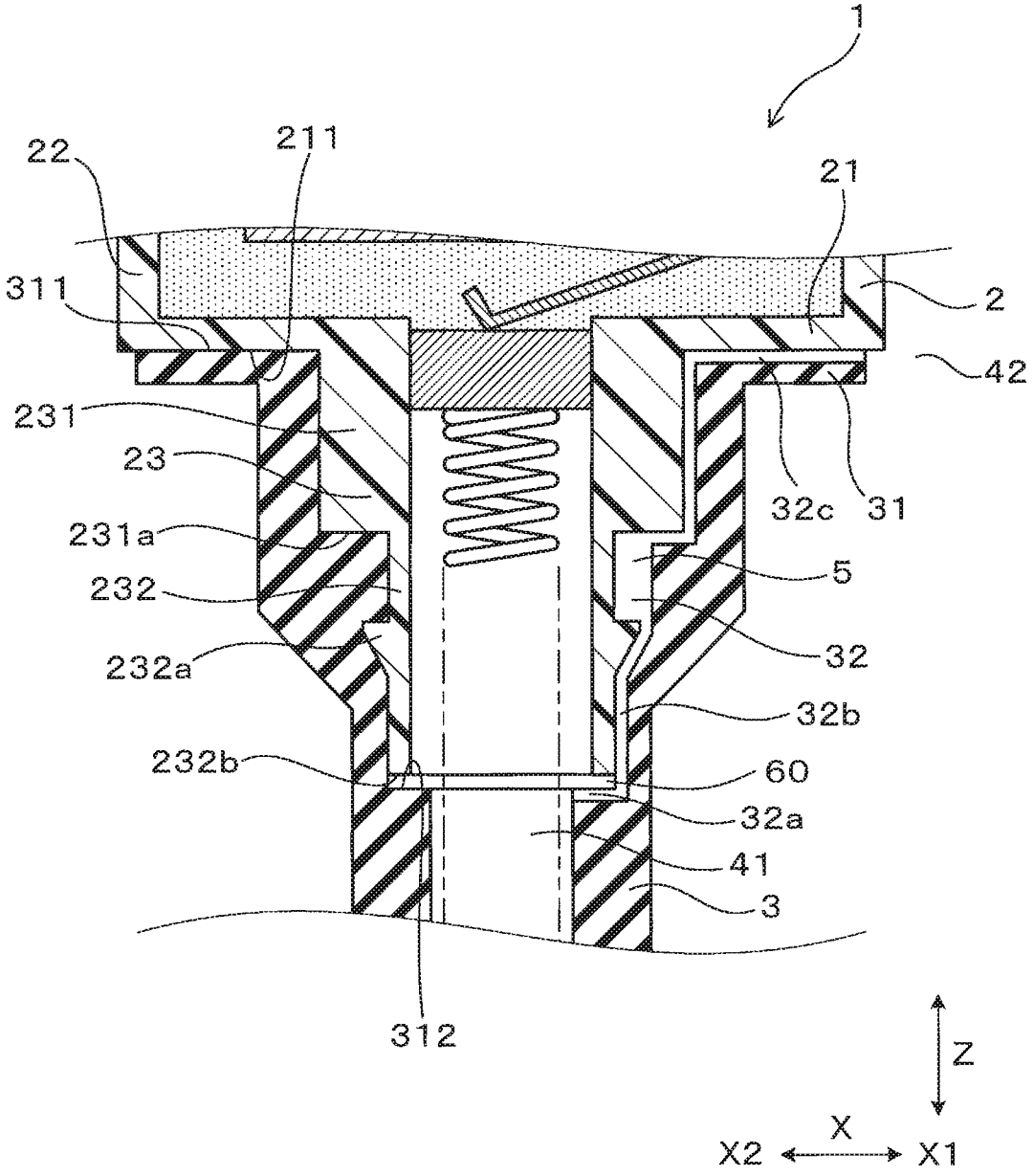
FIG. 2 is an enlarged sectional view which illustrates a region around a high-voltage tower of an ignition coil in the first embodiment.
Figure 3:
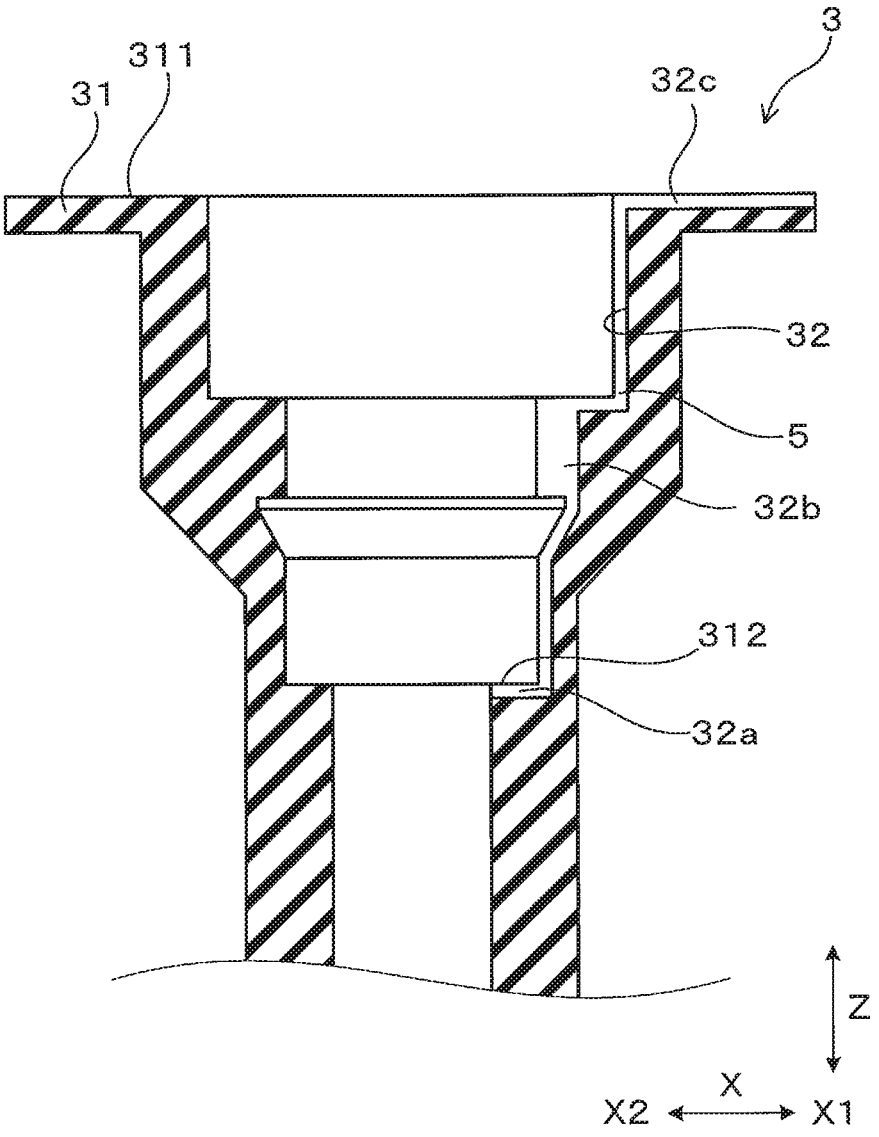
FIG. 3 is a sectional view parallel to an axial direction of a joint and an enlarged sectional view passing through a void-forming groove in the first embodiment.
Figure 4:
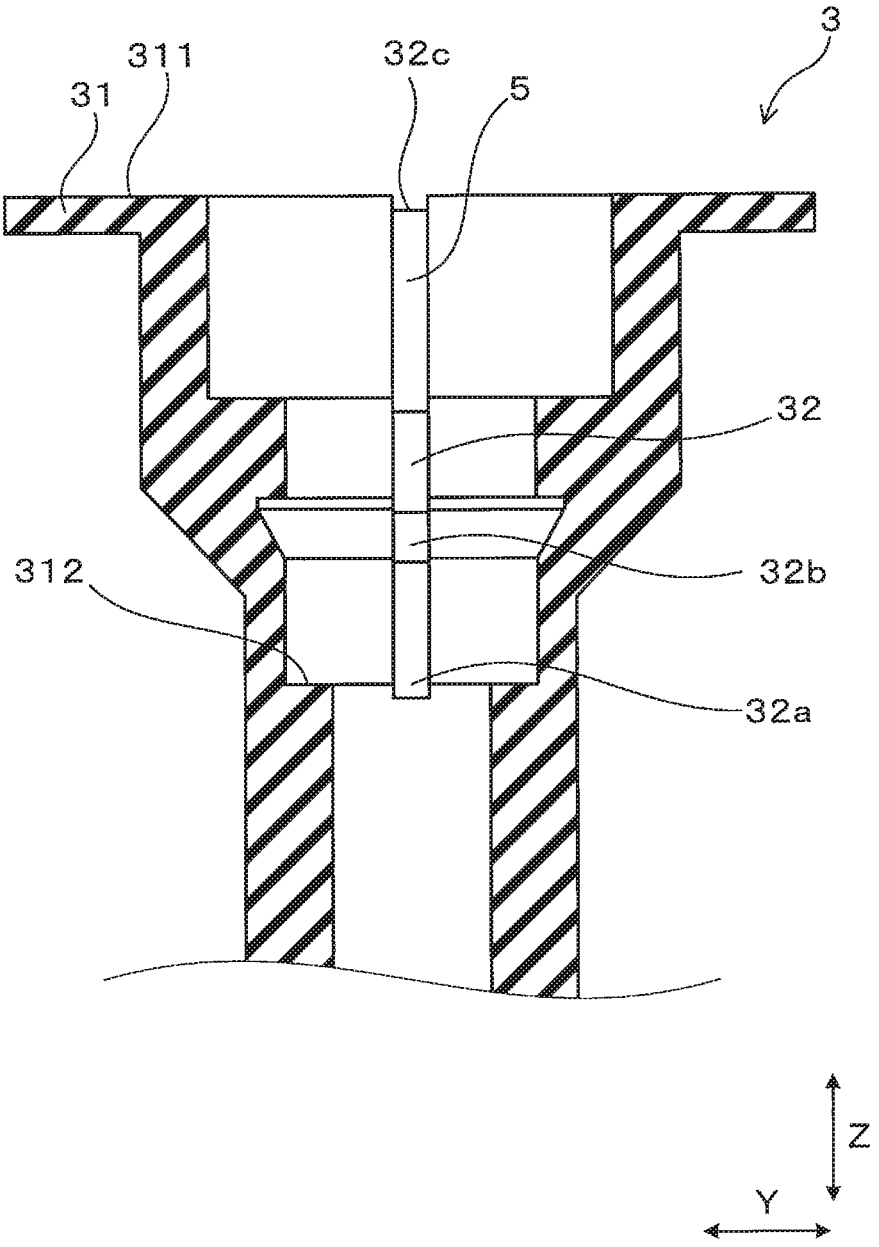
FIG. 4 is a sectional view parallel to an axial direction of a joint and an enlarged sectional view not passing through a void-forming groove in the first embodiment.
Figure 5:
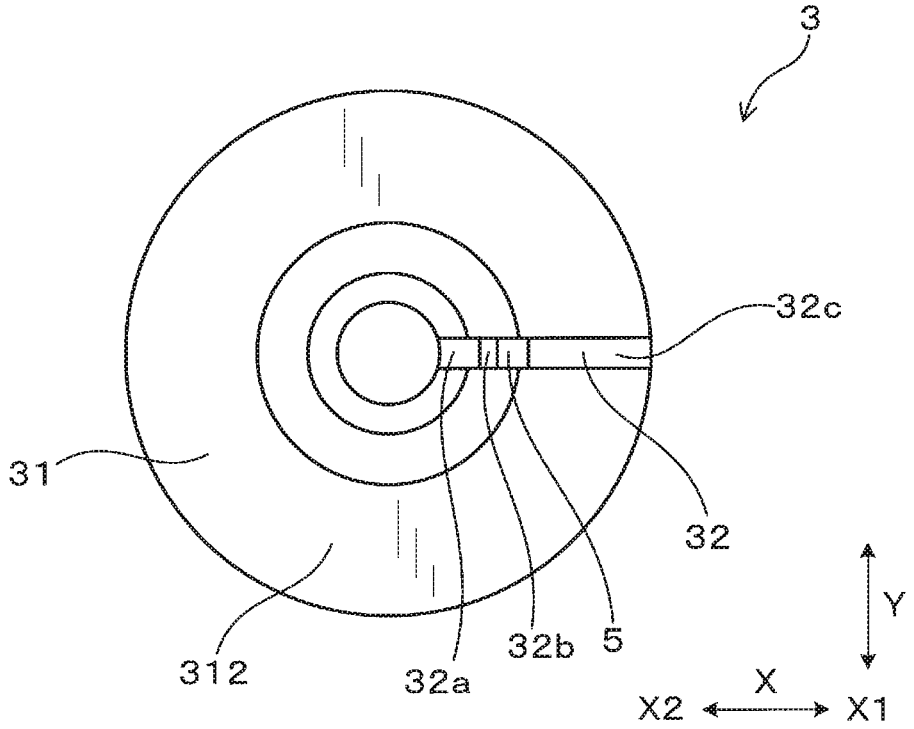
FIG. 5 is a top view of a joint in the first embodiment.
Figure 6:
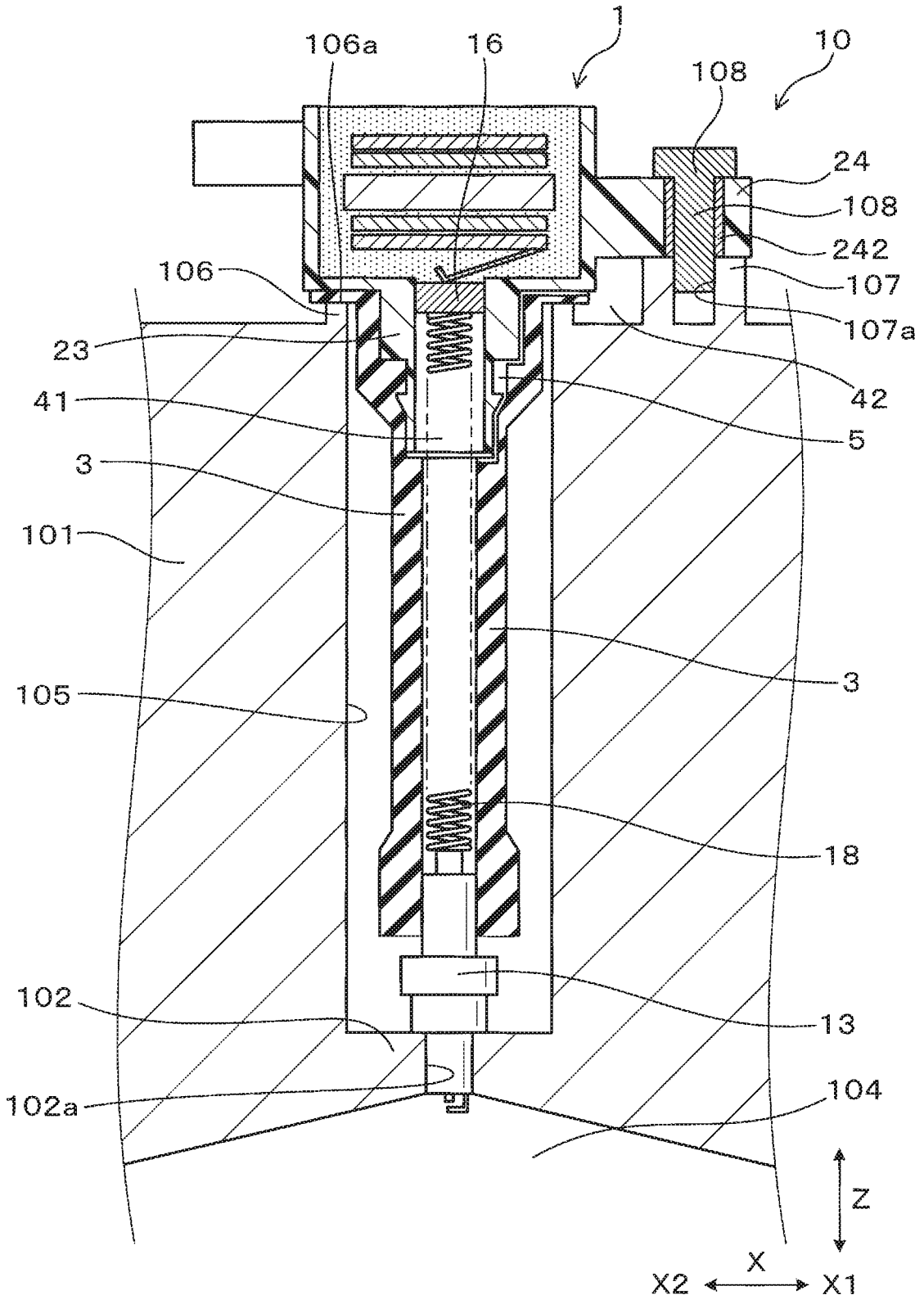
FIG. 6 is a sectional view of an ignition device equipped with an ignition coil in the first embodiment.

The ignition coil 1, as illustrated in FIG. 1, includes the primary coil 11, the secondary coil 12, the case 2, and the joint 3. The primary coil 11 and the secondary coil 12 are magnetically coupled with each other. The case 2 includes the case body 20 in which the primary coil 11 and the secondary coil 12 are installed and the hollow cylindrical high-voltage tower 23 protruding from the base bottom wall 21 of the case body 20 downward, as viewed in the drawing. The joint 3 is, as illustrated in FIG. 6, fit on the high-voltage tower 23 and the spark plug 13. The joint 3 is, as can be seen in FIGS. 1 and 2, of a hollow cylindrical shape. The communicating void 5 (which will also be referred to as a path) is formed between the high-voltage tower 23 and the joint 3 and communicates between an inner space (i.e., an inner chamber) 41 formed inside the high-voltage tower 23 and the joint 3 and an outer space (i.e., an outer chamber) 42 formed outside the high-voltage tower 23 and the joint 3.

In the following discussion, a direction in which the high-voltage tower 23 protrudes from the case body 20, in other words, a lengthwise direction of the high-voltage tower 23 will be referred to as an axial direction Z. In this embodiment, the axial direction Z is also the lengthwise direction (i.e., a direction of the center axis) of the ignition coil 1. A side where the high-voltage tower 23 protrudes from the case body 20 in the axial direction Z will be referred to as a lower side, while a side opposite the lower side will be referred to as an upper side.

The ignition coil 1 of this embodiment is connected to the spark plug 13 installed in an internal combustion engine of automobiles or cogenerations to apply high-voltage to the spark plug 13. The spark plug 13 has, as illustrated in FIG. 6, an end which is opposite an end on which the joint 3 of the ignition coil 1 is fit and protrudes into the combustion chamber 104 of the internal combustion engine.

The case body 20, as illustrated in FIG. 1, includes the case bottom wall 21 extending perpendicular to the axial direction Z and the case side wall 22 extending upward from a circumferential edge of the case bottom wall 21. The case body 20 has an opening at an upper end of the case side wall 22. The case body 20 has the flange 24 protruding perpendicular to the axial direction Z. The flange 24 is, as described later, secured to the internal combustion engine. The flange 24 has the bolt hole 241 passing therethrough in the axial direction Z. The flange 24 is also equipped with the bush 242 fit in the bolt hole 241. The bush 242 is made of hollow metallic cylinder.

In this disclosure, a direction in which the flange 24 of the case body 20 protrudes will be referred to as a lateral direction X. A side where the flange 24 of the case body 23 protrudes in the lateral direction X will be referred to as a side X1 (or right or a first direction). A side opposite the side X1 will be referred to as a side X2 or (or left or a second direction). A direction perpendicular both to the axial direction Z and to the lateral direction X will be referred to as a vertical direction Y.

The case body 20 is equipped with the connector 25 protruding in a direction (i.e., on the side X2) opposite the direction in which the flange 24 protrudes in the lateral direction X. The connector 25 is joined to an external connector that is an end of a cable to which, for example, an external device is connected, thereby achieving a connection between the ignition coil 1 and the external device.

The case bottom wall 21 has formed a middle portion thereof the circular opening 210 which extends through the case bottom wall 21 in the axial direction Z. The high-voltage tower 23 protrudes downward from a circumferential edge of the opening 210.

The high-voltage tower 23 is substantially of a hollow cylindrical shape. The high-voltage tower 23, as illustrated in FIG. 2, includes the tower upper portion 231 formed at an upper end portion thereof and the tower lower portion 232 which extends below the tower upper portion 231 and is formed to have a thickness less than that of the tower upper portion 231. The tower upper portion 231 has the lower surface 231*a* facing downward. The tower lower portion 232 extends downward from an inner circumferential edge of the lower surface 231*a* of the tower upper portion 231. The tower lower portion 232 has the removal stopper 232*a* protruding from the high-voltage tower 23 outwardly in a radial direction thereof. The removal stopper 232*a* is formed on substantially a middle of the tower lower portion 232 in the axial direction Z. The removal stopper 232*a* serves to hold the joint 3 from being removed from the high-voltage tower 23.

The joint 3 is fitted on the high-voltage tower 23 from beneath the high-voltage tower 23. The joint 3 covers an outer periphery of the high-voltage tower 23.

The joint 3 includes the joint upper end portion 31 which faces the case bottom wall 21 in the axial direction Z. The joint upper end portion 31 extends at the upper end of the joint 3 outwardly in the radial direction of the joint 3. The joint upper end portion 31 is of an annular shape, as viewed in the axial direction Z. In the following discussion, a surface of the joint upper end portion 31 which faces the case bottom wall 21 will be referred to as a first facing surface 311. A surface of the case bottom wall 21 which faces the joint upper end portion 31 will be referred to as a lower bottom surface 211. In this embodiment, the first facing surface 311 and the lower bottom surface 211 are placed in contact with each other.

The joint 3 has the second facing surface 312 which faces the lower end surface 232*b* of the tower lower portion 232 of the high-voltage tower 23 in the axial direction Z. The lower end surface 232*b* of the tower lower portion 232 and the second facing surface 312 are arranged away from each other through a gap in the axial direction Z. In other words, the air gap 60 is provided between the lower end surface 232*b* of the tower lower portion 232 and the second facing surface 312 in the axial direction Z. The air gap 60 serves to enhance air permeability of the void-forming groove 32 which will be described later. In a case where the lower groove 32*a* of the void-forming groove 32, which will be described later, ensures a required degree of air permeability of the void-forming groove 32, the lower end surface 232*b* of the tower lower portion 232 and the second facing surface 312 may be placed in contact with each other without an air gap therebetween.

In this embodiment, the communicating void 5 is, as illustrated in FIGS. 2 to 5, at least partially provided in the void-forming groove 32 formed in the joint 3. The void-forming groove 32 continuously extends from the inner chamber 41 to the outer chamber 42 of the joint 3 on a surface of the joint 3 facing the high-voltage tower 23. The void-forming groove 32 has the communicating void 5 defined therein. In this embodiment, the void-forming groove 32 is on the first facing surface 311 of the joint upper end portion 31. The void-forming groove 32 is also on the second facing surface 312 of the joint 3. In this embodiment, the void-forming groove 32 includes the lower groove 32*a* formed on the second facing surface 312, the upper groove 32*c* formed on the first facing surface 311, and the intermediate groove 32*b* which is formed on an inner wall of the joint 3 and communicates between the lower groove 32*a* and the upper groove 32*c*. The void-forming groove 32 may be equipped with a member which is mounted in an end thereof and works to permit air to pass therethrough, but block liquid. A valve mechanism may alternatively be mounted in the end of the void-forming groove 32.

In this embodiment, a surface of the joint 3 which faces an outer surface of the case 2 including the high-voltage tower 23 and which also excludes a portion thereof defining the void-forming groove 32 and the second facing surface 312 is placed in surface-contact with the case 2.

The case body 20, as clearly illustrated in FIG. 1, has disposed therein the primary coil 11, the secondary coil 12 arranged around the outer periphery of the primary coil 11, the core 14 located inside the primary coil 11 and the secondary coil 12, and the connecting terminal 15 joined to an end of the secondary coil 12. The metallic high-voltage output terminal 16 is fit in the high-voltage tower 23. The high-voltage output terminal 16 is connected at an upper end thereof to the secondary coil 12 through the connecting terminal 15. The high-voltage output terminal 16 is fit in the tower upper portion 231 to hermetically close an upper end of an inner space of the tower upper portion 231.

The case body 20 is filled with the resinous filler 17. Members, such as the primary coil 11, the secondary coil 12, and the connecting terminal 15 are sealed by the resinous filler 17 within the case body 20. The high-voltage output terminal 16 also serves to stop the resinous filler 17 from escaping downward from the high-voltage tower 23.

The coil spring 18 which is elastically extendable or contractable in the axial direction Z is disposed inside the high-voltage tower 23 and the joint 3. The coil spring 18 has an upper end pressed against the lower surface of the high-voltage output terminal 16 to electrically connect the coil spring 18 and the high-voltage output terminal 16. Although not illustrated, the coil spring 18 is positioned relative to the joint 3 in the axial direction Z.

The ignition device 10 which has the ignition coil 1 installed in the engine head 101 of the internal combustion engine, as illustrated in FIG. 6, will be described below.

The engine head 101, as illustrated in FIG. 6, has formed therein the plug hole 105 in which the ignition coil 1 is inserted and mounted. The plug hole 105 has an opening facing upward and also has a lower end closed by the blocking wall 102. The blocking wall 102 has formed therein the internal threaded hole 102*a* into which the spark plug 13 is screwed. Specifically, the spark plug 13 is fastened into the internal threaded hole 102*a*, so that the spark plug 13 is secured to the engine head 101. The spark plug 13 has a head exposed inside the combustion chamber 104 of the internal combustion engine.

The ignition coil 1 is arranged with the joint 3 fit in the plug hole 105. The joint 3 has a lower end portion covering an outer periphery of an upper end of the spark plug 13. This causes the inner chamber 41 of the high-voltage tower 23 and the joint 3 to be blocked at lower ends thereof by the spark plug 13 and at upper ends thereof by the high-voltage output terminal 16. The inner chamber 41 is not fully sealed, but communicates with the outer chamber 42 through the communicating void 5. The coil spring 18 has a lower end pressed against a terminal on the base of the spark plug 13, thereby electrically connecting the secondary coil 12 of the ignition coil 1 and the spark plug 13 together.

The ignition coil 1 is arranged with the joint upper end portion 31 placed on an upper surface of the engine head 101 around the plug hole 105. In this embodiment, the engine head 101 has the annular lip 106 protruding upward from a circumferential end of the plug hole 105. The ignition coil 1 has the joint upper end portion 31 placed in contact with the whole of the upper end surface 106*a* of the lip 106.

The engine head 101 has formed thereon the boss 107 to which the ignition coil 1 is fastened. The ignition coil 1 is firmly secured to the engine head 101 by inserting the bolt 108 into the bush 242 of the flange 24 and tightening the bolt 108 to achieve engagement with the threaded hole 107*a* formed in the boss 107.

Next, installation of the ignition coil 1 in the internal combustion engine will be described below. First, the spark plug 13 is screwed into the internal threaded hole 102*a* of the engine head 101. Subsequently, the joint 3 of the ignition coil 1 is inserted into the plug hole 105. The upper end portion of the spark plug 13 is inserted into the lower end of the joint 3. The ignition coil 1 is then pressed toward the spark plug 13 until the joint upper end portion 31 contacts the upper end surface 106*a* of the lip 106 of the engine head 101.

The bolt 108 is put in the bush 242 of the flange 24 and then screwed into the threaded hole 107*a* of the boss 107. This causes the spark plug 13 to be forced into the joint 3. Specifically, the axial force, as produced by the bolt 108, achieves the engagement of the spark plug with the joint 3.

The inner chamber 41, as described above, has the upper end closed by the high-voltage output terminal 16 and the lower end closed by the upper end of the spark plug 13. The insertion of the spark plug 13 into the joint 3 will, therefore, cause air in the inner chamber 41 to be ejected from the inner chamber 41 into the outer chamber 42 through the communicating void 5. This easily achieves the fitting of the joint 3 on the spark plug 13 without excessively increasing the pressure in the inner chamber 41. The bolt 108 is screwed into the boss 107 until the lower surface of the flange 24 achieves contact with the upper surface of the boss 107, thereby pressing the joint upper end portion 31 against the upper end surface 106*a* of the lip 106, so that it is adhered firmly to the whole of the upper end surface 106*a*.

The removal of the ignition coil 1 from the internal combustion engine will be described below. First, the bolt 108 is removed from the boss 107 and the flange 24. The ignition coil 1 is then pulled out of the spark plug 13. The pulling of the ignition coil 1 from the spark plug 13 will cause the inner chamber 41 to be expanded, so that outside air is sucked into the inner chamber 41 through the communicating void 5, thereby facilitating the removal of the ignition coil 1 from the spark plug 13 without undesirably making the pressure in the inner chamber 41 negative.

Next, the operations and beneficial advantages in this embodiment.

The ignition coil 1 of the internal combustion engine has the communication void 5 formed between the high-voltage tower 23 and the joint 3. When the joint 3 is fitted on or removed from the spark plug 13, the air pressure in the inner chamber 41 of the joint 3 is, therefore, substantially equal to that in the outer chamber 42. This facilitates the installation or removal of the joint 3 on or from the spark plug 13. Specifically, when the ignition coil 1 is removed from the spark plug 13, the load on a disassembling worker is decreased as a whole. The time during which a higher load is exerted on the disassembling worker is also shortened.

At least a portion of the communicating void 5 is provided in the void-forming groove 32 or 233 formed in the joint 3. This facilitates formation of the communicating void 5 and eliminates the need for an excessive increase in size of the communicating void 5. This facilitates achievement of insulation between inside and outside the joint 3 and liquid tight seal of the joint 3.

As apparent from the above discussion, this embodiment provides an ignition coil for internal combustion engines which is capable of facilitating installation or removal of a joint on or from a spark plug.

Second Embodiment

Figure 8:
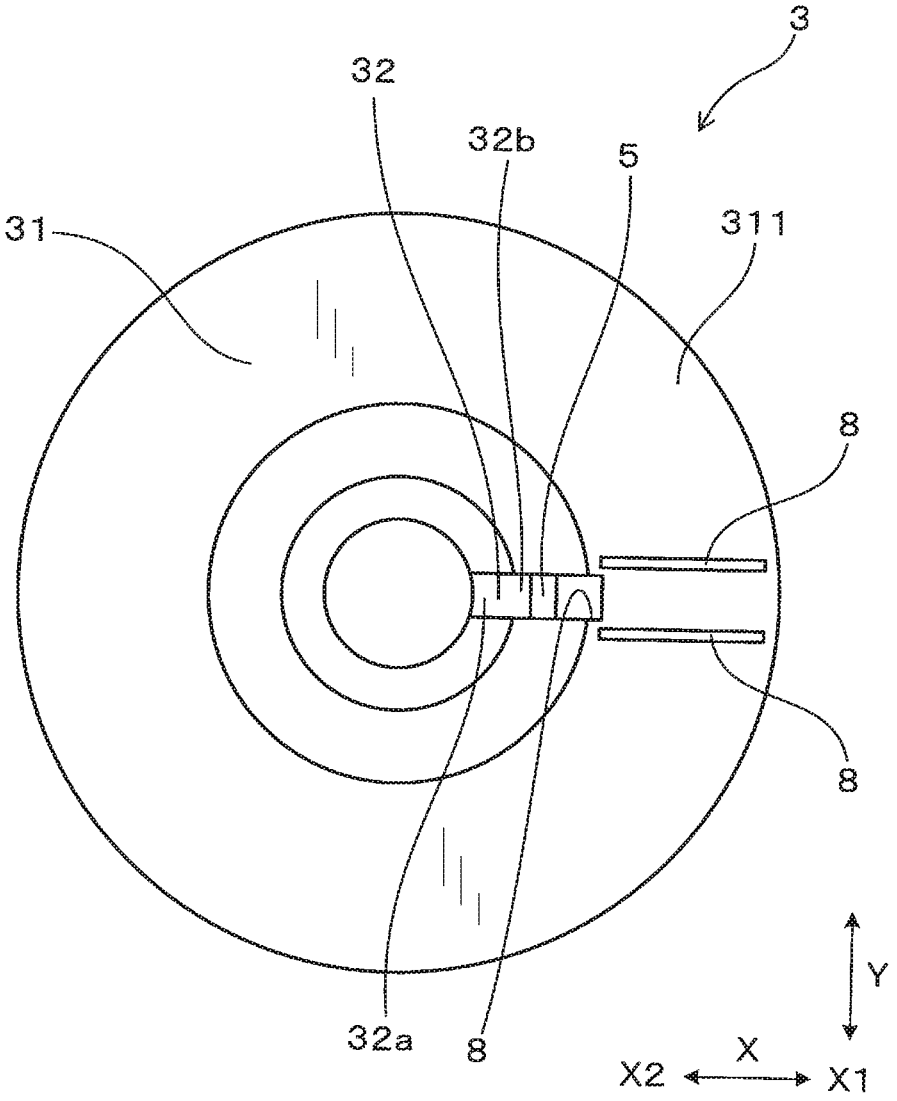
FIG. 8 is a top view of a joint in the second embodiment.
Figure 9:
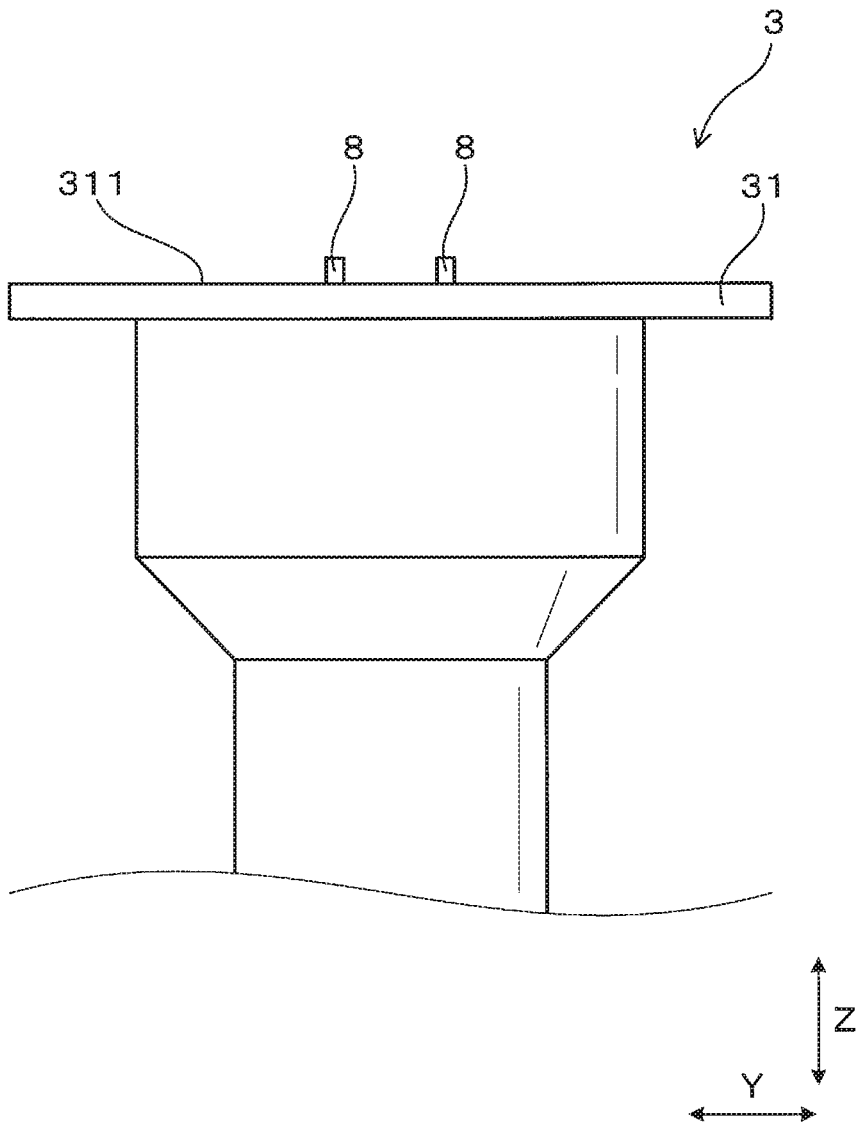
FIG. 9 is an enlarged front elevation of a joint, as viewed in a lateral direction in the second embodiment.
Figure 10:
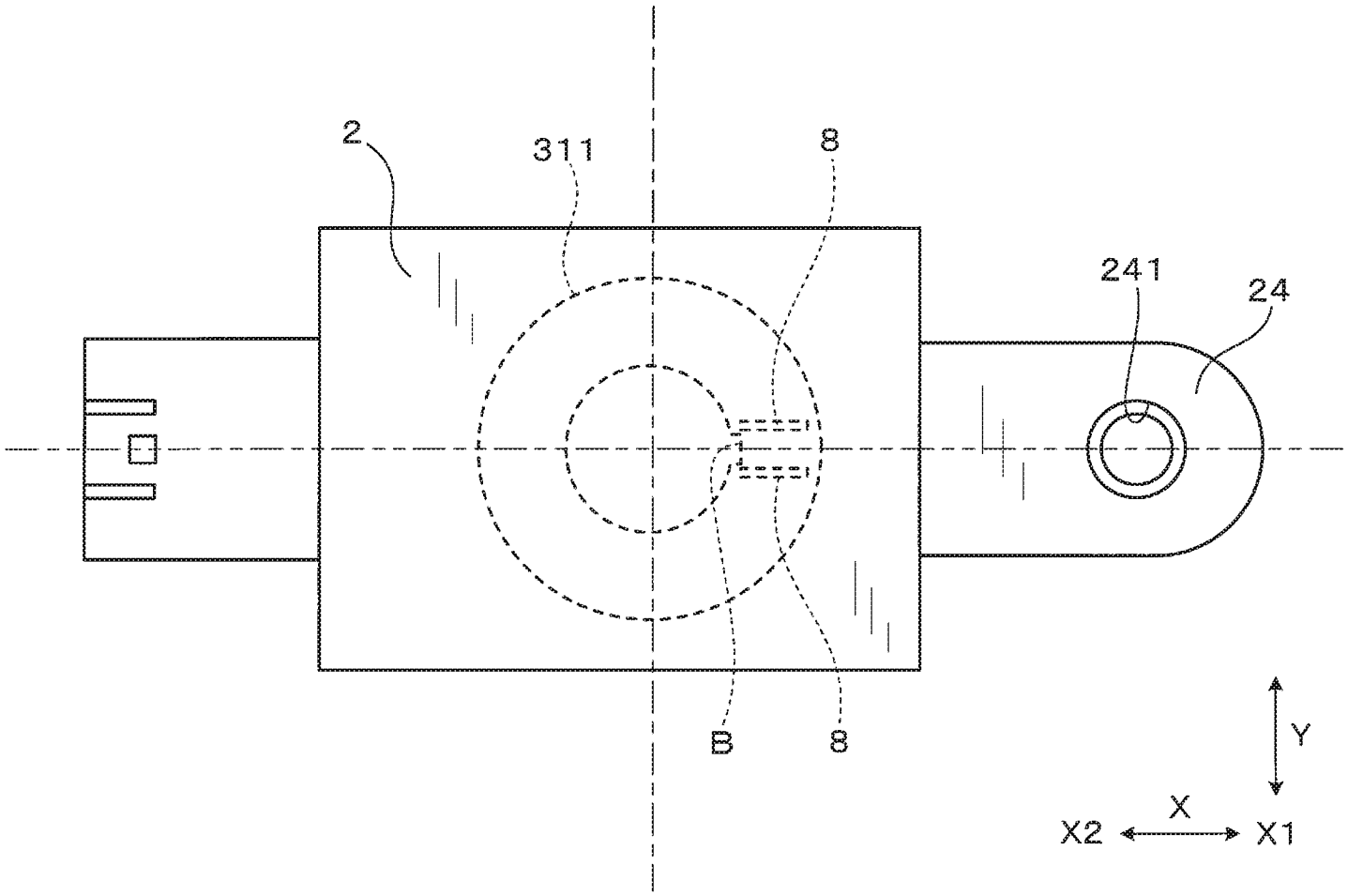
FIG. 10 is a top view of an ignition coil in the second embodiment.

This embodiment is, as illustrated in FIGS. 7 to 12, an embodiment where the bottom wall side void 51, as will be described later, defines a portion of the communicating void 5. The case bottom wall 21 is opposed to the joint upper end portion 31 through an air gap in the axial direction Z. Specifically, the bottom wall side void 51 is formed between the case bottom wall 21 and the joint upper end portion 31 adjacent the outer chamber 42. In this embodiment, the communicating void 5 includes the bottom wall side void 51, the inner space of the intermediate groove 32*b*, and the inner space of the lower groove 32*a*. In FIG. 10, an outline of the first facing surface 311 of the joint upper end portion 31 and outlines of the protrusions 8, as will be described later, are indicated by broken lines.

Figure 7:
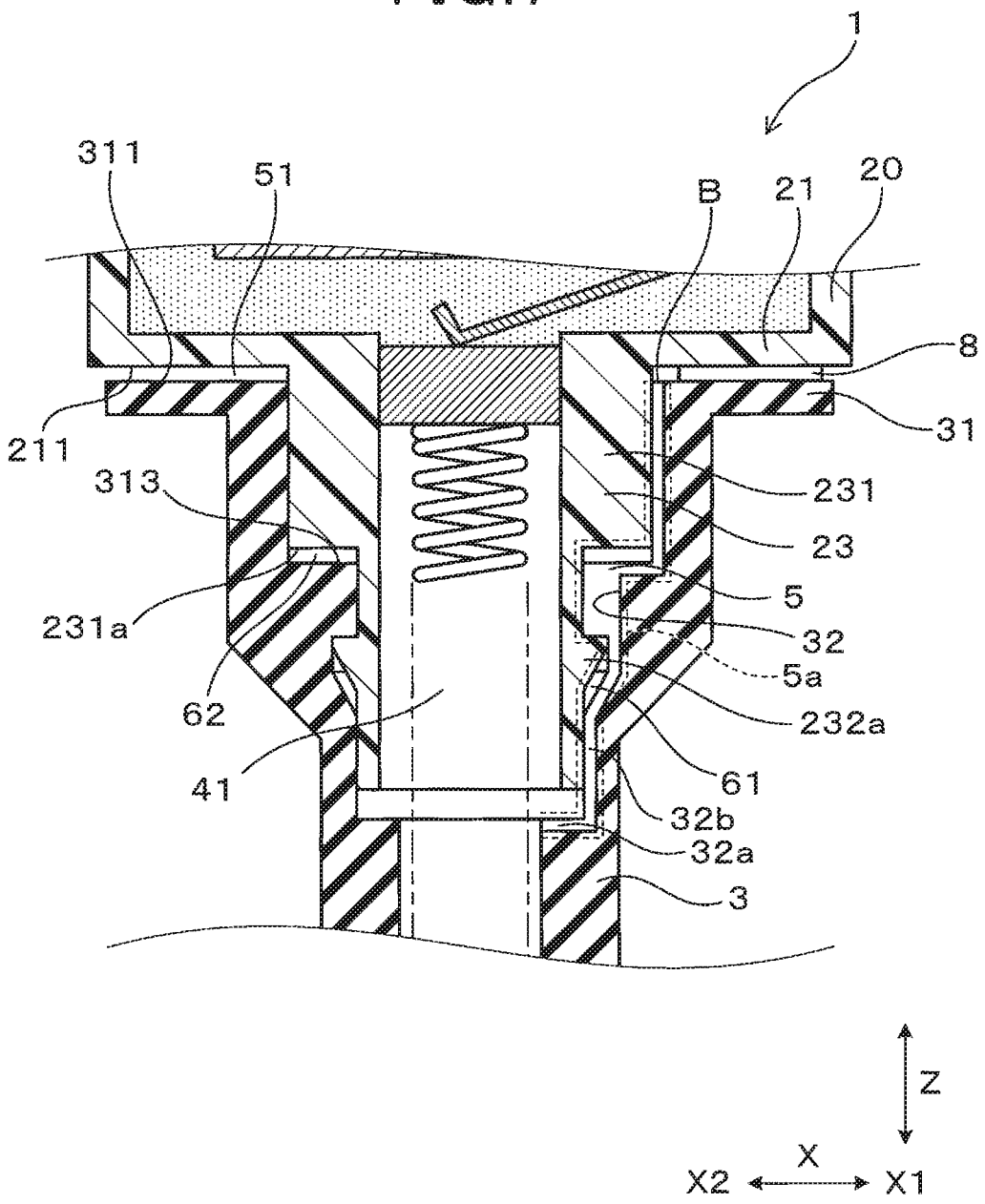
FIG. 7 is an enlarged sectional view which illustrates a region around a high-voltage tower of an ignition coil in the second embodiment.

The bottom wall side void 51 is, as clearly illustrated in FIG. 7, formed between the lower bottom surface 211 of the case bottom wall 21 and the first facing surface 311 of the joint upper end portion 31 in the axial direction Z. The bottom wall side void 51 is shaped to surround the entire circumference of the high-voltage tower 23 in the form of an annular shape, as viewed in the axial direction Z.

At least one of the case 2 and the joint 3 has the protrusions 8 which extend in the axial direction Z toward and contact the other. In this embodiment, at least one of the case bottom wall 21 and the joint upper end portion 31 is equipped with the protrusions 8. The protrusions 8 are, as illustrated in FIGS. 7 to 9, formed on the joint upper end portion 31. The protrusions 8 are formed by portions of the first facing surface 311 of the joint upper end portion 31 which bulge upward. The protrusions 8, as illustrated in FIG. 7, have upper ends placed in contact with the lower bottom surface 211 of the case bottom wall 21. The protrusions 8 serve to position the joint 3 and the case 2 in the axial direction Z. The dimension of the bottom wall side void 51 in the axial direction Z is identical with those of the protrusions 8. The protrusions 8 are formed integrally with the joint 3. Specifically, the protrusions 8 are made of rubber, so that they are elastically deformable.

The joint upper end portion 31, as illustrated in FIGS. 8 and 9, has the two protrusions 8 formed thereon. The protrusions 8 are, as can be seen in FIG. 8, of a convex shape and elastically deformable in the axial direction Z. In this embodiment, the protrusions 8 have a length extending in the lateral direction X and are thin to have a thickness in the vertical direction Y. The two protrusions 8 are arranged adjacent each other in the vertical direction Y.

In this disclosure, a border, as illustrated in FIG. 7, between the bottom wall side void 51 and a portion of the communicating void 5 which is located closer to the inner chamber 41 than the bottom wall side void 51 is (i.e., a portion of the communicating void 5, as enclosed by a broken line in FIG. 7) is defined as the boundary portion B. In other words, a border between the bottom wall side void 51 and the inner space of the intermediate groove 32*b* is the boundary portion B. The protrusions 8 are formed around the boundary portion B to minimize ingress of foreign matter, such as water or dust, into the inner chamber 41 from the outer chamber 42.

Specifically, the boundary portion B is located on the side X1 of the center axis of the high-voltage tower 23. When viewed in the axial direction Z, the boundary portion B lies on a straight line, as indicated by a two-dot chain line in FIG. 10, passing through the center axis of the high-voltage tower 23 and the center axis of the bolt hole 241 of the flange 24. The two protrusions 8 are, as illustrated in FIG. 8, formed near the boundary portion B on the side X1 in lateral direction X. The protrusions 8 are arranged on opposite sides of the boundary portion B in the vertical direction Y. When viewed in the axial direction Z in FIG. 10, the protrusions 8 are opposed to each other in the vertical direction Y and located on opposite sides of the straight line, as indicated by the two-dot chain line in FIG. 10, which passes through the center axis of the high-voltage tower 23 and the center axis of the bolt hole 241 of the flange 24.

When viewed in the axial direction Z in FIG. 10, the protrusions 8 are located closer to the flange 24 than the center axis of the high-voltage tower 23 is in a direction in which the center axis of the high-voltage tower 23 is aligned with the flange 24 (i.e., in the lateral direction X. In FIG. 10, a straight line passing through the center axis of the high-voltage tower 23 in the vertical direction Y is indicated by an alternate long and short dash line. Specifically, in this embodiment, the protrusions 8 are located on the side X1 of the line indicated by the alternate long and short dash line in FIG. 10.

In this embodiment, the lower surface 231*a* of the tower upper portion 231 and the joint 3, as illustrated in FIG. 7, face each other through an air gap in the axial direction Z. A surface of the joint 3 facing the lower surface 231*a* of the tower upper portion 231 in the axial direction Z is referred to as a third facing surface 313. The upper slide void 62 is created between the lower surface 231*a* of the tower upper portion 231 and the third facing surface 313 of the joint 3. The lower slide void 61 is formed below the removal stopper 232*a*. The removal stopper 232*a* faces the joint 3 through the lower slide void 61 in the axial direction Z. The dimensions of the upper slide void 62 and the lower slide void 61 in the axial direction Z are greater than or equal to that of the bottom wall side void 51 in the axial direction Z.

Figure 11:
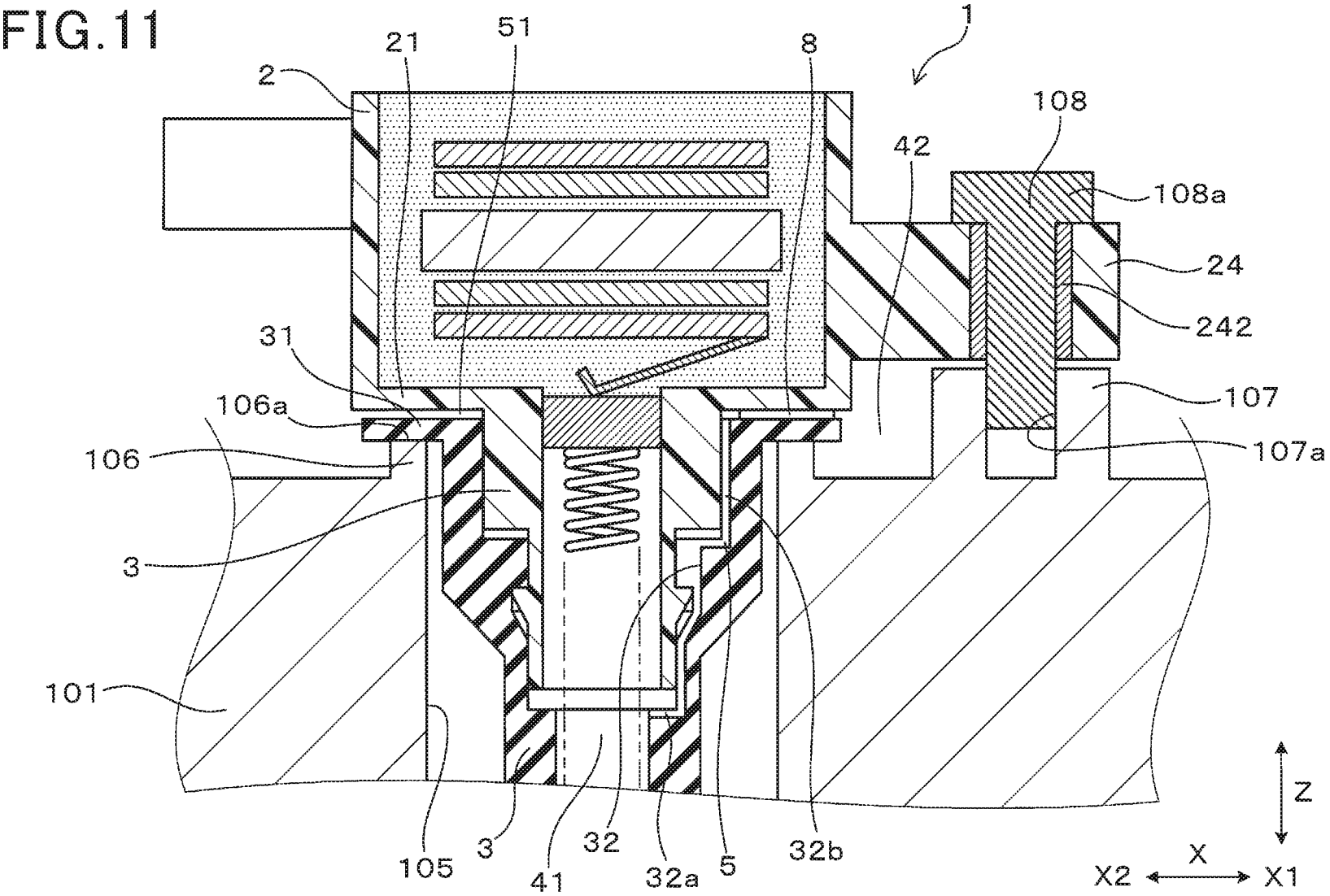
FIG. 11 is an enlarged sectional view of an ignition device before an axial force, as produced by a bolt, is exerted on a case in the second embodiment.

Next, installation of the ignition coil 1 in the internal combustion engine will be described below with reference to FIGS. 11 and 12.

First, the joint 3 of the ignition coil 1 is, like in the first embodiment, inserted into the plug hole 105 to have the upper end of the spark plug fit in the lower end of the joint 3. The upper end portion of the spark plug is, like in the first embodiment, inserted into the lower end of the joint 3. The ignition coil 1 is then pressed toward the spark plug until the joint upper end portion 31 contacts the upper end surface 106*a* of the lip 106 of the engine head 101.

Next, the bolt 108 is put in the bush 242 of the flange 24 and then screwed into the threaded hole 107*a* of the boss 107 until the head 108*a* of the bolt 108 contacts the upper surface of the flange 24. This is illustrated in FIG. 11. In this condition, the axial force, as produced by the bolt 108, does not act on the ignition coil 1, so that the protrusions 8 are not elastically deformed, thereby keeping the bottom wall side void 51 as it is.

Subsequently, the bolt 108 is further tightened into the boss 107 from the condition in FIG. 11. This transmits the axial force from the bolt 108 to the case 2 of the ignition coil 1 to move the case 2 downward toward the joint 3. The joint upper end portion 31 is, as described above, placed in contact with the lip 106, thereby stopping the joint 3 from moving downward even when the case 2 is moved downward by the axial force produced by the bolt 108. The fastening of the bolt 108 into the boss 107, thus, causes the protrusions 8 to be elastically deformed or compressed in the axial direction Z. In other words, the fastening of the bolt 108 into the boss 107 causes the bottom wall side void 51 to be contracted.

Figure 12:
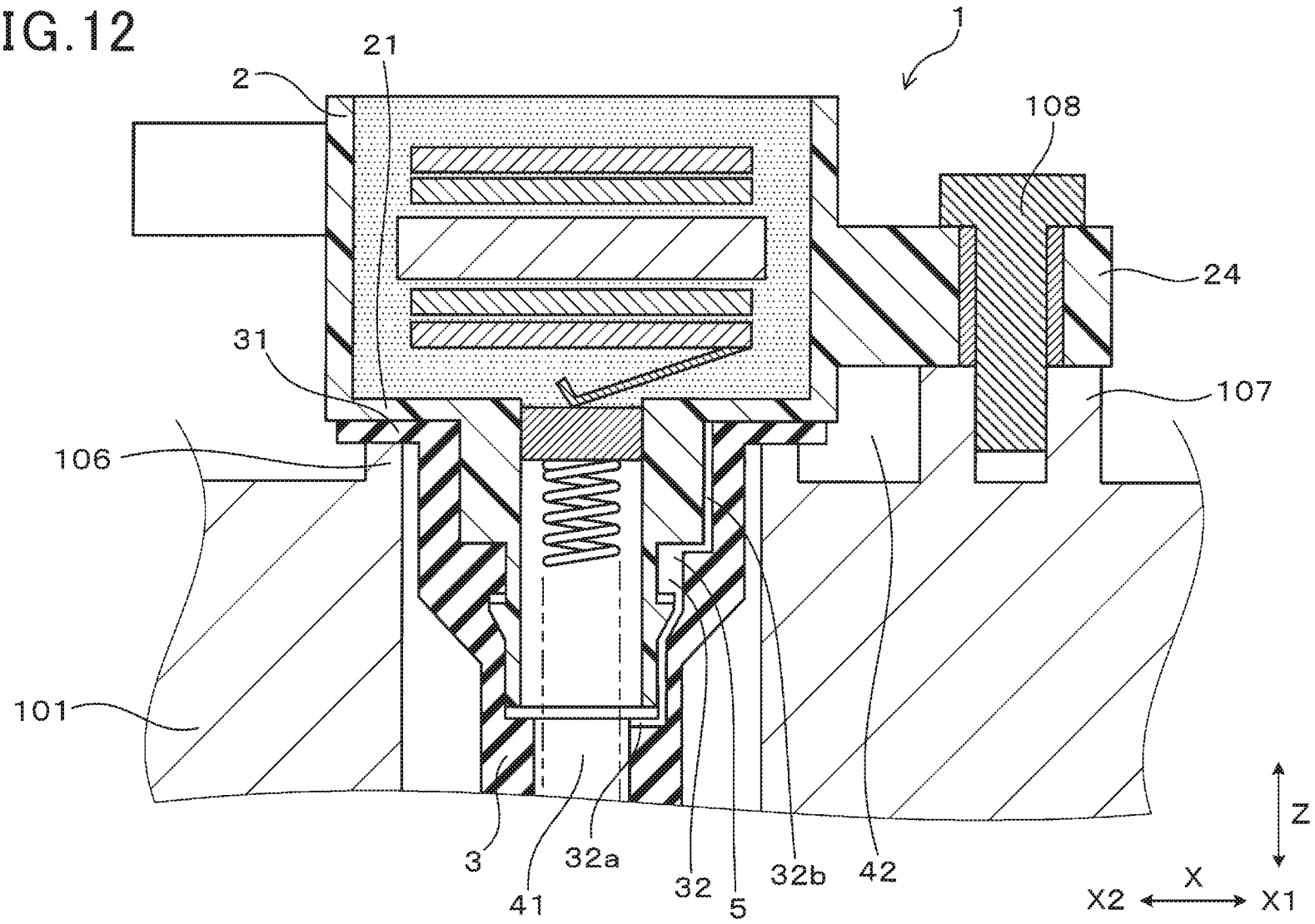
FIG. 12 is an enlarged sectional view of an ignition device equipped with an ignition coil in the second embodiment.

When the bolt 108 is fastened until the lower surface of the flange 24 of the case 2 contacts the upper surface of the boss 107, it will cause the bottom wall side void 51, as illustrated in FIG. 12, to substantially disappear. For example, the protrusions 8 are elastically deformed until the dimension of the bottom wall side void 5 in the axial direction Z becomes 0.02 mm to 0.5 mm. In other words, the communicating void 5 which is created before the ignition coil 1 is installed in the internal combustion engine is fully or almost closed after the ignition coil 1 is installed in the internal combustion engine.

The removal of the ignition coil 1 from the internal combustion engine will be described below.

First, the bolt 108 is, like in the first embodiment, removed from the boss 107 and the flange 24. This causes the axial force exerted by the bolt 108 on the case 2 to disappear, so that the case 2 is moved by the resilience of the protrusions 8 away from the joint 3. This creates the bottom wall side void 51 again between the case bottom wall 21 and the joint upper end portion 31 or increases the volume of the bottom wall side void 51 to be more than that when the bolt 108 is screwed into the flange 24, thereby establishing fluid communication between the communicating void 5 and the outer chamber 42.

The ignition coil 1 is pulled out of the spark plug 13. The pulling of the ignition coil 1 from the spark plug 13 causes the inner chamber 41 to expand, so that outside air is sucked into the inner chamber 41 through the communicating void 5. This facilitates the ease with which the ignition coil 1 is pulled out of the spark plug 13 without making the pressure in the inner chamber 41 negative.

Other arrangements are identical with those in the first embodiment.

The same reference numbers in the second and following embodiments as those in the previous embodiment(s) will refer to the same parts unless otherwise specified.

In this embodiment, the bottom wall side void 51 constitutes a portion of the communicating void 5. This facilitates the formation of the portion of the communicating void 5 and improves the ease of production of the ignition coil 1.

The joint 3 includes the protrusions 8 which project toward the case 2 in the axial direction Z and contact the case 2. The protrusions 8 are used to align the case 2 and the joint 3 in the axial direction Z, which facilitates the ease of creation of the bottom wall side void 51.

The joint upper end portion 31 is equipped with the protrusions 8, thereby facilitating the formation of the protrusions 8 on the joint 3.

The protrusions 8 are elastically deformable in the axial direction Z and of a convex shape bulging perpendicular to the axial direction Z. Before the ignition coil 1 is fastened to the internal combustion engine, the protrusions 8, thus, serve to keep the bottom wall side void 51 as it is. When the ignition coil 1 is installed in the internal combustion engine, the axial force, as produced by the bolt 108, works to elastically deform the protrusions 8, thereby causing the bottom wall side void 51 to disappear easily. Therefore, after the ignition coil 1 is mounted in the internal combustion engine, it is possible to minimize the ingress of foreign matter, such as water or dust, into the inner chamber 41 through the communicating void 5 from the outer chamber 42 of the ignition coil 1. This prevents a high-voltage of, for example, 10 to 50 kV developed at the high-voltage output terminal 16 from being conducted from inside to outside the joint 3 through the foreign matter. The corrosion of metallic members, such as the coil spring 18 and the terminal on the base of the spark plug 13 disposed inside the joint 3, is also avoided, thereby ensuring the stability in conduction between the ignition coil 1 and the spark plug 13.

As viewed in the axial direction Z, the protrusions 8 are located closer to the flange 24 than the center axis of the high-voltage tower 23 is in a direction in which the flange 24 and the high-voltage tower 23 are aligned with each other. This facilitates transmission of the axial force, as produced by the bolt 108 fastened into the bolt hole 241 of the flange 24, to the protrusions 8 when the ignition coil 1 is mounted in the internal combustion engine. This ensures the elastic deformation of the protrusions 8 to block the communication void 5 when the ignition coil 1 has been installed in the internal combustion engine.

The protrusions 8 are arranged around the boundary portion B to minimize the entry of foreign matter from the outer chamber 42 into the inner chamber 41 through the boundary portion B. Specifically, the protrusions 8 work to block the ingress of foreign matter, as having entered the bottom wall side void 51 from the outer chamber 42, into the inner chamber 41 through the boundary portion B of the communicating void 5.

This embodiment has substantially the same beneficial advantages as those in the first embodiment.

Figure 13:
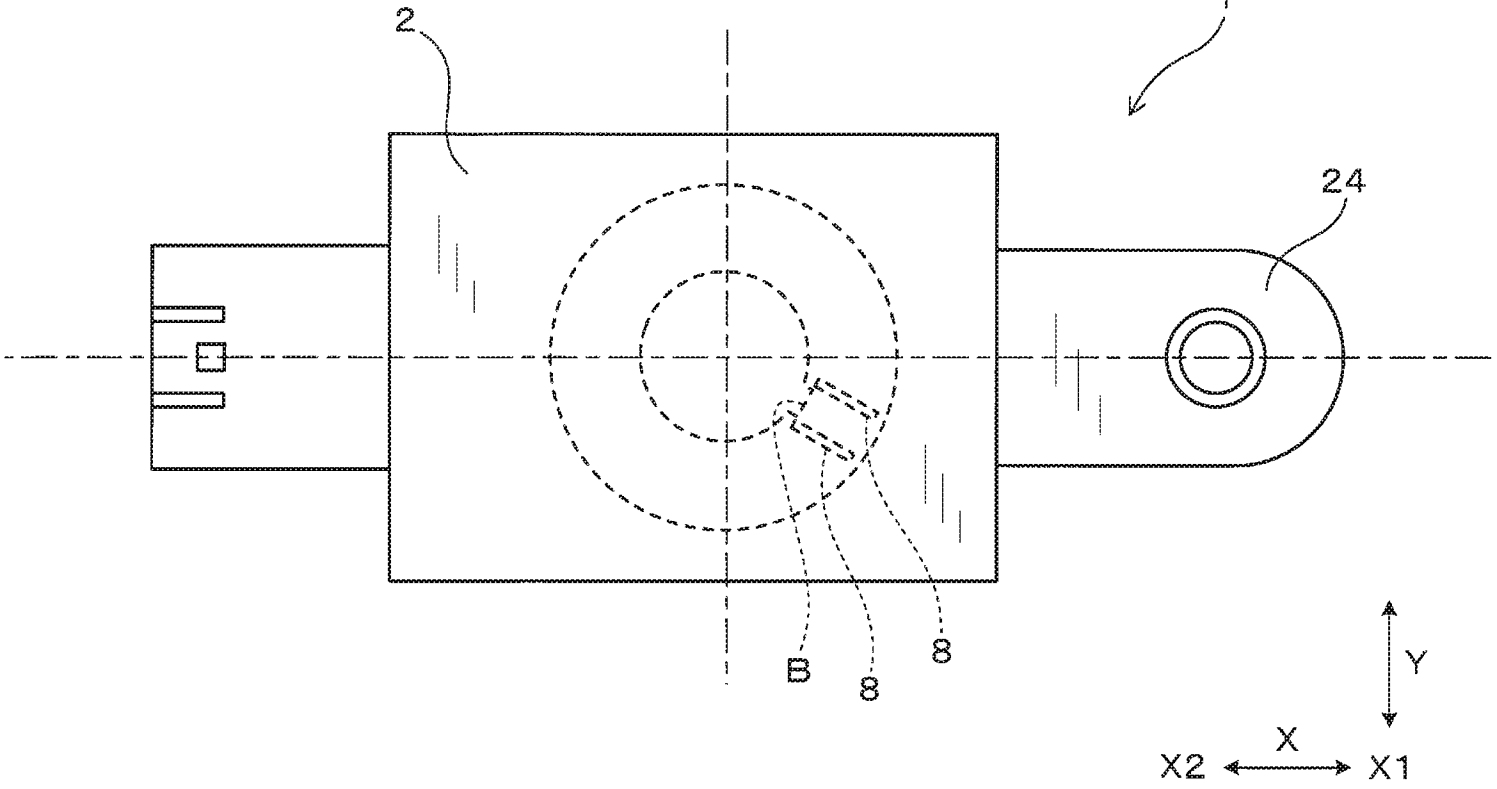
FIG. 13 is a top view of a modification of the second embodiment.

Both the two protrusions 8 may be, as illustrated in FIG. 13, arranged on one side of the center axis of the high-voltage tower 23 in the vertical direction Y. In other words, the protrusions 8 may be located on one of opposite sides of an alternate long and short dash line in FIG. 13 in the vertical direction Y. It is advisable that he boundary portion B of the communicating void 5 be selected to have the protrusions 8 arranged therearound.

Figure 14:
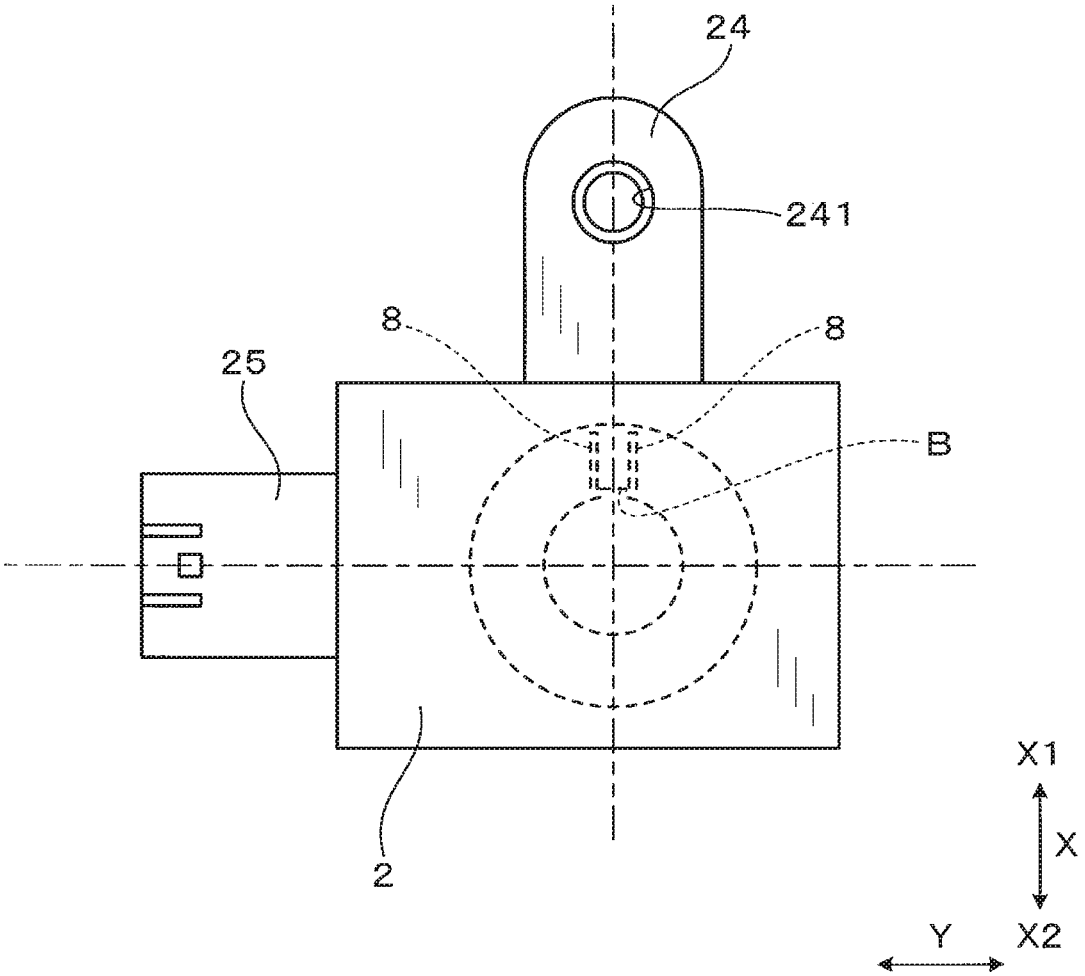
FIG. 14 is a top view of another modification of the second embodiment.

In a case, as illustrated in FIG. 14, where the direction in which the flange 24 of the case 2 extends is perpendicular to the direction in which the connector 25 of the case 2 extends, the protrusions 8 may be located closer to the flange 24 than the center axis of the high-voltage tower 23 is in the direction in which the center of the high-voltage tower 23 and the flange 24 are aligned with each other. In FIG. 14, a straight line passing through the center axis of the high-voltage tower 23 perpendicular to the direction in which the center axis of the high-voltage tower 23 and the flange 24 are aligned with each other is indicated by an alternate long and short dash line. The protrusions 8 are arranged closer to the flange 24 than the alternate long and short dash line is in FIG. 14. In the case of FIG. 14, it is advisable that the boundary portion B be defined closer to the flange 24 than the center axis of the high-voltage tower 23 is and also arranged on the alternate long and short dash line in FIG. 14 passing through the center axis of the high-voltage tower 23 and the bolt hole 241, as viewed in the axial direction Z. This facilitates transmission of the axial force, as produced by the bolt 108 fastened into the bolt hole 241 of the flange 24, to the protrusions 8 when the ignition coil 1 is mounted in the internal combustion engine. This ensures the elastic deformation of the protrusions 8 to block the communication void 5 when the ignition coil 1 has been installed in the internal combustion engine.

Figure 15:
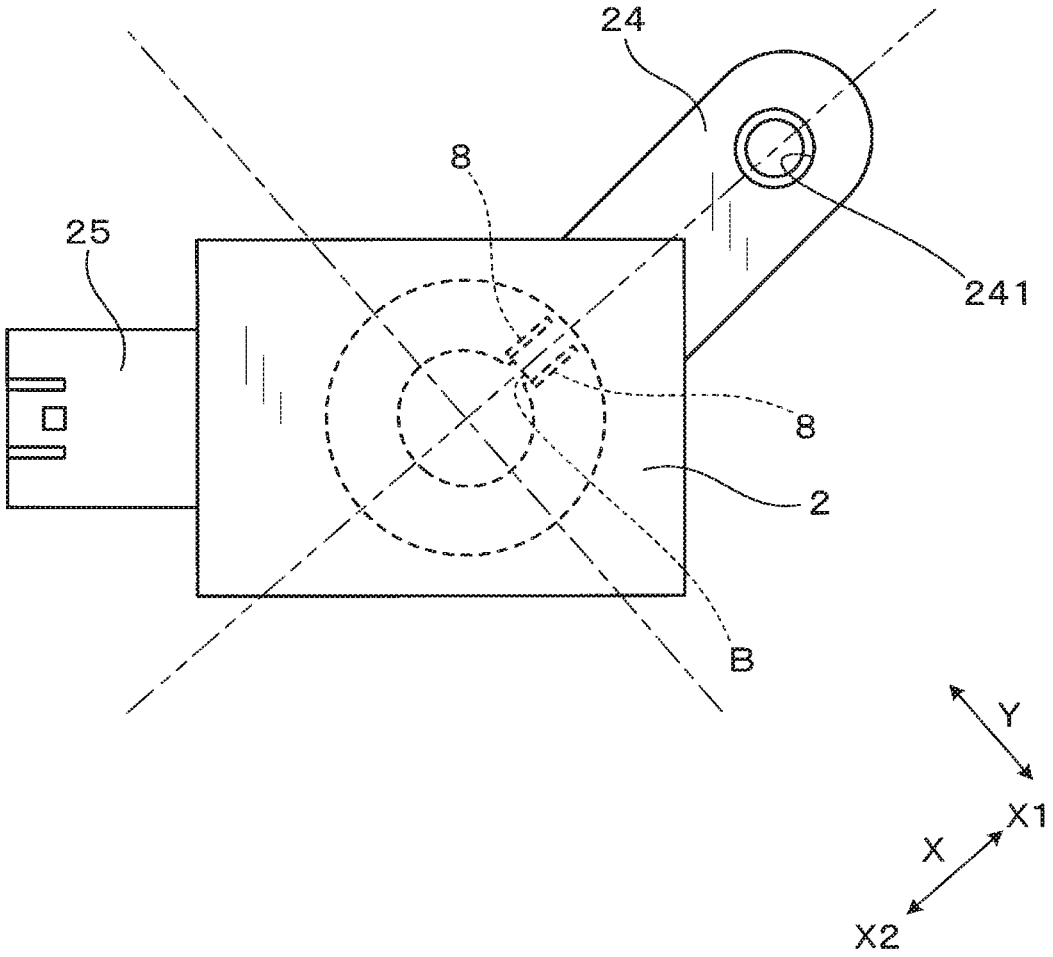
FIG. 15 is a top view of another modification of the second embodiment.

In a case, as illustrated in FIG. 15, where the direction in which the flange 24 of the case 2 extends is oblique to the direction in which the connector 25 of the case 2 extends, the protrusions 8 may be located closer to the flange 24 than the center axis of the high-voltage tower 23 is in the direction in which the center of the high-voltage tower 23 and the flange 24 are aligned with each other. In FIG. 15, a straight line passing through the center axis of the high-voltage tower 23 perpendicular to the direction in which the center axis of the high-voltage tower 23 and the flange 24 are aligned with each other is indicated by an alternate long and short dash line. The protrusions 8 are arranged closer to the flange 24 than the alternate long and short dash line is in FIG. 15. In the case of FIG. 15, it is advisable that the boundary portion B be defined closer to the flange 24 than the center axis of the high-voltage tower 23 is and also arranged on the alternate long and short dash line in FIG. 15 passing through the center axis of the high-voltage tower 23 and the bolt hole 241, as viewed in the axial direction Z. This facilitates transmission of the axial force, as produced by the bolt 108 fastened into the bolt hole 241 of the flange 24, to the protrusions 8 when the ignition coil 1 is mounted in the internal combustion engine. This ensures the elastic deformation of the protrusions 8 to block the communication void 5 when the ignition coil 1 has been installed in the internal combustion engine.

In this embodiment, the dimensions of the upper slide void 62 and the lower slide void 61 in the axial direction Z are selected to be greater than that of the bottom wall side void 51 in the axial direction Z, but however, it may be changed. For instance, the dimensions of the upper slide void 62 and the lower slide void 61 in the axial direction Z may alternatively be selected to be smaller than that of the bottom wall side void 51 in the axial direction Z. In this case, when the ignition coil 1 is installed in the internal combustion engine, the screwing of the bolt 108 will cause the lower surface 231*a* of the tower upper portion 231 contact the third facing surface 313 of the joint 3, so that the upper slide void 62 disappears and also cause the removal stopper 232*a* of the high-voltage tower 23 to contact the joint 3 in the axial direction Z, so that the lower slide void 61 disappears. The additional screwing of the bolt 108 from such a condition causes the axial force produced by the bolt 108 to be transmitted from the case 2 to the joint 3 in the axial direction Z, thereby elastically deforming the joint 3 to move the case 2 downward to compress the bottom wall side void 51.

Third Embodiment

Figure 16:
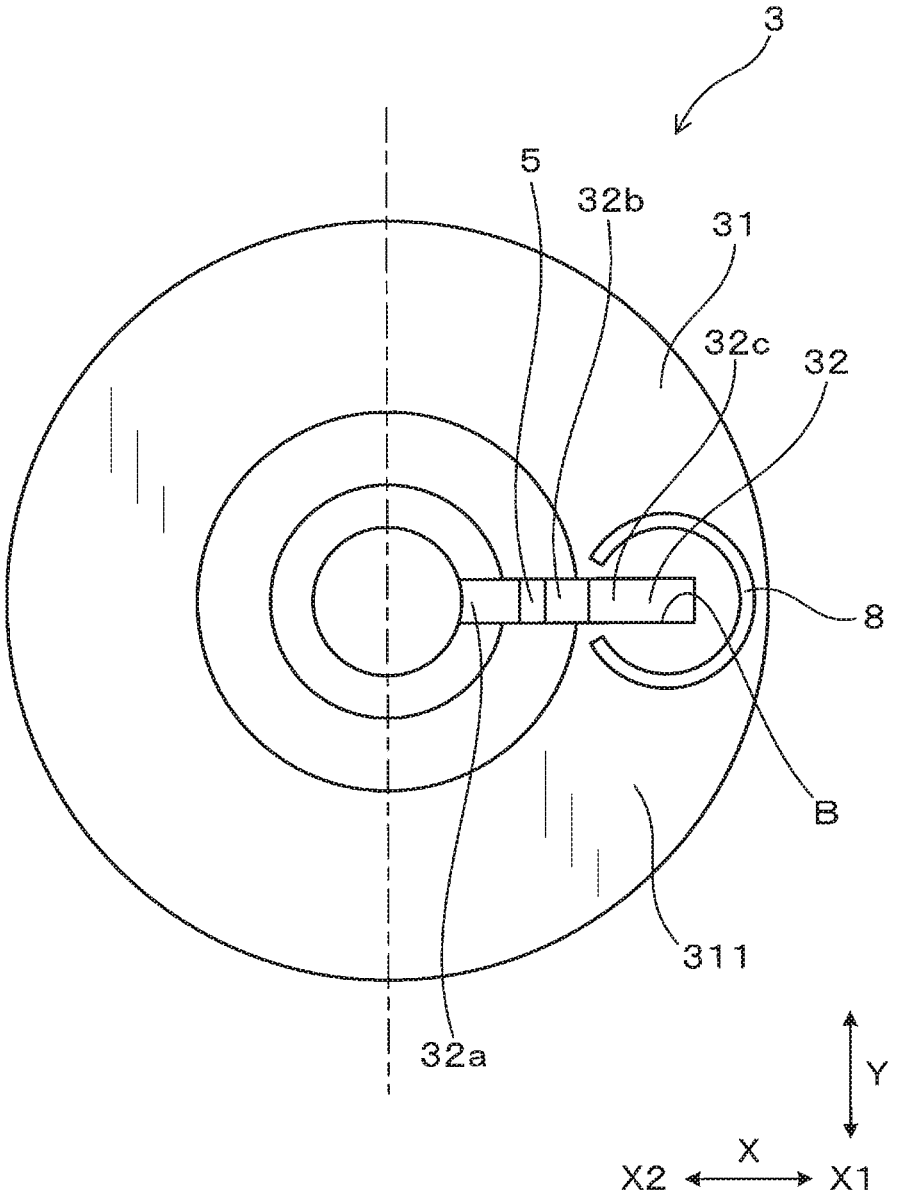
FIG. 16 is a top view of a joint in the third embodiment.
Figure 17:
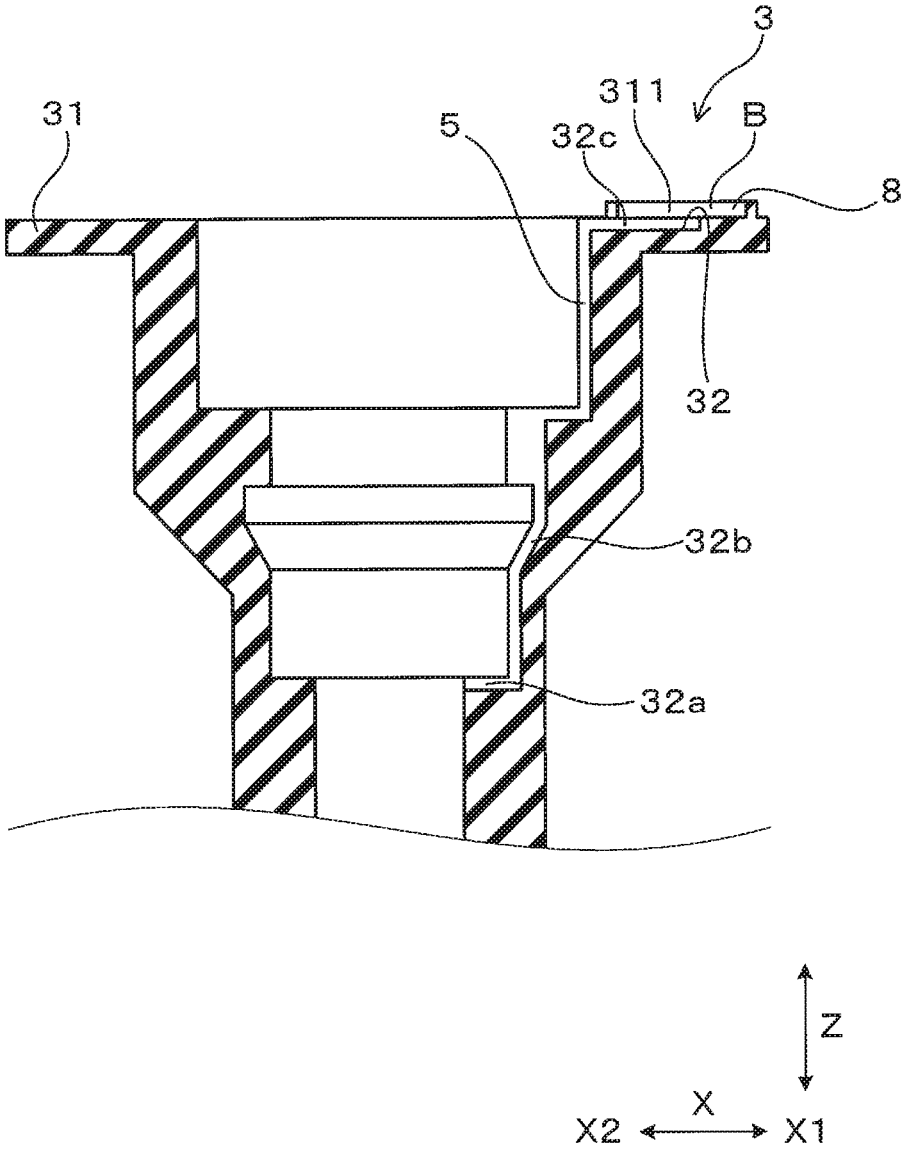
FIG. 17 is a sectional view parallel to an axial direction of a joint and an enlarged sectional view passing through a void-forming groove in the third embodiment.

This embodiment is, as illustrated in FIGS. 16 and 17, a modification of the second embodiment which includes the protrusion 8 of a C-shape with an opening facing the center of the joint 3, as viewed in the axial direction Z.

In this embodiment, the first facing surface 311 of the joint upper end portion 31 has formed therein the upper groove 32*c* that is a portion of the void-forming groove 32 constituting the communicating void 5. As viewed in the axial direction Z, the upper groove 32*c* of the void-forming groove 32 formed in the first facing surface 311, as illustrated in FIG. 16, continuously extends from the opening of the protrusion 8 to inside the protrusion 8. As viewed in the axial direction Z, the boundary portion B of the communicating void 5 is formed to continuously extend from the opening of the protrusion 8 to inside the protrusion 8. A least a portion of the boundary portion B lies inside the C-shaped protrusion 8.

Other arrangements are identical with those in the second embodiment.

In this embodiment, at least a portion of the boundary portion B of the communicating void 5 is located inside the C-shaped protrusion 8. This enhances the avoidance of entry of foreign matter, intruding into the bottom wall side void 51 from the outer chamber 42 of the high-voltage tower 23 and the joint 3, into the inner chamber 41 of the high-voltage tower 23 and the joint 3 from the boundary B of the communicating void 5.

Other arrangements are identical with those in the second embodiment.

Fourth Embodiment

Figure 18:
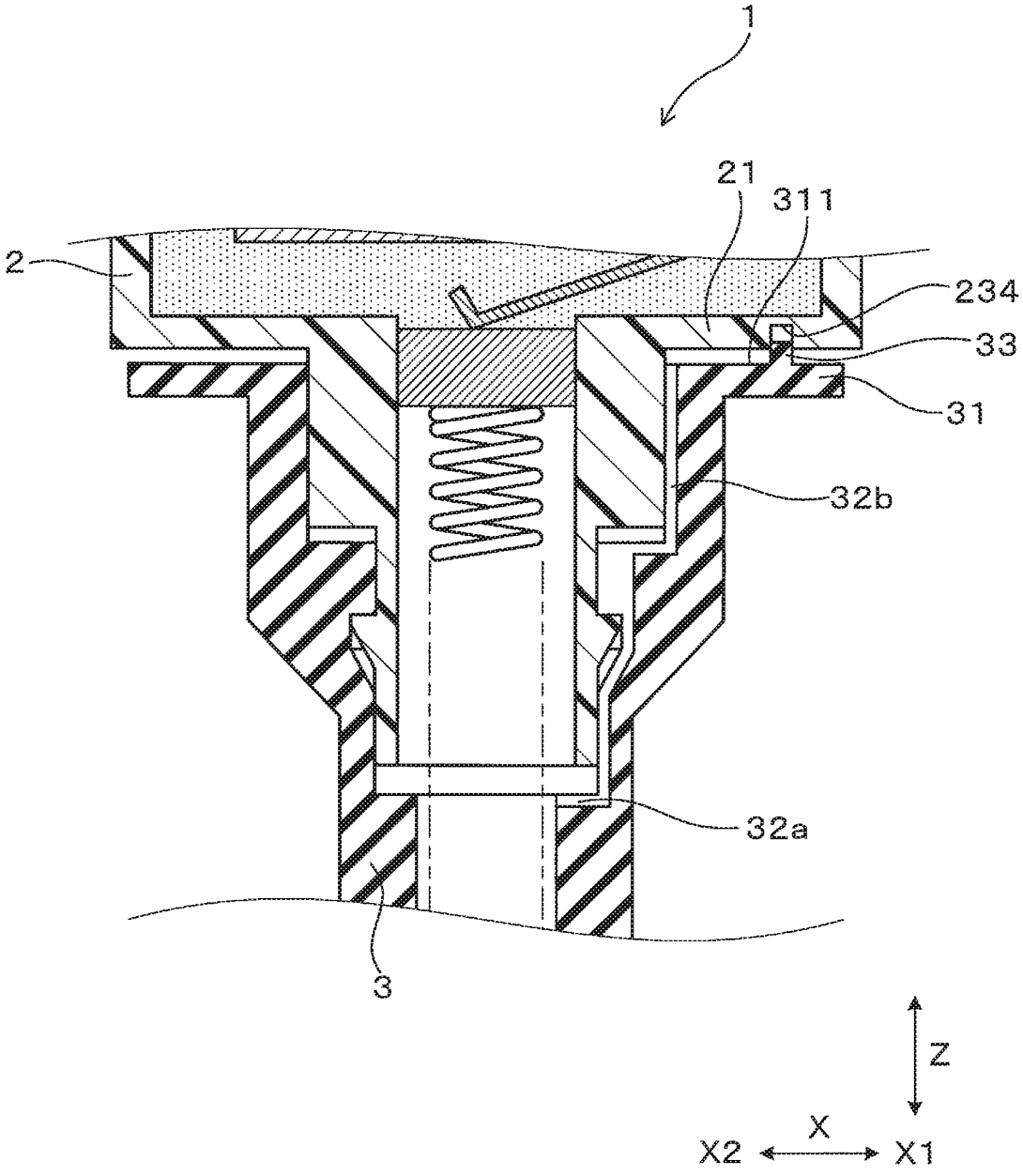
FIG. 18 is an enlarged sectional view which illustrates a region around a high-voltage tower of an ignition coil in the fourth embodiment.
Figure 19:
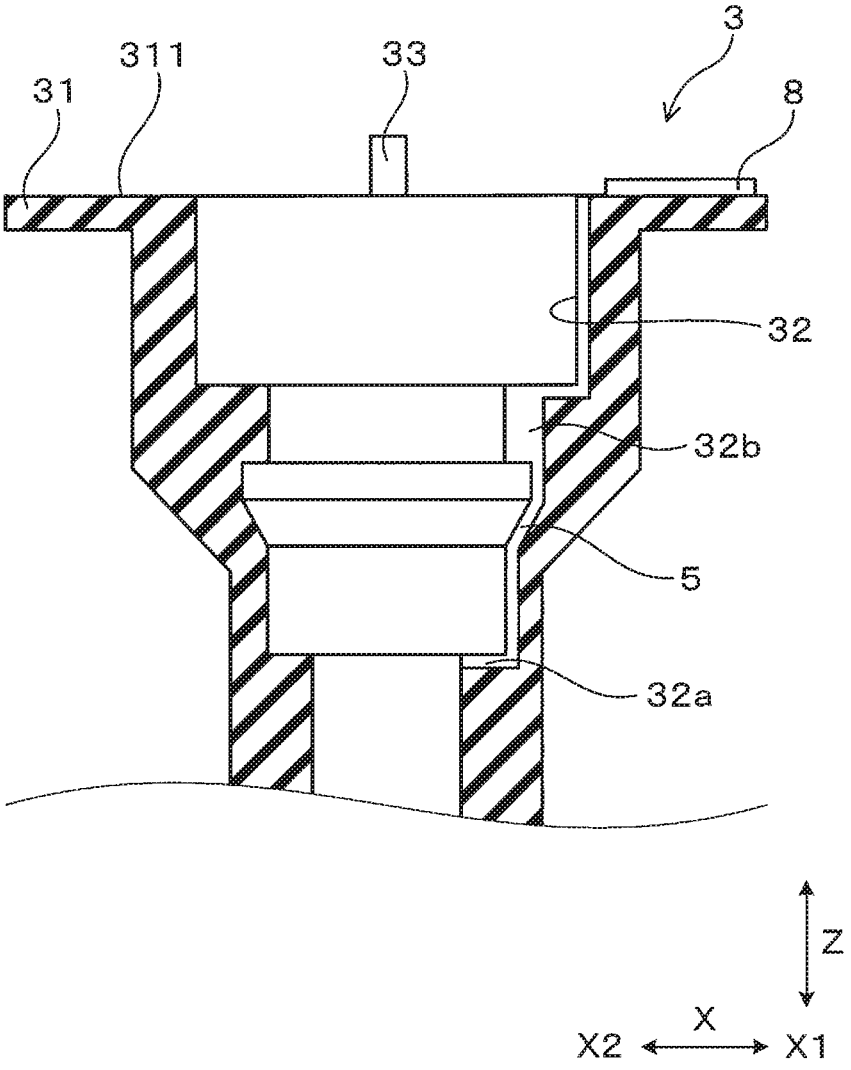
FIG. 19 is a sectional view parallel to an axial direction of a joint and an enlarged sectional view passing through a void-forming groove in the fourth embodiment.
Figure 20:
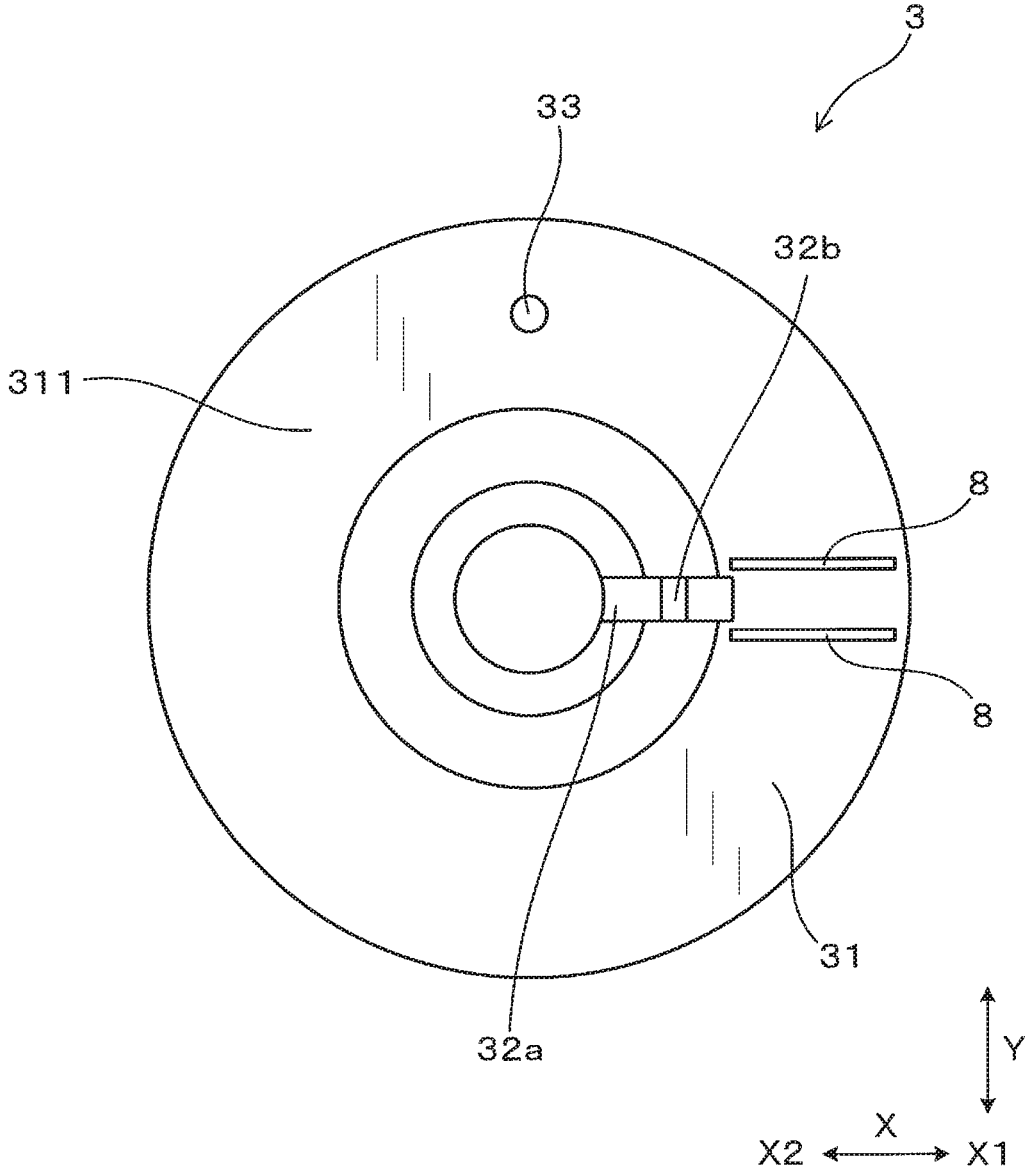
FIG. 20 is a top view of a joint in the fourth embodiment.
Figure 21:
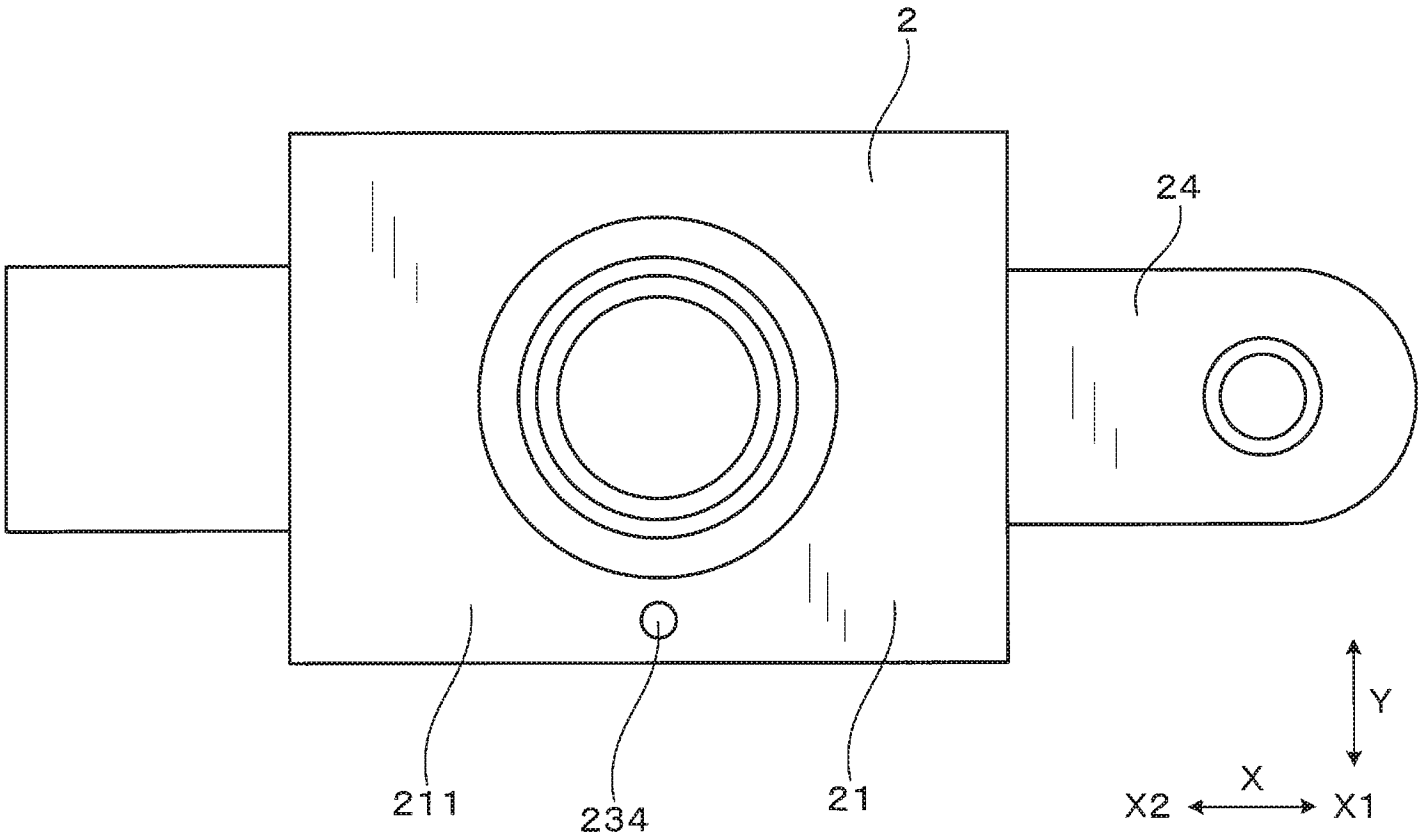
FIG. 21 is a bottom view of a case in the fourth embodiment.

This embodiment is, as clearly illustrated in FIGS. 18 to 21, a modification of the second embodiment in which a positioning means for achieving alignment between the case 2 and the joint 3 in a circumferential direction. The joint upper end portion 31, as illustrated in FIGS. 18 to 20, has the engaging protrusion 33 bulging toward the case bottom wall 21. The case bottom wall 21, as illustrated in FIGS. 18 and 21, has the engaging recess 234 in which the engaging protrusion 33 is fit. The engaging protrusion 33 and the engaging recess 234, as can be seen in FIG. 18, serve to position the case 2 and the joint 3 in the circumferential direction.

The engaging protrusion 33, as illustrated in FIGS. 18 to 20, extends upward from the first facing surface 311 of the joint upper end portion 31. The engaging protrusion 33 is of a substantially cylindrical shape. The engaging recess 234 is, as illustrated in FIGS. 18 and 21, hollowed upward in a portion of the lower bottom surface 211 of the case bottom wall 21. In this embodiment, the dimension of the engaging recess 234 in the axial direction Z is greater than that of the engaging protrusion 33 in the axial direction Z, so that an air gap is created between the engaging protrusion 33 and the engaging recess 234 when the ignition coil 1 is fastened to the internal combustion engine, and the first facing surface 311 of the joint upper end portion 31 is placed in surface-contact with the lower bottom surface 211 of the case bottom wall 21 in the axial direction Z.

The engaging protrusion 33 and the engaging recess 234 are, as illustrated in FIG. 18, formed on one of opposite sides of the center axis of the joint 3 in the vertical direction Y. The engaging protrusion 33 is, as clearly illustrated in FIG. 20, located at 90° away from the protrusions 8 in the circumferential direction of the joint 3. The engaging recess 234 is, therefore, arranged at 90° away from the protrusion 8 in the circumferential direction of the joint 3. The locations of the engaging protrusion 33 and the engaging recess 234 are, however, not limited to the ones described in this embodiment.

Other arrangements are identical with those in the second embodiment.

This embodiment facilitates the positioning of the joint 3 and the case 2 in the circumferential direction of the joint 3. For instance, in a case where the protrusions 8 are arranged on the joint upper end portion 31 close to the flange 24, the joint 3 and the case 2 will be joined together so as to have the protrusions 8 close to the flange 24. Alternatively, in a case where the protrusions 8 are formed on the case bottom wall 21, the joint 3 and the case 2 will be joined together so as to have the protrusions 8 arranged around the boundary B of the communicating void 5.

This embodiment offers substantially the same beneficial advantages as those in the second embodiment.

Fifth Embodiment

This embodiment is an embodiment, as illustrated in FIGS. 22 to 28, in which the case bottom wall 21 has formed therein the receiving recesses 235 which contact the protrusion 8 in the axial direction Z. The protrusion 8 is fit in the receiving recess 235 when the ignition coil 1 is installed in the internal combustion engine. The fitting of the protrusion 8 in the receiving recess 235 is, as will be described later, achieved in this embodiment by exerting the axial force, as produced by the bolt 108, on the protrusion 8 to elastically deform it and pressing the protrusion 8 into the receiving recess 235 when the ignition coil 1 is installed in the internal combustion engine.

Figure 24:
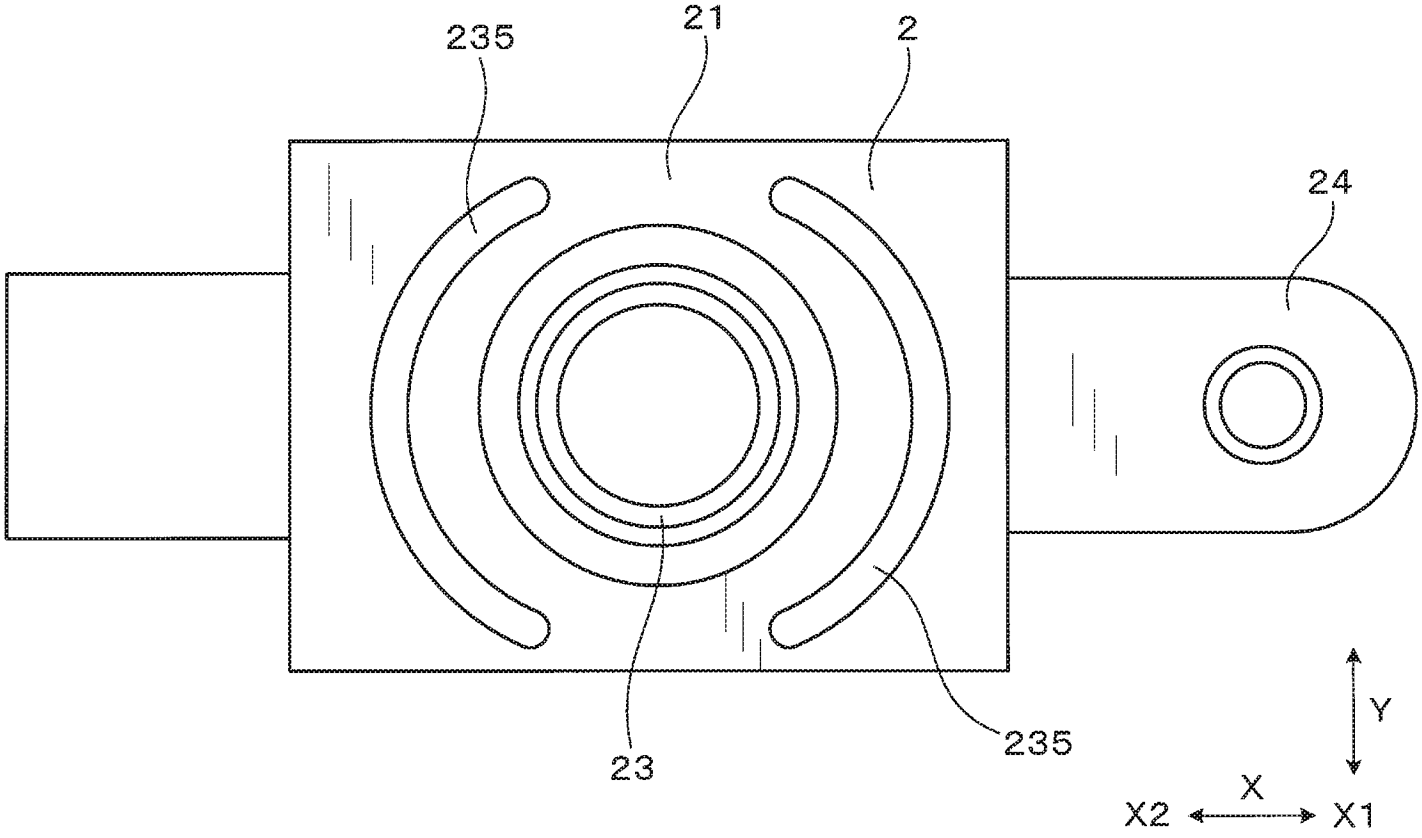
FIG. 24 is a bottom view of a case in the fifth embodiment.

As viewed in the axial direction Z in FIG. 24, the receiving recesses 235 are formed in an arc-shape that is a portion of a circular ring-shape around the center axis of the high-voltage tower 23. In this embodiment, the two receiving recesses 235 are formed in the case bottom wall 21. The two receiving recesses 235 are arranged in an arc shape to have openings facing each other in the lateral direction X. As viewed in the axial direction Z, the receiving recesses 235 are opposed to each other in the lateral direction X to surround the high-voltage tower 23. Alternatively, the receiving recess 235 may be, as illustrated in FIG. 29, formed in a circular ring-shape around the center axis of the high-voltage tower 23. In this case, the high-voltage tower 23 is arranged inside the receiving recess 235. Specifically, as viewed in the axial direction Z, the receiving recess 235 is formed so as to fully surround the circumference of the high-voltage tower 23. For the sake of convenience, the receiving recesses 235 is hatched in FIG. 28.

Figure 22:
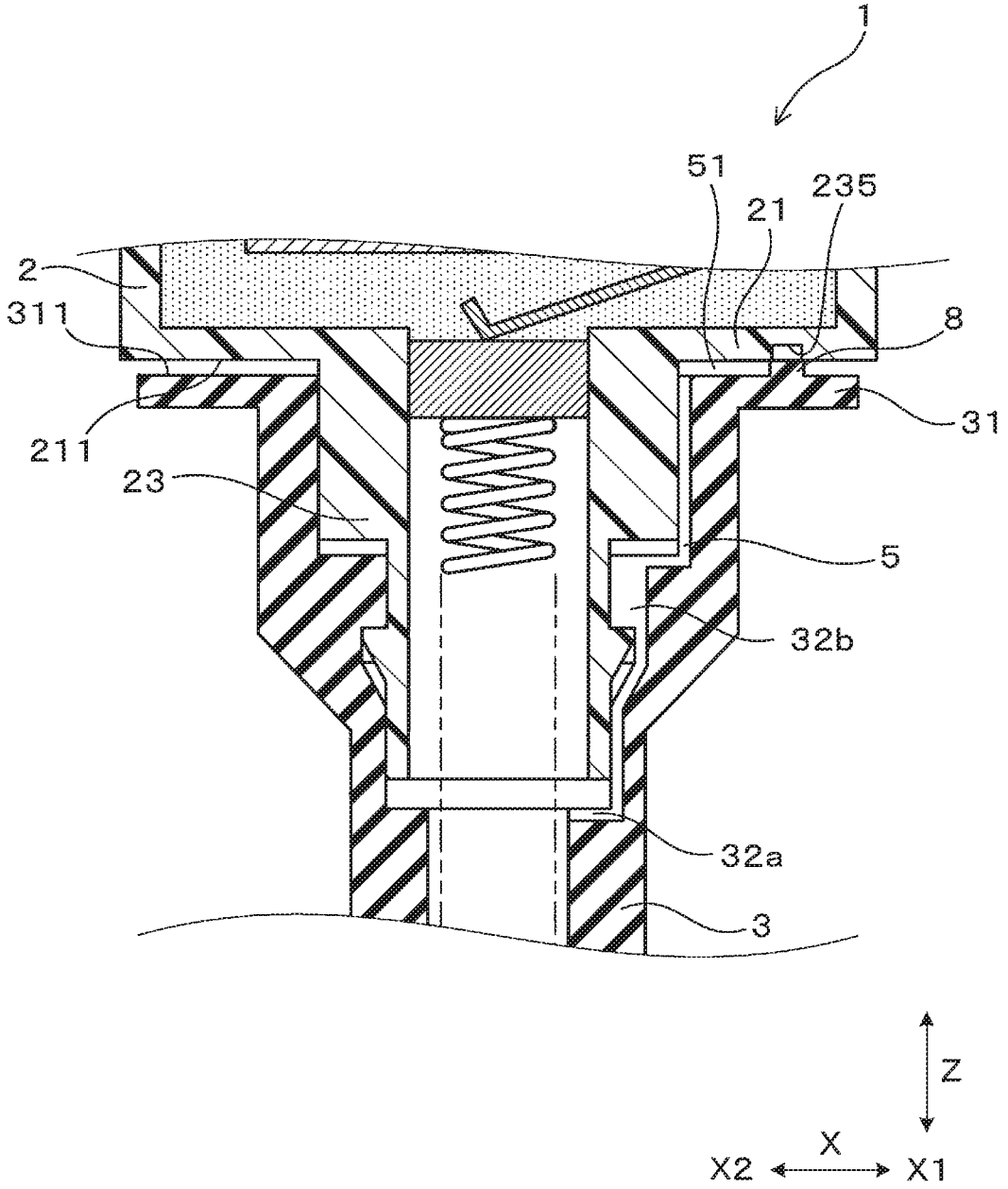
FIG. 22 is an enlarged view which illustrates a region around a high-voltage tower of an ignition coil in the fifth embodiment.
Figure 23:
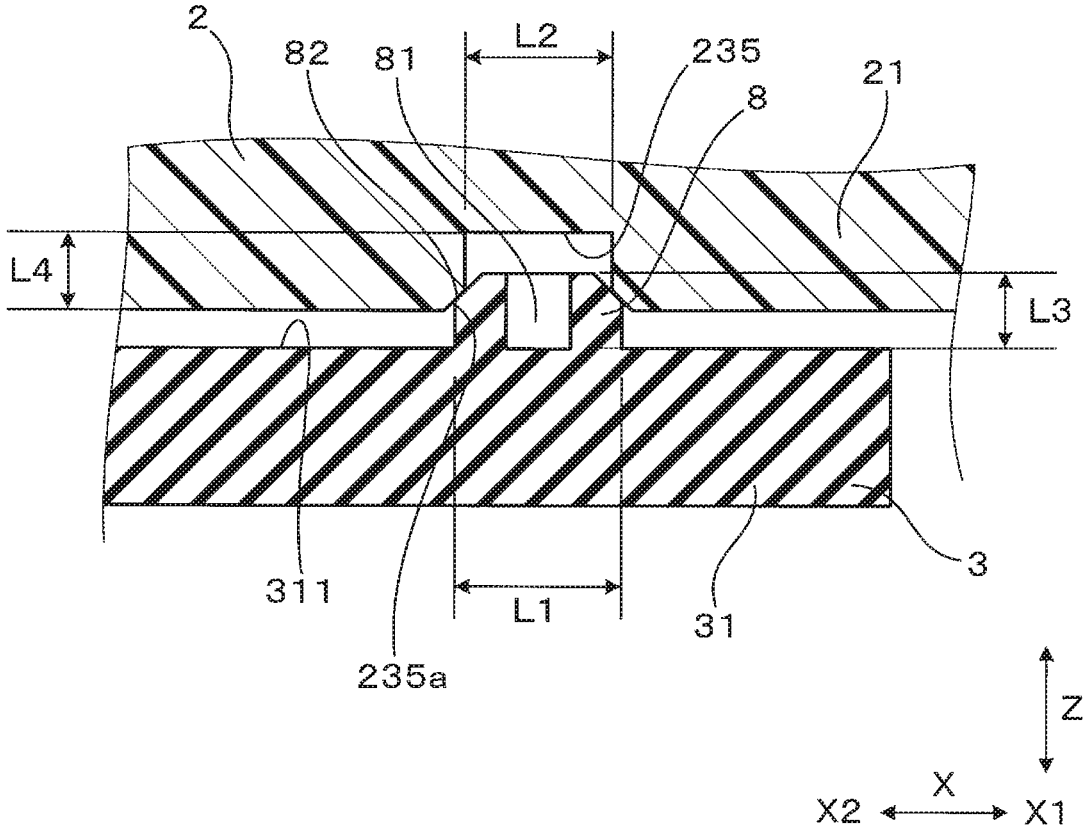
FIG. 23 is an enlarged view which illustrates a region around a protrusion and a receiving recess in the fifth embodiment.
Figure 25:
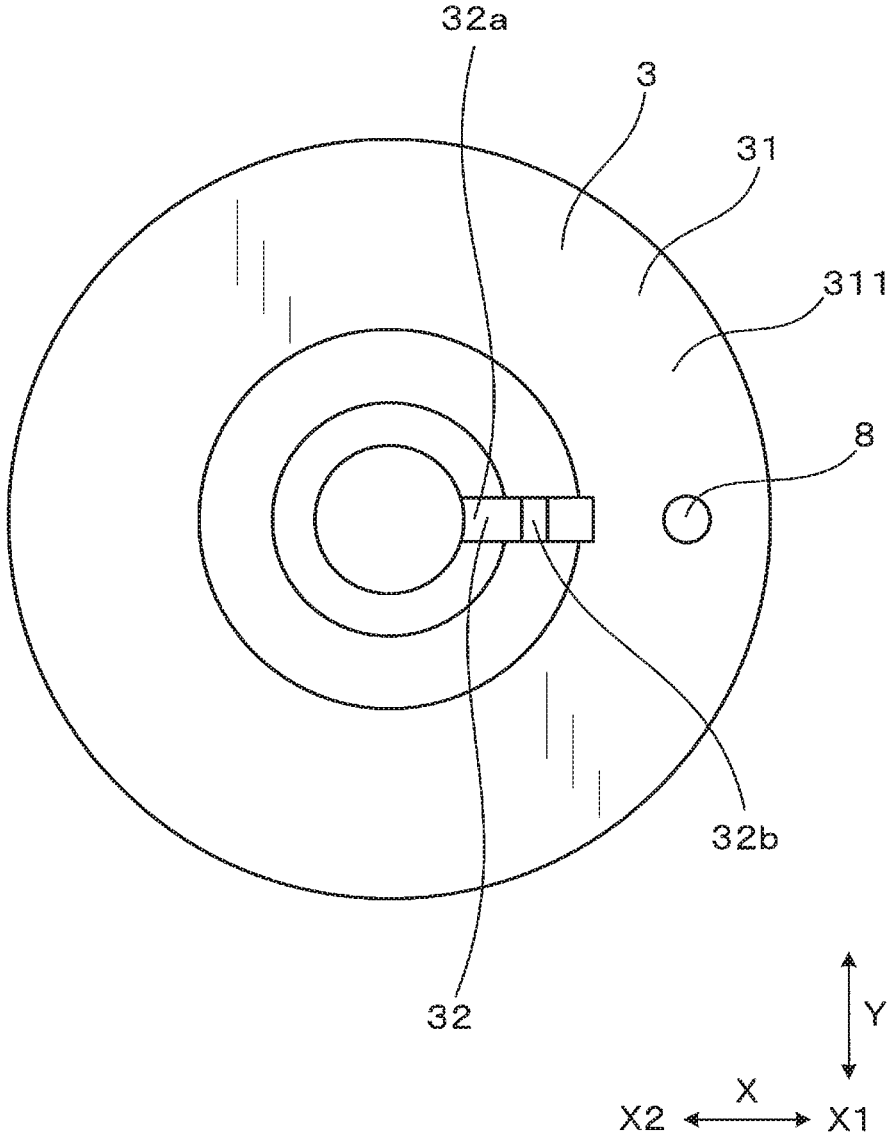
FIG. 25 is a top view of a joint in the fifth embodiment.

The protrusion 8 on the joint upper end portion 31 is, as illustrated in FIGS. 22, 23, and 25, of a cylindrical shape in this embodiment. The protrusion 8 is located to overlap a portion of the receiving recess 235 in the case bottom wall 21 in the axial direction Z. The protrusion 8, as illustrated in FIG. 23, has the easy-to-press-fit recess 81 which is formed in a top end thereof and hollowed in the axial direction Z. The drawings except FIGS. 23 and 28 omit the easy-to-press-fit recess 81.

The diameter of the protrusion 8 is, as can be seen in FIG. 23, greater than the width of the receiving recess 235 in the radial direction. Specifically, in a cross section of the protrusion 8 parallel to the axial direction Z, the dimension L1 of the protrusion 8 in a direction perpendicular to the axial direction Z is greater than the dimension of the receiving recess 235 in a direction perpendicular to the axial direction Z, thereby causing an upper end of the protrusion 8 to contact the periphery of the receiving recess 235 in the case bottom wall 21. The dimension L3 of the protrusion 8 in the axial direction Z is smaller than the dimension L4 of the receiving recess 235 in the axial direction Z.

The protrusion 8 has the tapered surface 82 formed on the corner of the top end thereof. The receiving recesses 235 have the tapered surfaces 235*a* formed on the corner of the open end thereof. The corner of the protrusion 8 is shaped to have a diameter decreasing upward to form the tapered surface 82. The inner and outer corners of the open end of the receiving recess 235 are shaped to have an interval therebetween which increases downward to form the tapered surface 235*a*. The tapered surface 82 of the protrusions 8 engages the tapered surface 235*a* of the receiving recess 235. The drawings except FIGS. 23 and 28 omit the tapered surfaces 82 and 235*a* for the sake of convenience.

Figure 26:
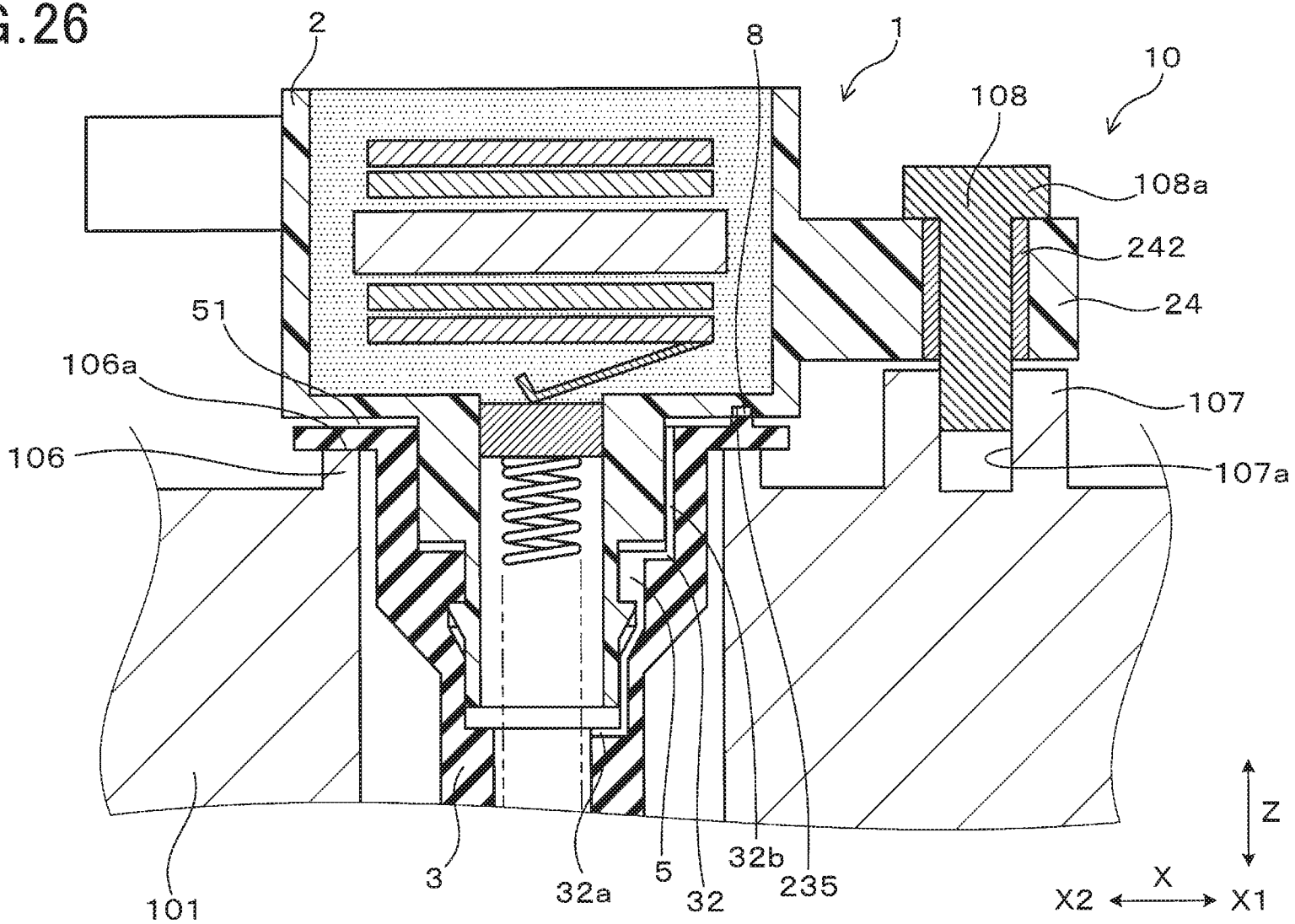
FIG. 26 is an enlarged sectional view of an ignition device before an axial force, as produced by a bolt, is exerted on a case in the fifth embodiment.

The installation of the ignition coil 1 of this embodiment in the internal combustion engine will be described below with reference to FIGS. 26 to 28.

First, the joint 3 of the ignition coil 1 is, like in the first embodiment, inserted into the plug hole 105 to have the upper end of the spark plug 13 fit in the lower end of the joint 3. The upper end portion of the spark plug 13 is, like in the first embodiment, inserted into the lower end of the joint 3. The ignition coil 1 is then pressed toward the spark plug 13 until the joint upper end portion 31 contacts the upper end surface 106*a* of the lip 106 of the engine head 101.

Next, the bolt 108 is put in the bush 242 of the flange 24 and then screwed into the threaded hole 107*a* of the boss 107 until the head 108*a* of the bolt 108 contacts the upper surface of the flange 24. This is illustrated in FIG. 26. In this condition, the axial force, as produced by the bolt 108, does not act on the ignition coil 1. The protrusion 8 is, as illustrated in FIG. 26, placed in contact with the periphery of the receiving recess 235 in the case bottom wall 21, thereby keeping the bottom wall side void 51 as it is.

Subsequently, the bolt 108 is further tightened into the boss 107 from the condition in FIG. 26. This transmits the axial force from the bolt 108 to the case 2 of the ignition coil 1 to move the case 2 downward toward the joint 3. The joint upper end portion 31 is, as described above, placed in contact with the lip 106, thereby stopping the joint 3 from moving downward even when the case 2 is moved downward by the axial force produced by the bolt 108. The fastening of the bolt 108 into the boss 107, thus, causes the protrusion 8 to be elastically deformed so that it is forced into the receiving recess 235 of the case bottom wall 21. This contracts the bottom wall side void 51 with the fastening of the bolt 108 into the boss 107.

Figure 27:
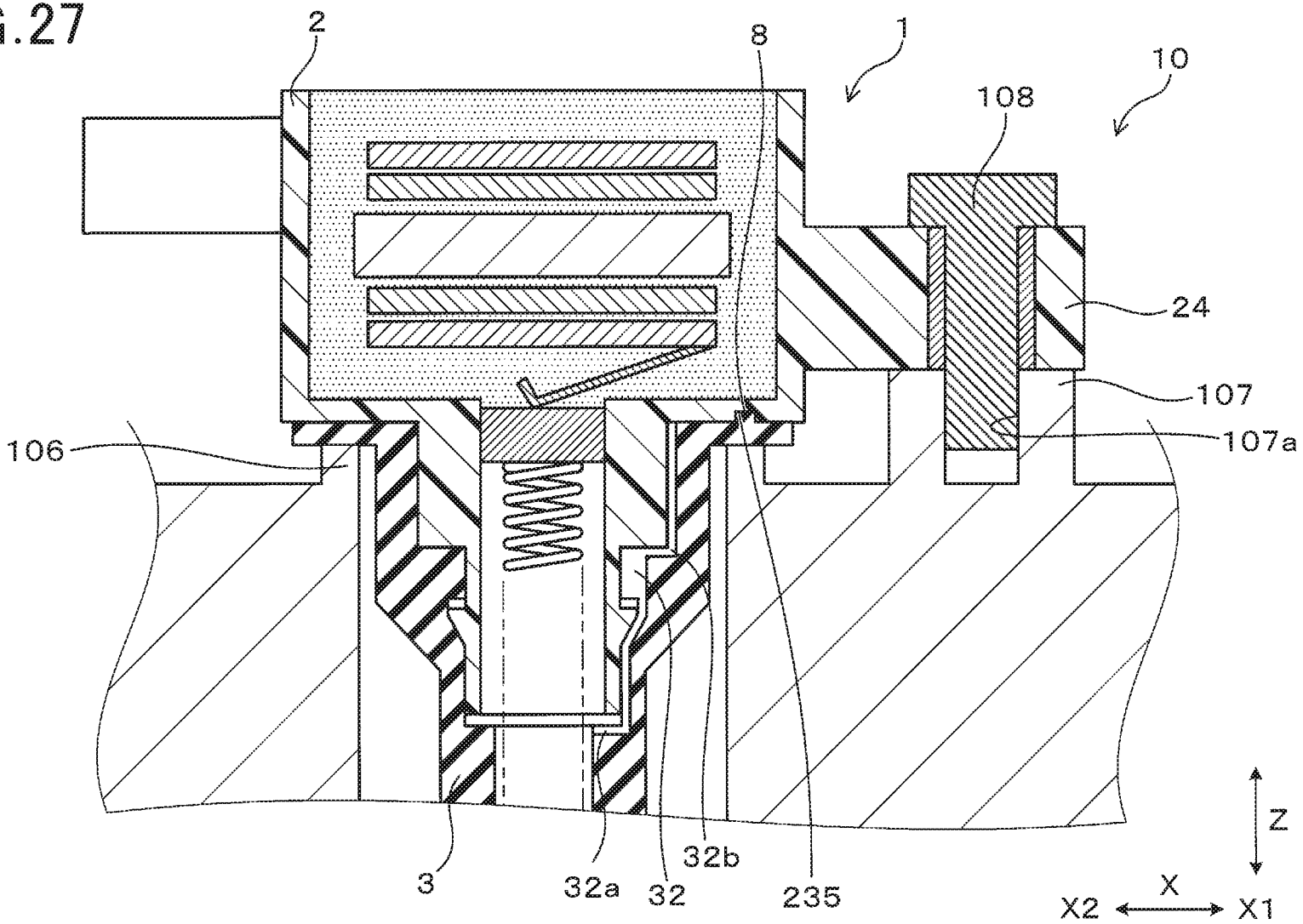
FIG. 27 is an enlarged sectional view of an ignition device equipped with an ignition coil in the fifth embodiment.
Figure 28:
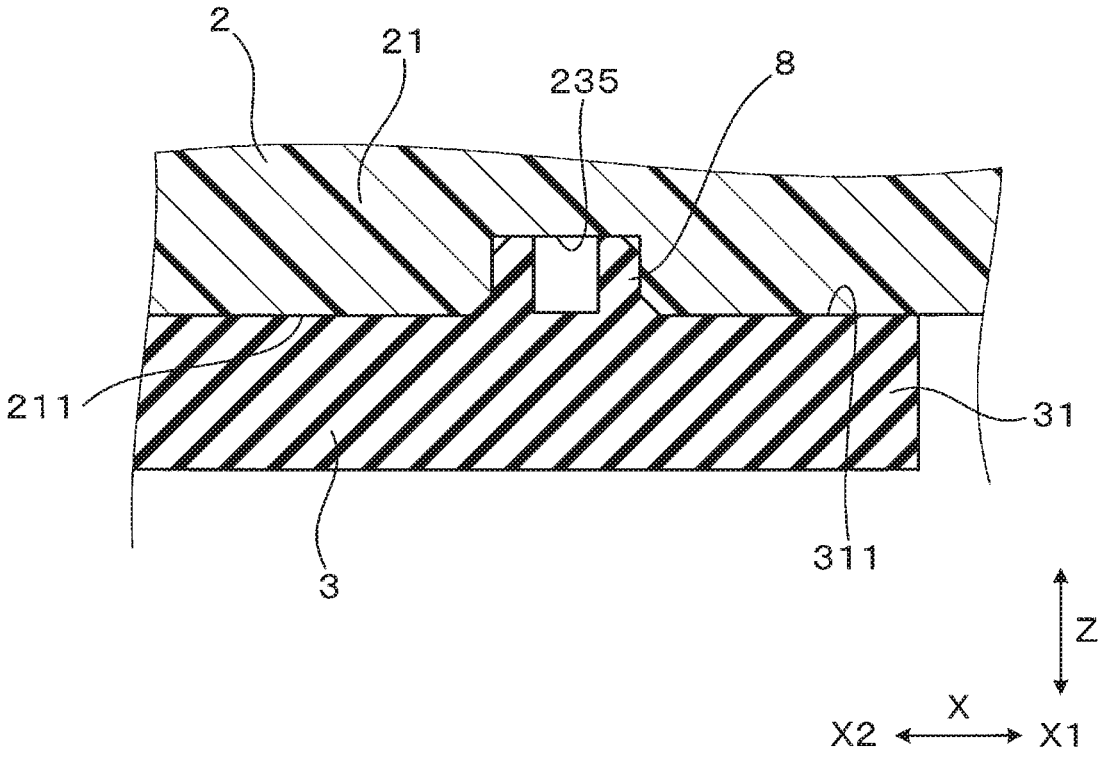
FIG. 28 is an enlarged sectional view which illustrates a region around a protrusion and a receiving recess of an ignition device in the fifth embodiment.
Figure 29:
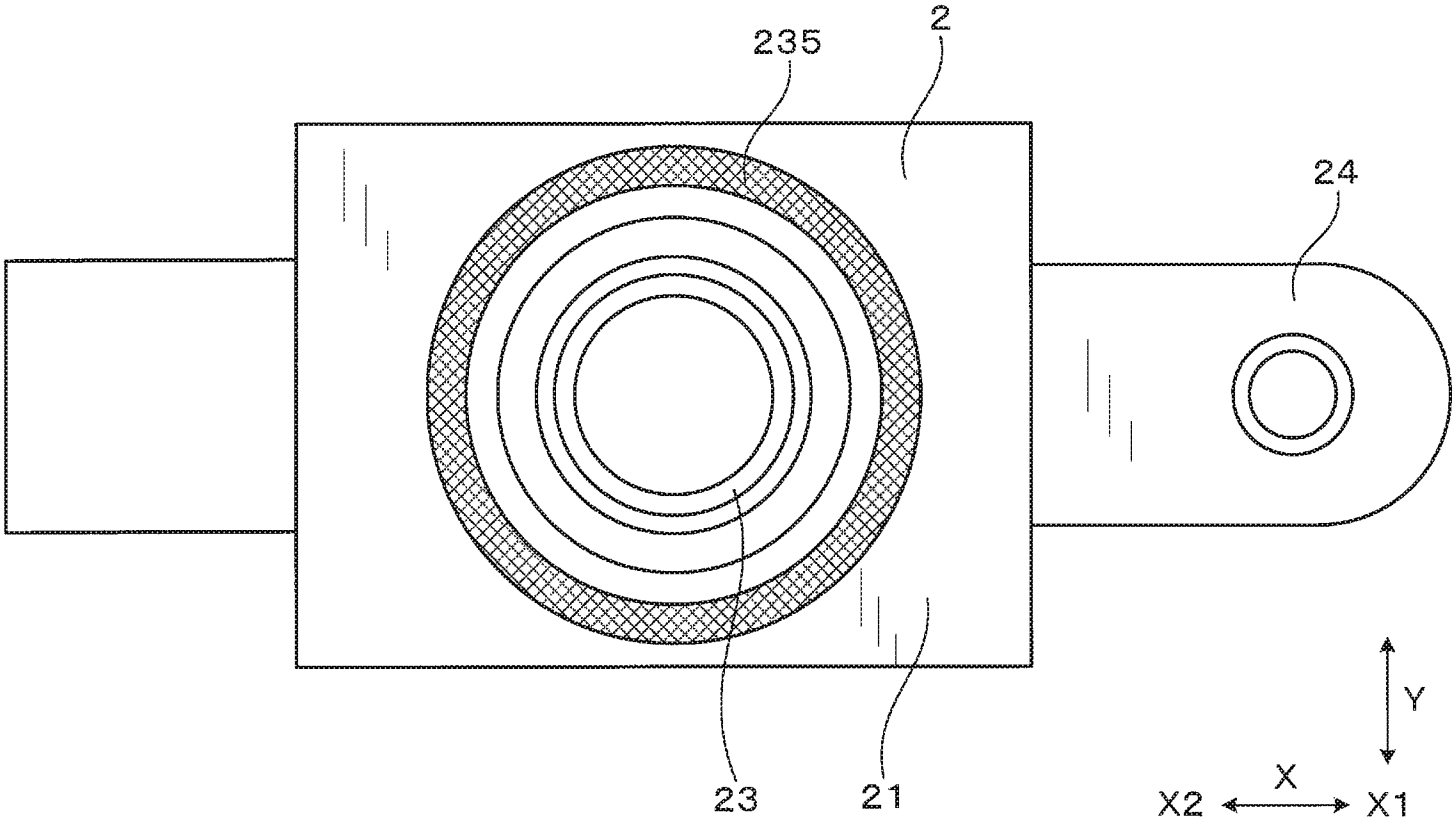
FIG. 29 is a bottom view of a case in a modification of the fifth embodiment.
Figure 30:
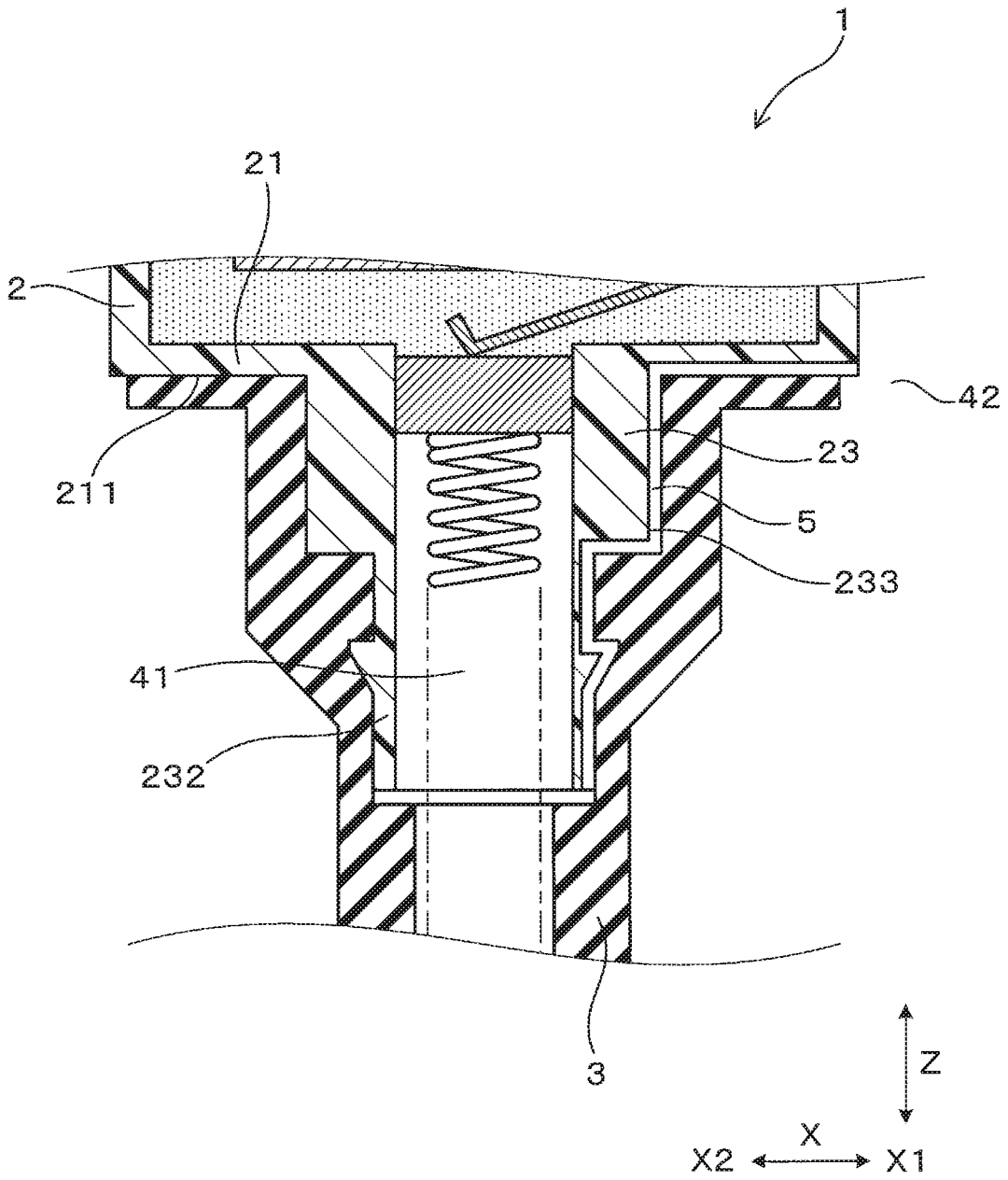
FIG. 30 is an enlarged view which illustrates a region around a high-voltage tower of an ignition coil in the sixth embodiment.
Figure 31:
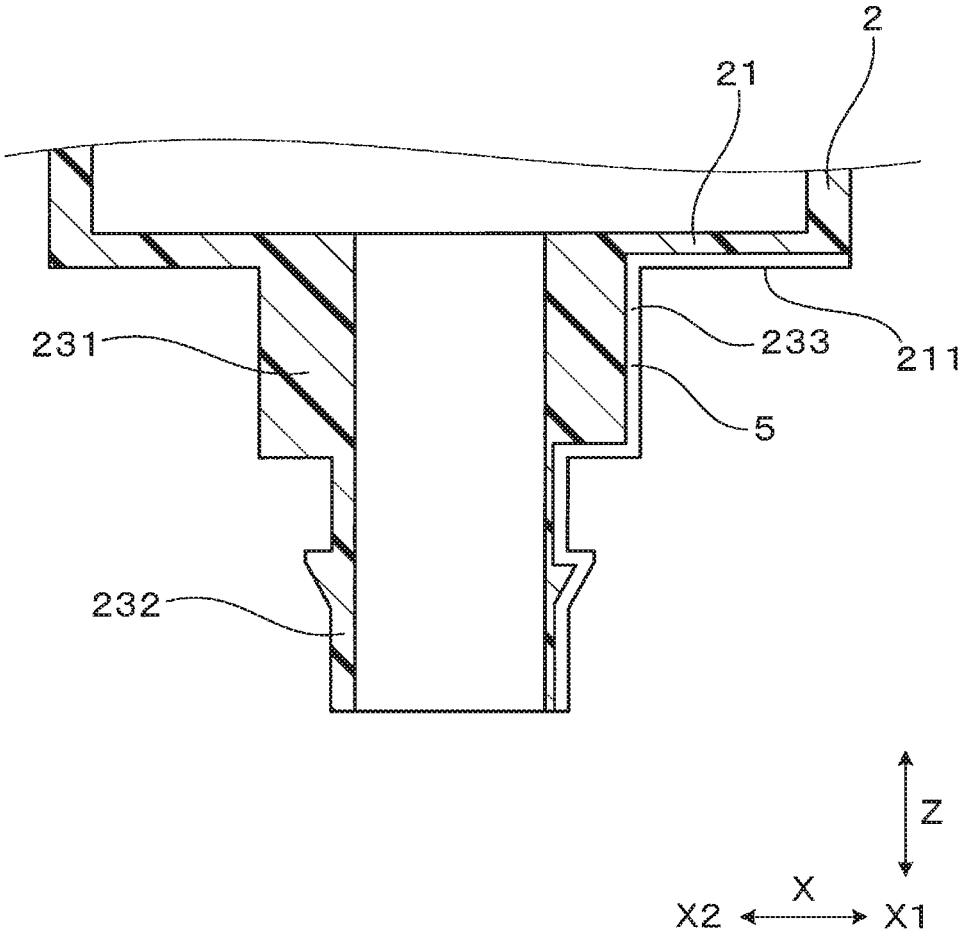
FIG. 31 is an enlarged sectional view of a case in the sixth embodiment.
Figure 32:
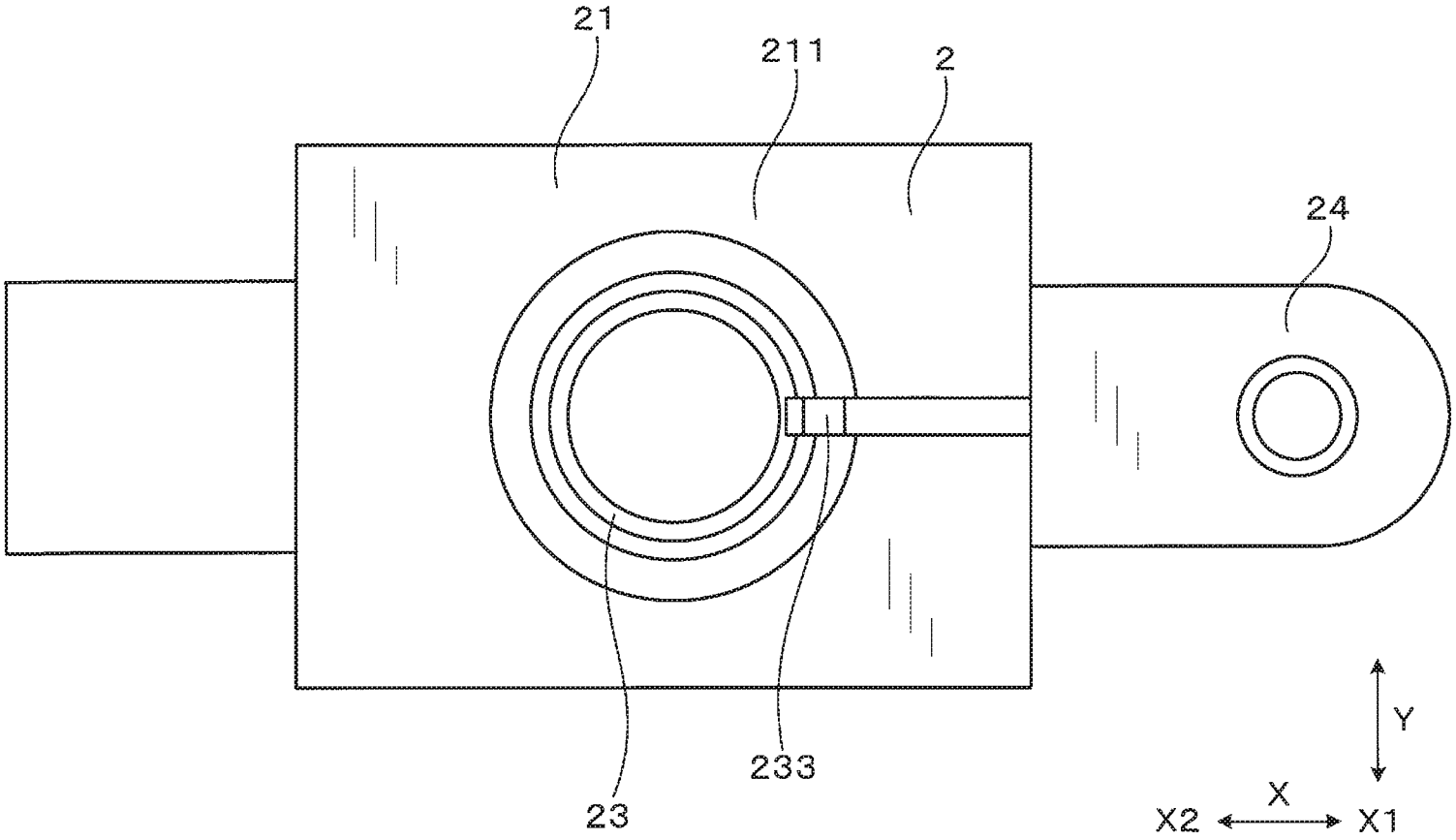
FIG. 32 is a bottom view of a case in the sixth embodiment.
Figure 33:
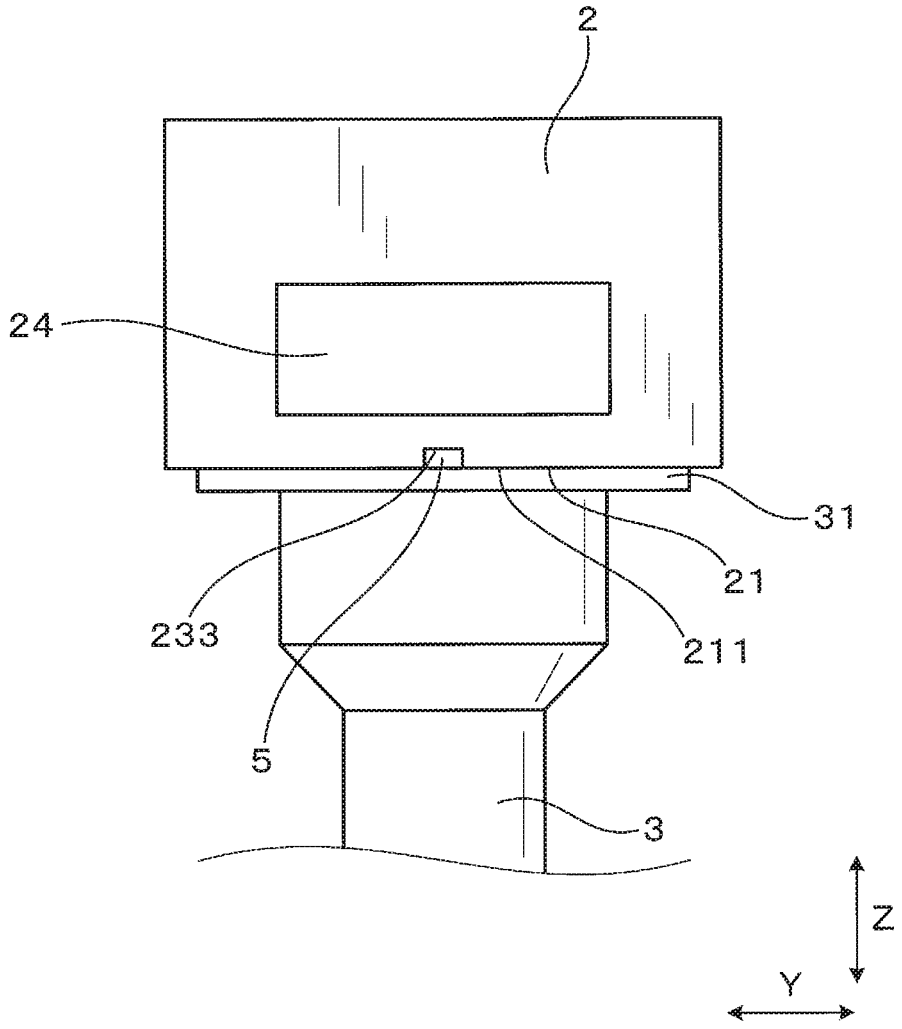
FIG. 33 is an illustration of an ignition coil, as viewed from a flange of a case in the sixth embodiment.
Figure 34:
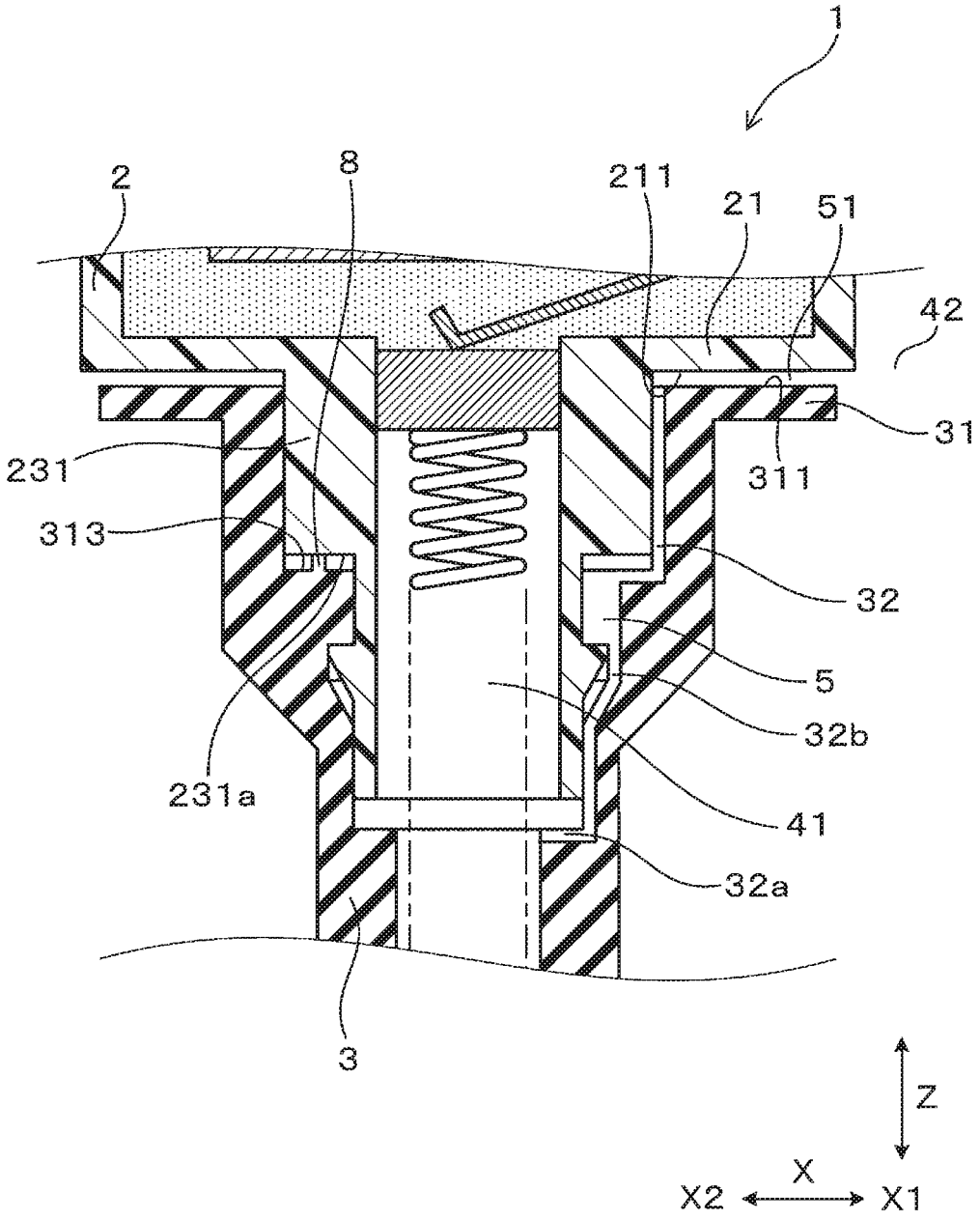
FIG. 34 is an enlarged view which illustrates a region around a high-voltage tower of an ignition coil in the seventh embodiment.

When the bolt 108 is fastened until the lower surface of the flange 24 of the case 2 contacts the upper surface of the boss 107, it will cause the protrusion 8 to be fully disposed, as illustrated in FIGS. 27 and 28, in the receiving recess 235, so that the bottom wall side void 51 will substantially disappear. In other words, the communicating void 5 which is created before the ignition coil 1 is installed in the internal combustion engine is closed after the ignition coil 1 is installed in the internal combustion engine.

The removal of the ignition coil 1 from the internal combustion engine will be described below.

First, the bolt 108 is, like in the first embodiment, removed from the boss 107 and the flange 24. This causes the axial force exerted by the bolt 108 on the case 2 to disappear. The protrusion 8 is, however, still press-fit in the receiving recess 235, so that the case 2 and the joint 3 are stopped from moving relative to each other in the axial direction Z.

Subsequently, load is exerted on the ignition coil 1 in the axial direction Z to move the ignition coil 1 upward away from the spark plug. Interferences between the receiving recess 235 and the protrusion 8 both in the axial direction Z and in a direction perpendicular to the axial direction Z are selected to have a degree of load required to pull the receiving recess 235 away from the protrusion 8 in the axial direction Z to be lower than that required to pull the joint 3 out of the spark plug 13 in the axial direction Z. The length of the protrusion 8 which is disposed in the receiving recess 235 in the axial direction Z is selected to be smaller than a distance by which the joint 3 is fit on the spark plug 13 in the axial direction Z. The application of the load to the ignition coil 1 in the axial direction Z to move the ignition coil 1 upward away from the spark plug 13, therefore, causes the protrusion 8 to be removed fully from the receiving recess 235 before the joint 3 is fully pulled out of the spark plug 13. This creates the bottom wall side void 51 again between the case bottom wall 21 and the joint upper end portion 31, thereby establishing fluid communication between the communicating void 5 and the outer chamber 42.

The ignition coil 1 is completely pulled out of the spark plug 13. The inner chamber 41 will expand with the pulling of the ignition coil 1 from the spark plug 13, thereby causing outside air to be sucked into the inner chamber 41 through the communicating void 5. This facilitates the removal of the ignition coil 1 from the spark plug 13 without making the pressure in the inner chamber 41 negative.

Other arrangements are identical with those in the second embodiment.

In this embodiment, the protrusion 8 is formed on one of the case bottom wall 21 and the joint upper end portion 31, while the receiving recesses 235 with which the protrusion 8 contacts in the axial direction Z are formed in the other. The protrusion 8 is shaped to be fit in the receiving recess 235 when the ignition coil 1 is installed in the internal combustion engine. In other words, when the ignition coil 1 is mounted in the internal combustion engine, the protrusion 8 is fully disposed inside the receiving recess 235. In other words, the bottom wall side void 51 which is created before the ignition coil 1 is installed in the internal combustion engine is fully eliminated after the ignition coil 1 is installed in the internal combustion engine. This avoids the ingress of foreign matter into the inner chamber 41 from the outer chamber 42 of the ignition coil 1 through the communication void 5 after the ignition coil 1 is installed in the internal combustion engine.

As viewed in the axial direction Z, the receiving recesses 235 are formed in an arc-shape that is a portion of a circular ring-shape around the center axis of the high-voltage tower 23. This enables the protrusion 8 to be aligned with one of the receiving recesses 235 in the axial direction Z without need for positioning the joint 3 and the case 2 precisely in the circumferential direction. This improves the ease of production of the ignition coil 1.

The protrusion 8 has the easy-to-press-fit recess 81 hollowed in the top end thereof in the axial direction Z, thereby decreasing a degree of force required to press the protrusion 8 into the receiving recess 235. This also improves the ease of production of the ignition coil 1.

The protrusion 8 and the receiving recesses 235 have the tapered surfaces 82 and 235*a* formed on the corners thereof, thereby facilitating the insertion of the protrusion 8 into the receiving recess 235. This also improves the ease of production of the ignition coil 1.

Other arrangements are identical with those in the second embodiment.

Sixth Embodiment

This embodiment is an embodiment, as illustrated in FIGS. 30 to 33, which has the same structure as that in the first embodiment except that a portion of the communicating void 5 is formed by the void-forming groove 233 made in the case 2.

The case 2 has the void-forming groove 233 continuously formed in a surface thereof which faces the joint 3. The void-forming groove 233 extends from the inner chamber 41 of the high-voltage tower 23 and the joint 3 to the outer chamber 42 arranged outside the high-voltage tower 23 and the joint 3. The void-forming groove 233 has an end extending to an end of the lower bottom surface 211 of the case bottom wall 21 on the side X1 and the other end extending to a lower end of the tower lower portion 232 of the high-voltage tower 23. In this embodiment, the joint 3 has no void-forming groove, that is, does not have the void-forming groove 32 illustrated in FIG. 2.

Other arrangements are identical with those in the first embodiment.

This embodiment offers substantially the same advantages as those in the first embodiment.

Seventh Embodiment

This embodiment is a modification of the second embodiment which is different in location of the protrusion 8 of the ignition coil 1 from the second embodiment. In this embodiment, the protrusion 8 is arranged between the high-voltage tower 23 and the joint 3 in the axial direction Z. In other words, the protrusion 8 does not lie adjacent the bottom wall side void 51.

The joint 3, as described already, has the third facing surface 313 which faces the lower surface 231*a* of the tower upper portion 231 in the axial direction Z. The third facing surface 313 has a portion bulging toward the tower upper portion 231 in the axial direction Z to define the protrusion 8. The dimension of the protrusion 8 in the axial direction Z is preferably greater than that of the bottom wall side void 51 in the axial direction Z.

The protrusion 8 is placed in contact with the lower surface 231*a* of the tower upper portion 231. In this embodiment the first facing surface of the joint 3 has no protrusion formed thereon.

Other arrangements are identical with those in the first embodiment.

Figure 35:
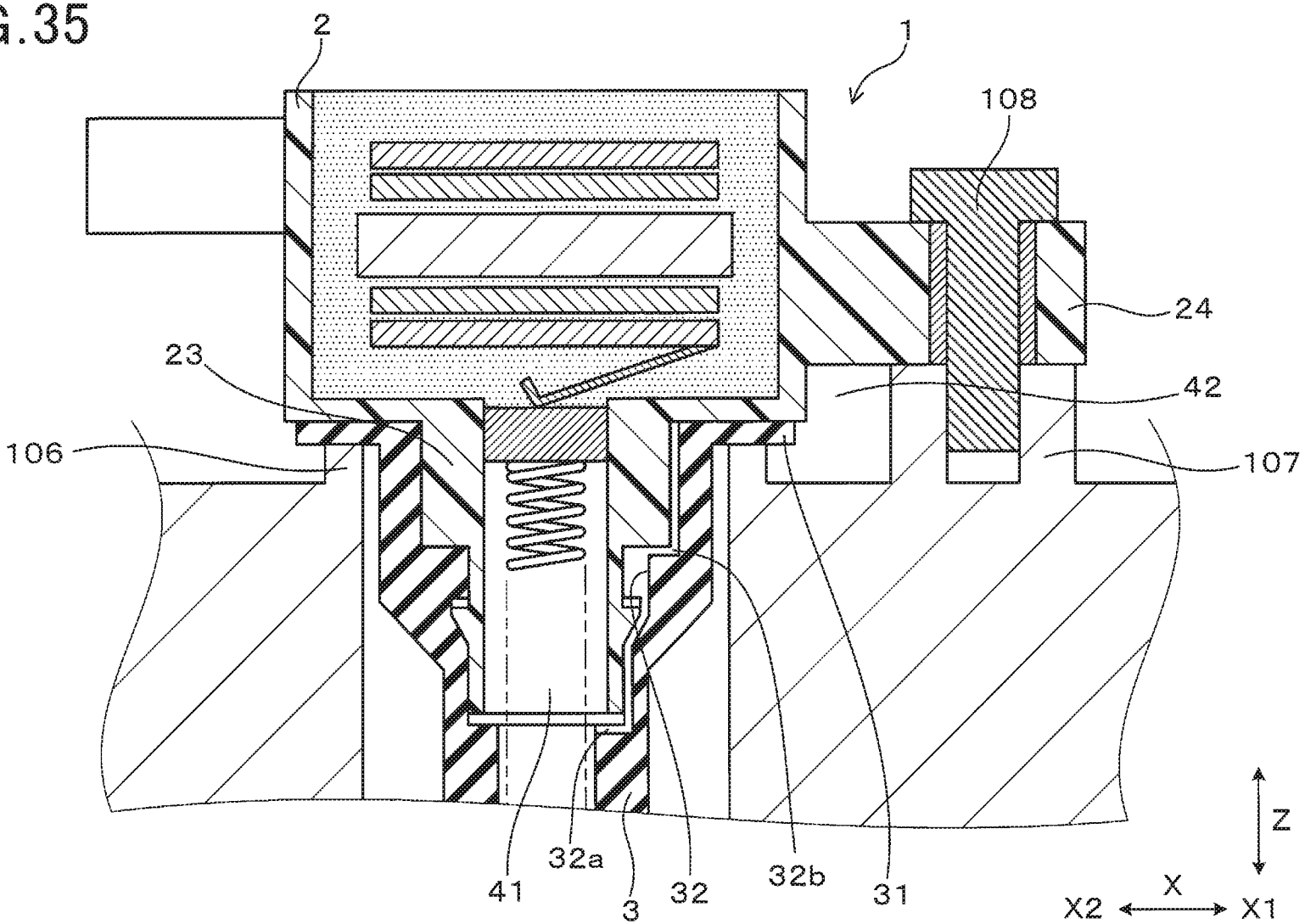
FIG. 35 is an enlarged sectional view of an ignition device equipped with an ignition coil in the seventh embodiment.

In this embodiment, when the ignition coil 1 is installed in the internal combustion engine, it will cause, as illustrated in FIG. 35, the protrusion 8 to be subjected to the axial force produced by the bolt 108, so that it is compressed to fully or almost eliminate the bottom wall side void 51. This avoids the ingress of foreign matter into the inner chamber 41 from the outer chamber 42 through the communicating void 5 of the ignition coil 1 when the ignition coil 1 is mounted in the internal combustion engine.

In this embodiment, the dimension of the protrusion 8 in the axial direction Z is selected to be greater than that of the bottom wall side void 51 in the axial direction Z, thereby causing the bottom wall side void 51 to be eliminated without having to compress the protrusion 8 fully. This enhances the avoidance of entry of foreign matter into the inner chamber 41 from the outer chamber 42 through the communicating void 5 when the ignition coil 1 is mounted in the internal combustion engine.

This embodiment offers substantially the same other advantages as those in the second embodiment.

Eighth Embodiment

Figure 36:
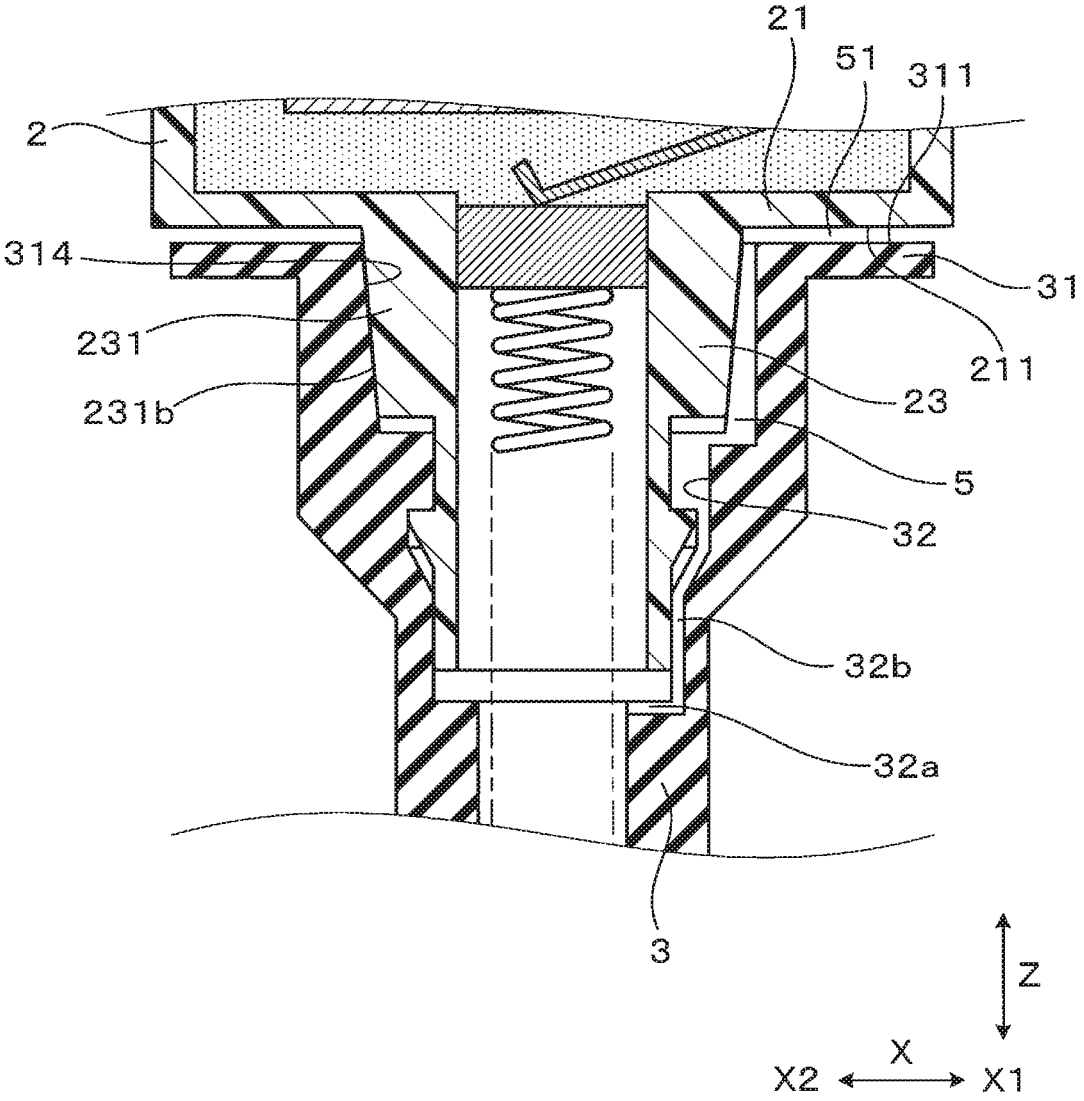
FIG. 36 is an enlarged view which illustrates a region around a high-voltage tower of an ignition coil in the eighth embodiment.

This embodiment is, as illustrated in FIG. 36, different from the second embodiment in how to position the case 2 and the joint 3 in the axial direction Z in order to form the bottom wall side void 51. The tower upper portion 231 of the high-voltage tower 23 has the outer peripheral surface 231*b* whose diameter decreases downward. In other words, the outer peripheral surface 231*b* of the tower upper portion 231 tapers downward.

Similarly, the joint 3 has the fourth facing surface 314 which faces the outer peripheral surface 231*b* of the tower upper portion 231 and has a diameter decreasing downward. In other words, the fourth facing surface 314 tapers downward.

The upper end of the fourth facing surface 314 has an inner diameter is selected to be smaller than an outer diameter of an upper end of the outer peripheral surface 231*b* of the tower upper portion 231. The inner diameter of the upper end of the fourth facing surface 314 is selected to be equal to an outer diameter of a portion of the outer peripheral surface 231*b* of the tower upper portion 231 which is located slightly below the upper end of the outer peripheral surface 231*b*, thereby forming the bottom wall side void 51 between the first facing surface 311 of the joint 3 and the lower bottom surface 211 of the case bottom wall 21 when the case 2 and the joint 3 are joined together.

Figure 37:
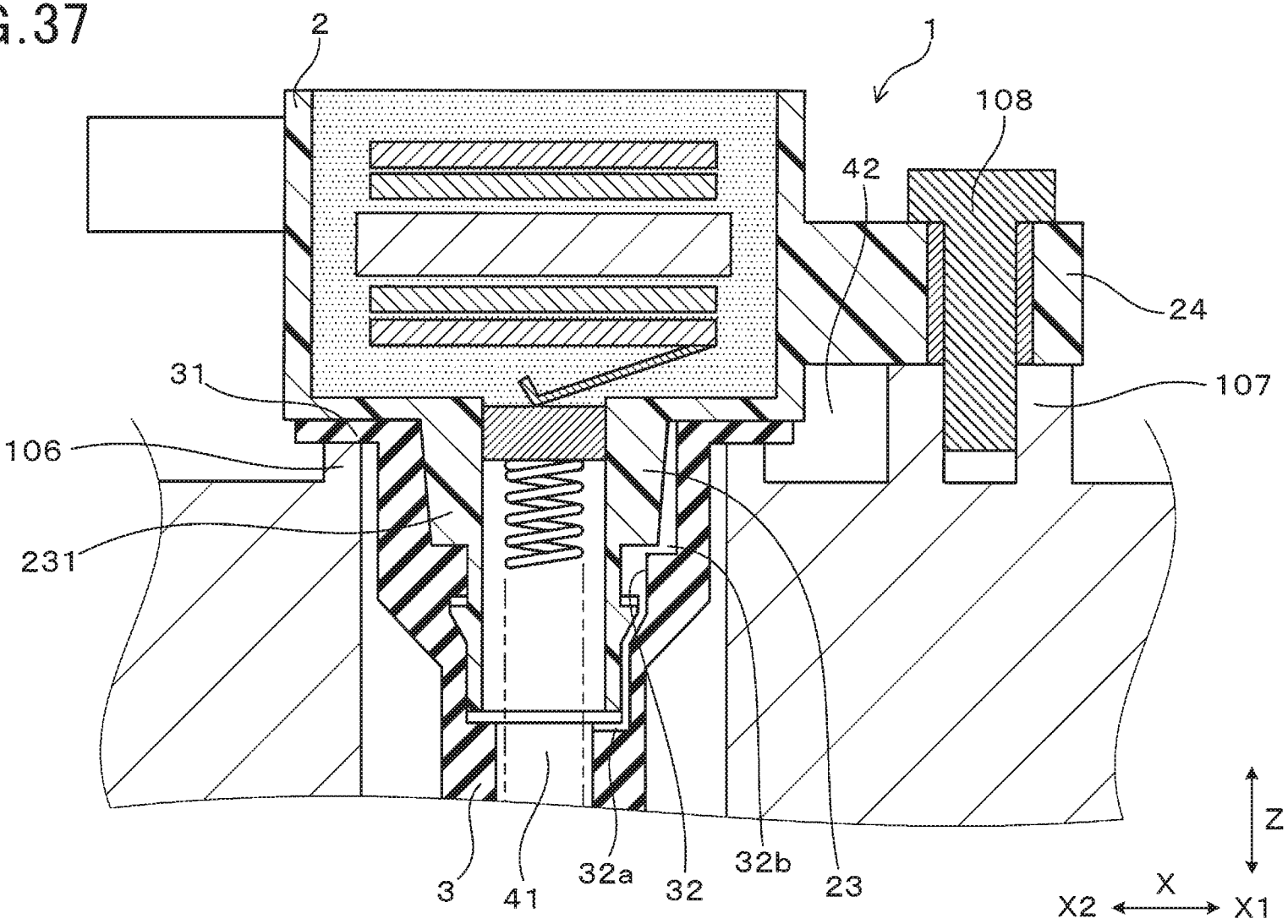
FIG. 37 is an enlarged sectional view of an ignition device equipped with an ignition coil in the eighth embodiment.

In this embodiment, the bottom wall side void 51 is kept as it is until the axial force produced by the bolt 108 acts on the case 2 when the ignition coil 1 is attached to the internal combustion engine. Upon exertion of the axial force of the bolt 108 on the case 2, the case 2 is moved downward to the joint 3 while the tower upper portion 231 of the high-voltage tower 23 is elastically expanding the upper portion of the joint 3. The bottom wall side void 51 is compressed with the screwing of the bolt 108 into the boss 107. When the bolt 108 is tightened until the lower surface of the flange 24 of the case 2 contacts the upper surface of the boss 107, the bottom wall side void 51 is, as clearly illustrated in FIG. 37, fully or almost eliminated.

Other arrangements are identical with those in the second embodiment.

In this embodiment, the protrusions 8 are subjected to the axial force produced by the bolt 108 and then compressed to fully or almost fully eliminate the bottom wall side void 51 when the ignition coil 1 is mounted in the internal combustion engine, thereby avoiding the ingress of foreign matter from the outer chamber 42 into the inner chamber 41 through the communicating void 5 of the ignition coil 1 when the ignition coil 1 is installed in the internal combustion engine.

This embodiment offers substantially the same other advantages as in the second embodiment.

Ninth Embodiment

This embodiment is, as illustrated in FIGS. 38 to 41, different in structure of the communicating void 5 from the second embodiment.

Figure 38:
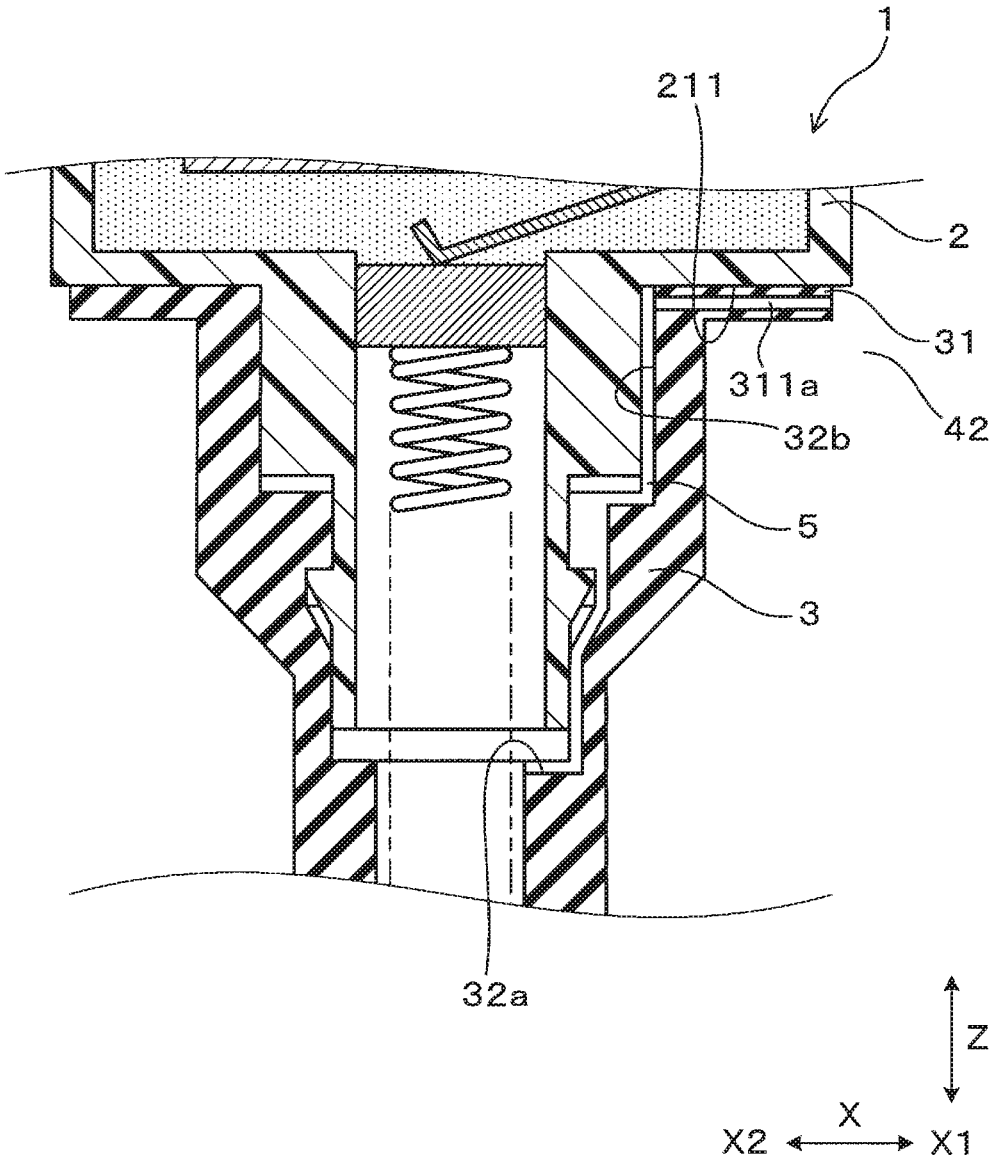
FIG. 38 is an enlarged view which illustrates a region around a high-voltage tower of an ignition coil in the ninth embodiment.
Figure 39:
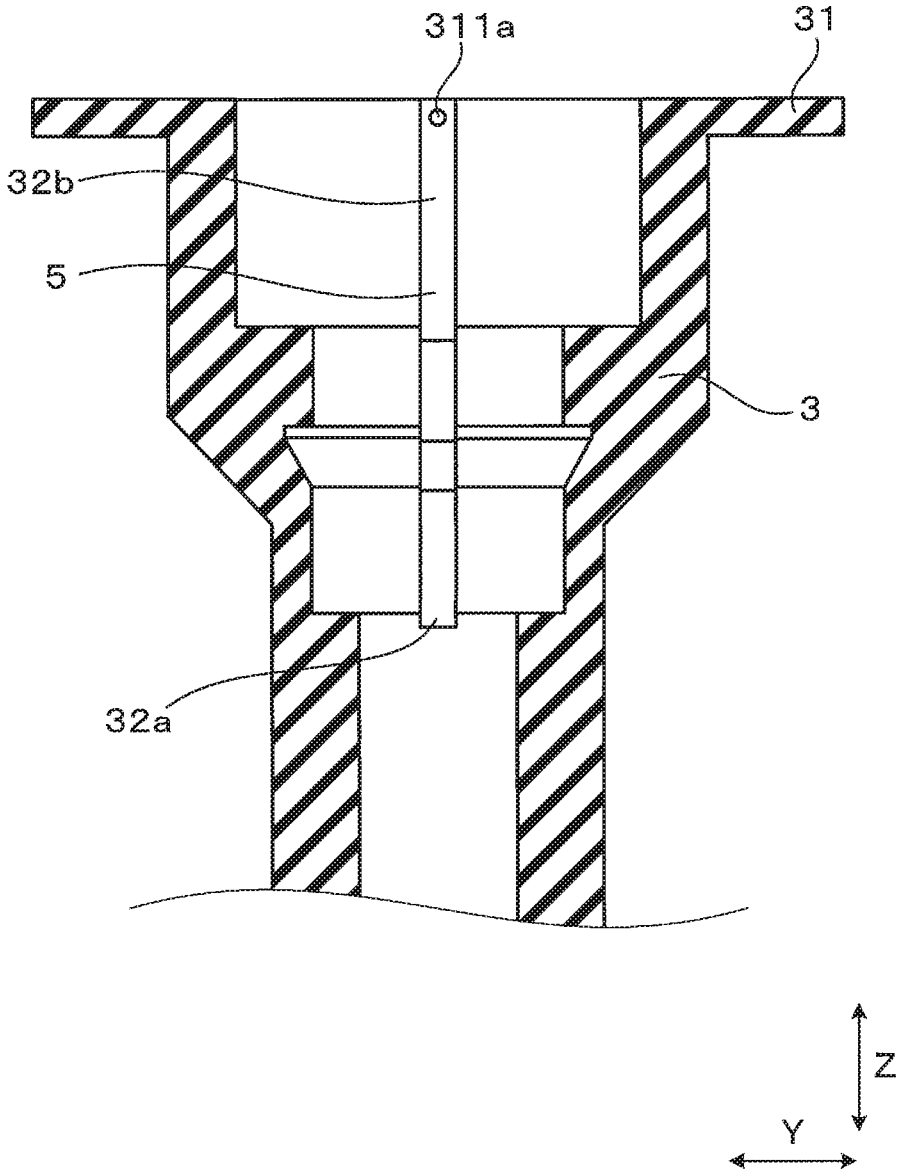
FIG. 39 is a sectional view parallel to an axial direction of a joint and an enlarged sectional view not passing through a void-forming groove in the ninth embodiment.
Figure 40:
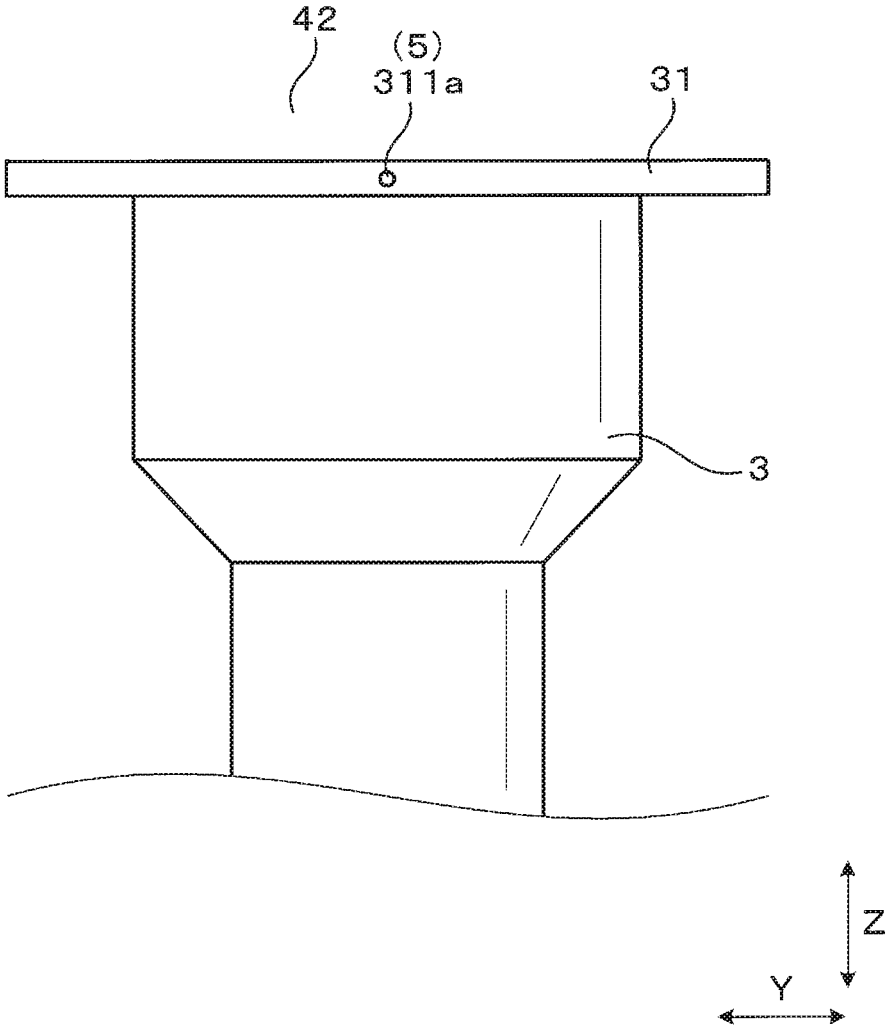
FIG. 40 is an illustration of a joint, as viewed from a front surface of a through-hole in the ninth embodiment.
Figure 41:
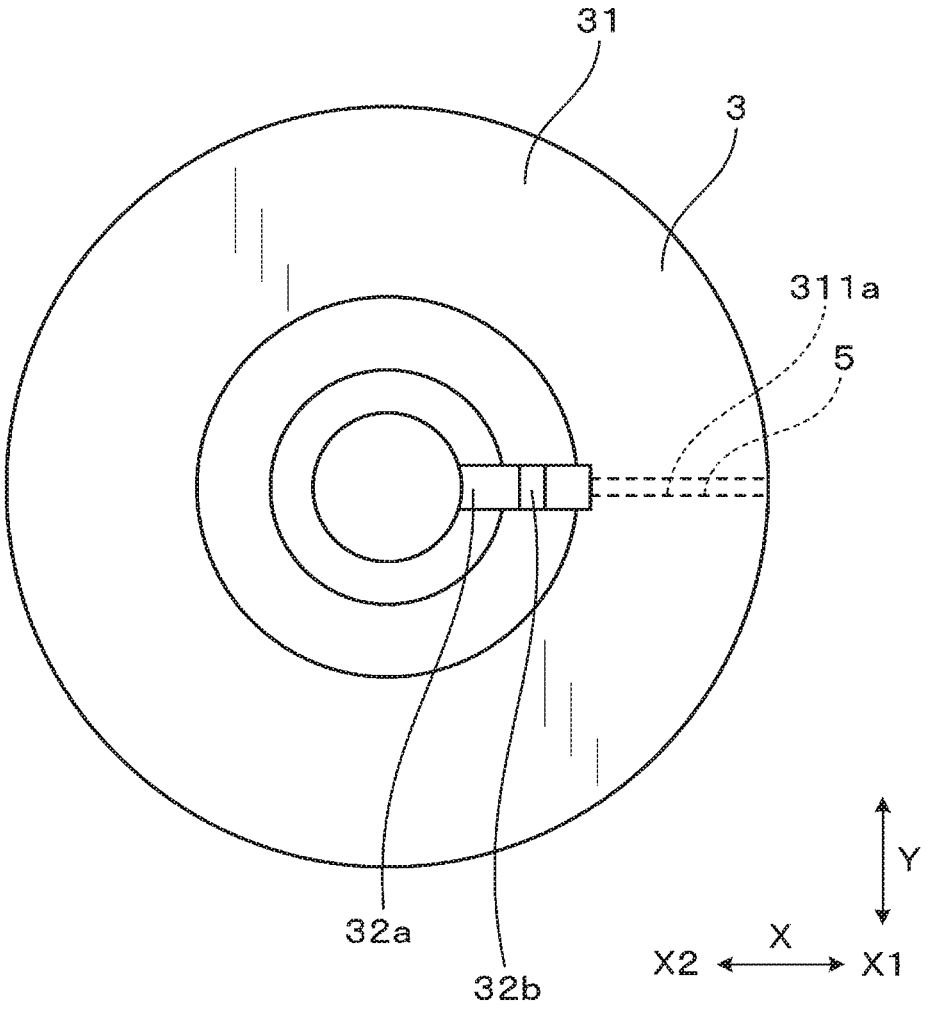
FIG. 41 is a top view of a joint in the ninth embodiment.

In this embodiment, the communicating void 5, as clearly illustrated in FIGS. 38, 39, and 41, includes the inner spaces of the intermediate groove 32*b* and the lower groove 32*a* and the inner space of the through-hole 311*a*, as will be described later. The through-hole 311*a* is, as illustrated in FIGS. 38 and 41, linearly formed to pass through the joint upper end portion 31 in the radial direction thereof. Specifically, the through-hole 311*a*, as can be seen in FIGS. 38 and 39, communicates at an inner end thereof with the intermediate groove 32*b* and, as shown in FIGS. 38 and 40, at an outer end thereof with the outer chamber 42. In this embodiment, the through-hole 311*a* is, as illustrated in FIGS. 38 and 41, formed to pass through the joint upper end portion 31 in the radial direction, i.e., the lateral direction X. The through-hole 311*a* has a circular cross section perpendicular to a length thereof, but may alternatively be formed to have another shaped cross section, such as an oval cross section elongated in the axial direction Z.

Figure 42:
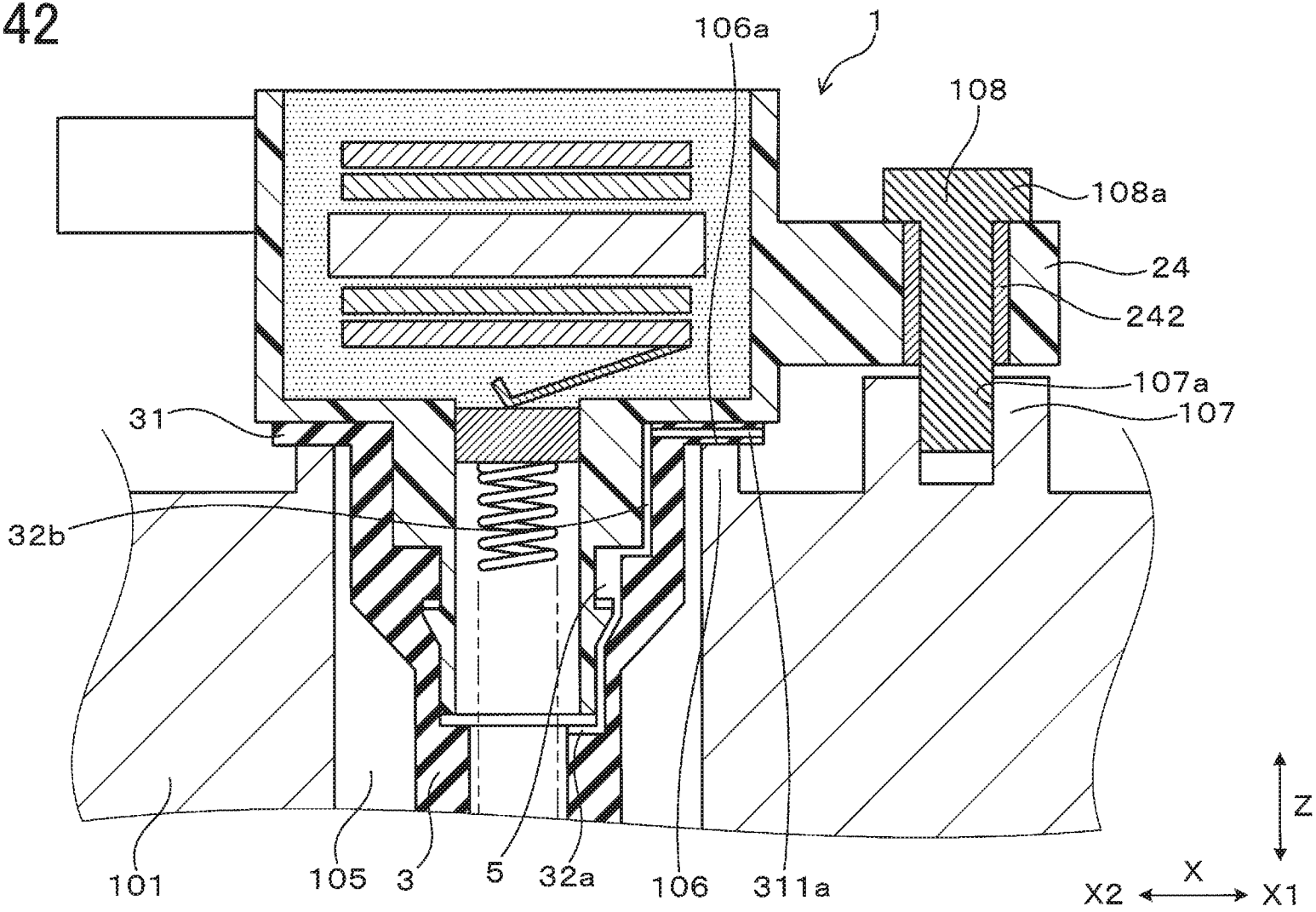
FIG. 42 is an enlarged sectional view of an ignition device before an axial force, as produced by a bolt, is exerted on a case in the ninth embodiment.

The through-hole 311*a* is, as clearly illustrated in FIG. 39, formed at the center of the joint upper end portion 31 in the axial direction Z and the center of the intermediate groove 32*b* in its circumferential direction. The through-hole 311*a* is, as can be seen in FIG. 42, arranged closer to the flange 24 than the center axis of the high-voltage tower 23 is (i.e., on the side X1). As viewed in the axial direction Z, the through-hole 311*a*, as can be seen in FIG. 41, lie on a straight line, not shown, passing through the center axis of the high-voltage tower 23 and the center axis of the bolt hole 241 of the flange 24. This enhances, as will be described later, the ease of transmission of the axial force from the bolt 108 inserted into the bolt hole 241 of the flange 24 to the through-hole 311*a* when the ignition coil 1 is mounted in the internal combustion engine. This facilitates elastic deformation of the through-hole 311*a* to close the communicating void 5 when the ignition coil 1 is mounted in the internal combustion engine.

In this embodiment, the first facing surface 311 of the joint upper end portion 31 is, as can be seen in FIG. 41, even or flat without any protrusions (e.g., the protrusions 8 in the second embodiment shown in FIG. 7). The lower bottom surface 211 of the case 2 is, as shown in FIG. 38, formed to be flat. The first facing surface 311 of the joint upper end portion 31 is in surface-contact with the lower bottom surface 211 of the case 2.

Next, installation of the ignition coil 1 in the internal combustion engine will be described below in FIGS. 42 and 43.

First, the joint 3 of the ignition coil 1 is, like in the second embodiment, inserted into the plug hole 105 to have the upper end of the spark plug fit in the lower end of the joint 3. The ignition coil 1 is, like in the second embodiment, then pressed toward the spark plug until the joint upper end portion 31 contacts the upper end surface 106*a* of the lip 106 of the engine head 101.

Next, the bolt 108 is put in the bush 242 of the flange 24 and then screwed into the threaded hole 107*a* of the boss 107 until the head 108*a* of the bolt 108 contacts the upper surface of the flange 24. This is illustrated in FIG. 42. In this condition, the axial force, as produced by the bolt 108, does not act on the ignition coil 1, so that the through-hole 311*a* is not elastically deformed.

Subsequently, the bolt 108 is further tightened into the boss 107 from the condition in FIG. 42. This transmits the axial force from the bolt 108 to the case 2 of the ignition coil 1 to move the case 2 downward toward the joint 3. The joint upper end portion 31 is, as described above, placed in contact with the lip 106, thereby stopping the joint 3 from moving downward even when the case 2 is moved downward by the axial force produced by the bolt 108. The fastening of the bolt 108 into the boss 107, thus, causes the joint upper end portion 31 held between the case 2 and the lip 106 to be elastically deformed in the axial direction Z. This also compresses the through-hole 311*a* in the axial direction Z with the screwing of the bolt 108 into the boss 107.

Figure 43:
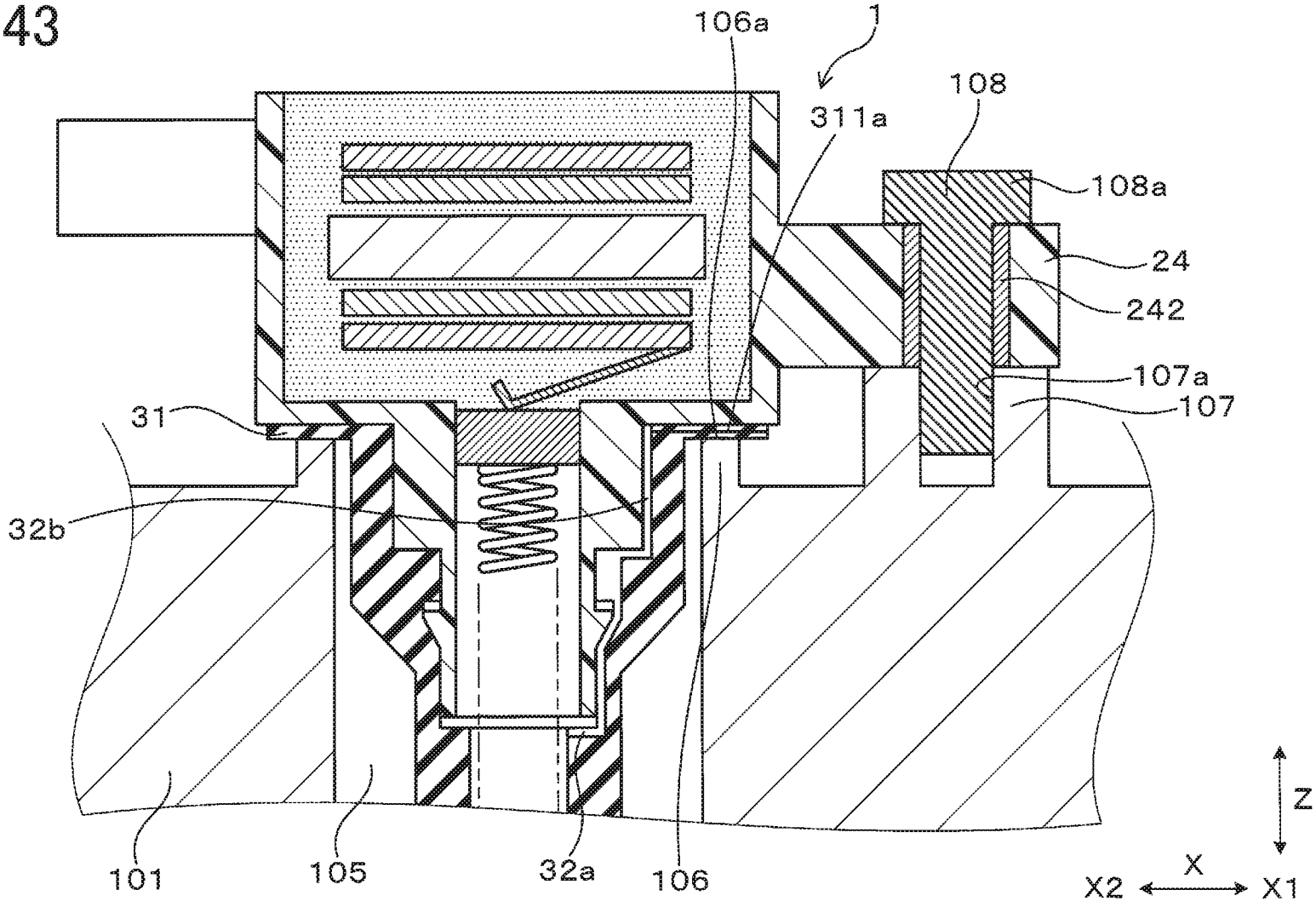
FIG. 43 is an enlarged sectional view of an ignition device equipped with an ignition coil in the ninth embodiment.

When the bolt 108 is screwed into the boss 107 until the lower surface of the flange 24 of the case 2 contacts the upper surface of the boss 107, it causes, as illustrated in FIG. 43, the through-hole 311*a* to be fully or almost fully compressed, so that an inner space thereof is fully or almost fully eliminated. In other words, the communicating void 5 which is created, as illustrated in FIG. 42, before the ignition coil 1 is installed in the internal combustion engine is fully or almost fully closed, as illustrated in FIG. 43, after the ignition coil 1 is installed in the internal combustion engine.

The removal of the ignition coil 1 from the internal combustion engine will be described below.

First, the bolt 108 is, like in the second embodiment, removed from the boss 107 and the flange 24. This causes the axial force exerted by the bolt 108 on the case 2 to disappear, so that the case 2 is moved away from the joint 3 by the resilience of the joint upper end portion 31 which has been compressed. This restores the joint upper end portion 31, thereby creating the bottom wall side void 51 again to establish communication between itself and the outer chamber 42.

The ignition coil 1 is pulled out of the spark plug 13. The pulling of the ignition coil 1 from the spark plug 13 causes the inner chamber 41 to expand, so that outside air is sucked into the inner chamber 41 through the communicating void 5. This facilitates the ease with which the ignition coil 1 is pulled out of the spark plug 13 without making the pressure in the inner chamber 41 negative.

Other arrangements are identical with those in the second embodiment.

In this embodiment, the first facing surface 311 of the joint upper end portion 31 and the lower bottom surface 211 of the case 2 are both flat and placed in surface-contact with each other. The joint upper end portion 31 has formed therein the through-hole 311*a* which forms at least a portion of the communicating void 5. Therefore, the axial force, as produced by the bolt 108 to install the ignition coil 1 in the internal combustion engine, presses the joint upper end portion 31, thereby fully or almost fully compressing the through-hole 311*a*. This avoids the ingress of foreign matter from the outer chamber 421 into the inner chamber 41 through the communicating void 5 when the ignition coil 1 is mounted in the internal combustion engine, thereby ensuring the stability in insulation between inside and outside the joint 3 and minimizes a risk that the ignition coil 1 corrodes. The joint upper end portion 31 remains elastically undeformed when the ignition coil 1 is not fastened to the internal combustion engine, so that the through-hole 311*a* is kept as it is to sustain the communicating void 5. It is, thus, easy to pull the ignition coil 1 out of the spark plug 13 without making the pressure in the inner chamber 41 negative.

In this embodiment, the through-hole 311*a* is located closer to the flange 24 than the center axis of the high-voltage tower 23 is, thereby facilitating the transmission of axial force from the bolt 108 fastened into the bolt hole 241 of the flange 24 to the through-hole 311*a* in the joint upper end portion 31 when the ignition coil 1 is secured to the internal combustion engine. This enhances the ease with which the through-hole 311*a* is elastically deformed by the axial force of the bolt 108. It is, thus, easy to block the communicating void 5 when the ignition coil 1 is mounted in the internal combustion engine.

This embodiment offers substantially the same other advantages as those in the second embodiment.

Tenth Embodiment

This embodiment is, as clearly illustrated in FIGS. 44 to 47, different in structure of the communicating void 5 from the second embodiment.

Figure 44:
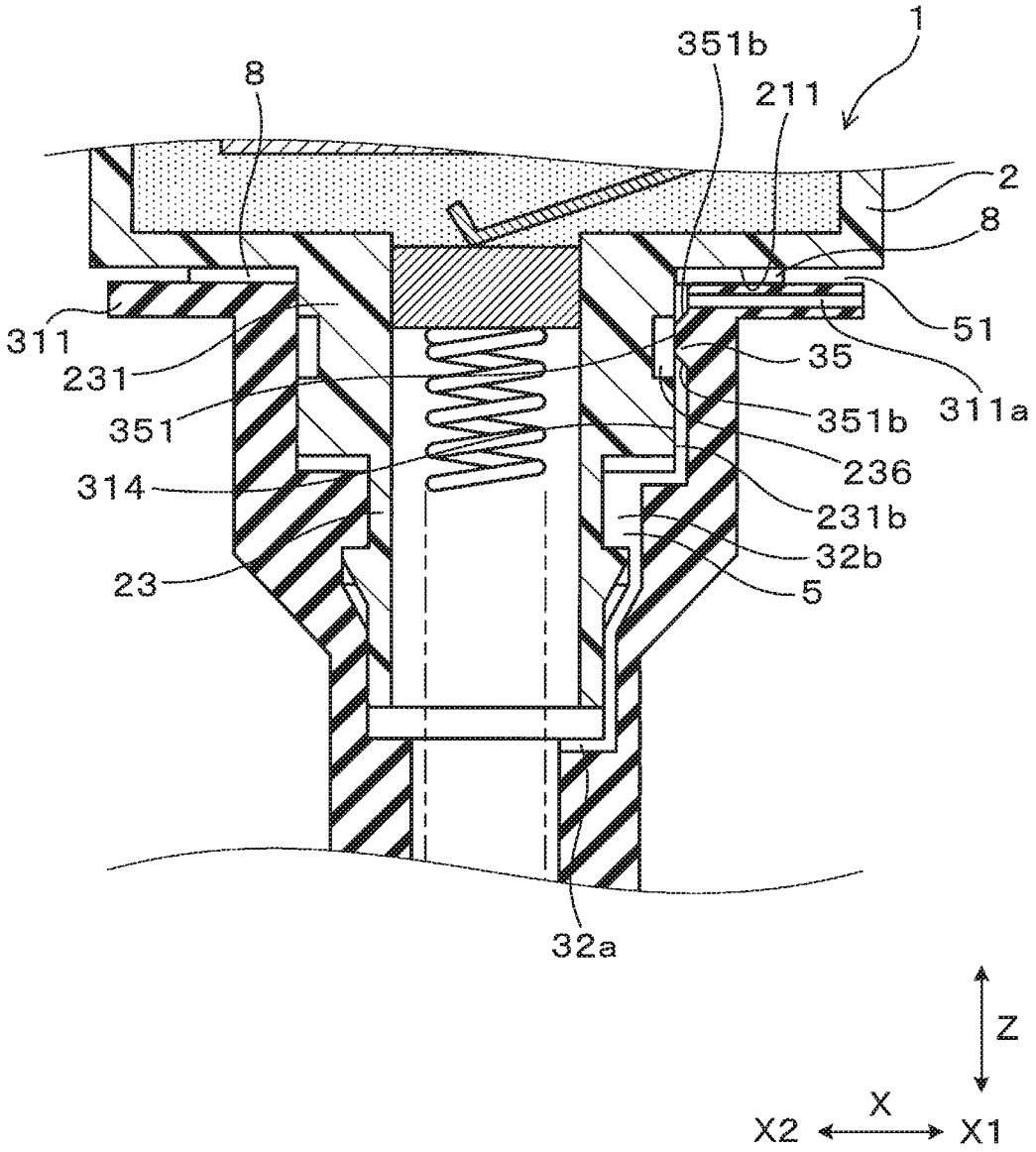
FIG. 44 is an enlarged view which illustrates a region around a high-voltage tower of an ignition coil in the tenth embodiment.

The communicating void 5 in this embodiment, as illustrated in FIG. 44, includes the inner spaces of the through-hole 311*a*, the intermediate groove 32*b*, the lower groove 32*a*, and the tower recess 236 which will be described later. The through-hole 311*a* has the same structure as that in the ninth embodiment.

The intermediate groove 32*b* is, as illustrated in FIGS. 44 to 46 and 49, equipped with the in-groove rib 35 bulging inwardly. The in-groove rib 35 bulges from the bottom surface of the intermediate groove 32*b* to the fourth facing surface 314 of the joint 3 to fully block a portion of the length of the intermediate groove 32*b*. The in-groove rib 35, as clearly illustrated in FIG. 46, occupies the whole of width of the intermediate groove 32*b* in the circumferential direction. The central portion 351 of the in-groove rib 35 in the axial direction Z has an inner end surface lying flush with a portion of the fourth facing surface 314 of the joint 3 which is located adjacent the intermediate groove 32*b*. The fourth facing surface 314 is, like in the eighth embodiment, a surface of the joint 3 which faces the outer peripheral surface 231*b* of the tower upper portion 231. The in-groove rib 35 has ends 351*b* of the central portion 351 which are opposed to each other in the axial direction Z. The ends 351*b* are each shaped to have a degree of protrusion which decreases with distance from the central portion 351 in the axial direction Z. In other words, the surfaces of the ends 351*b* form a surface of the rib 35 tapering inwardly toward the top end of the central portion 351.

Figure 46:
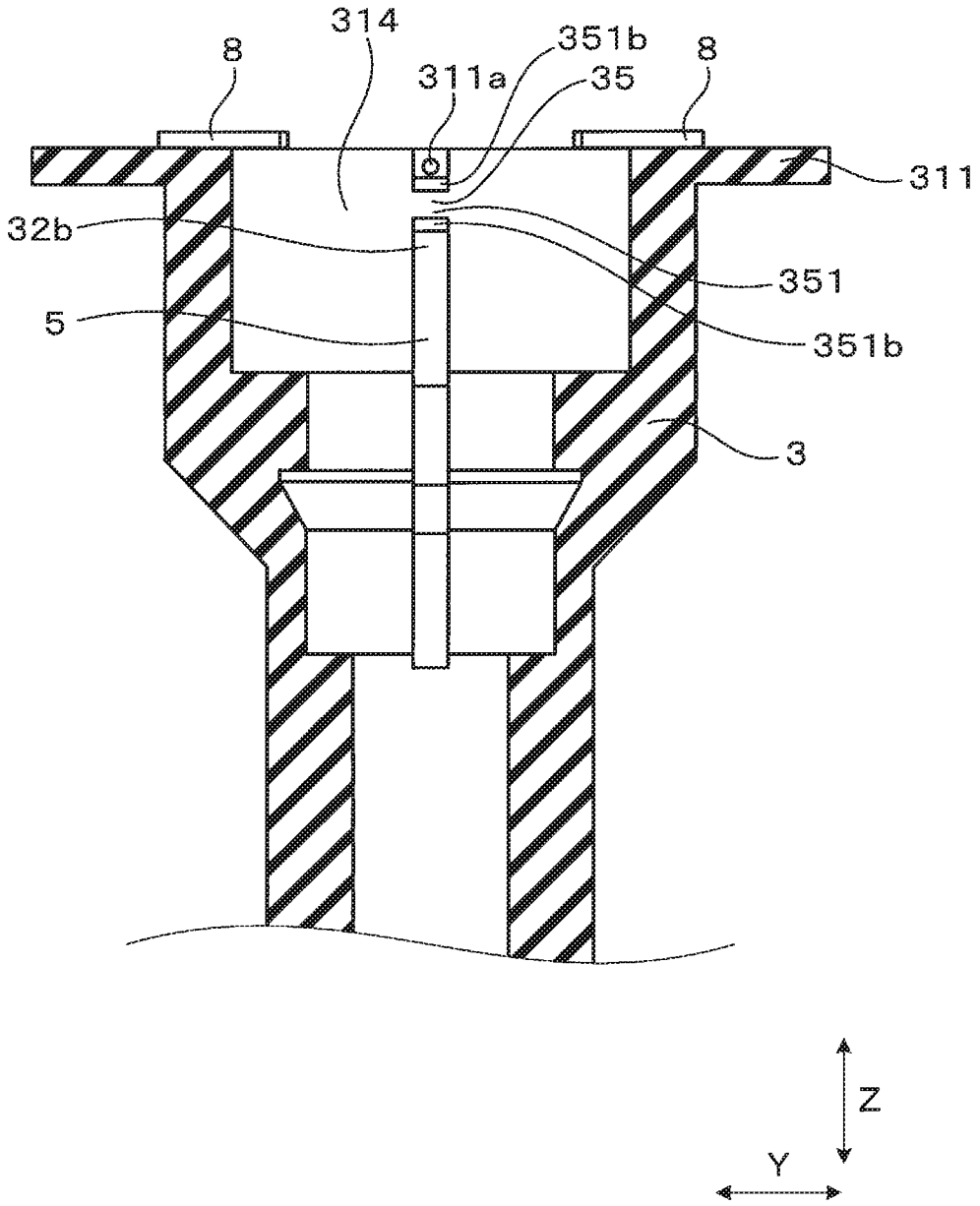
FIG. 46 is a sectional view parallel to an axial direction of a joint and an enlarged sectional view not passing through a void-forming groove in the tenth embodiment.
Figure 49:
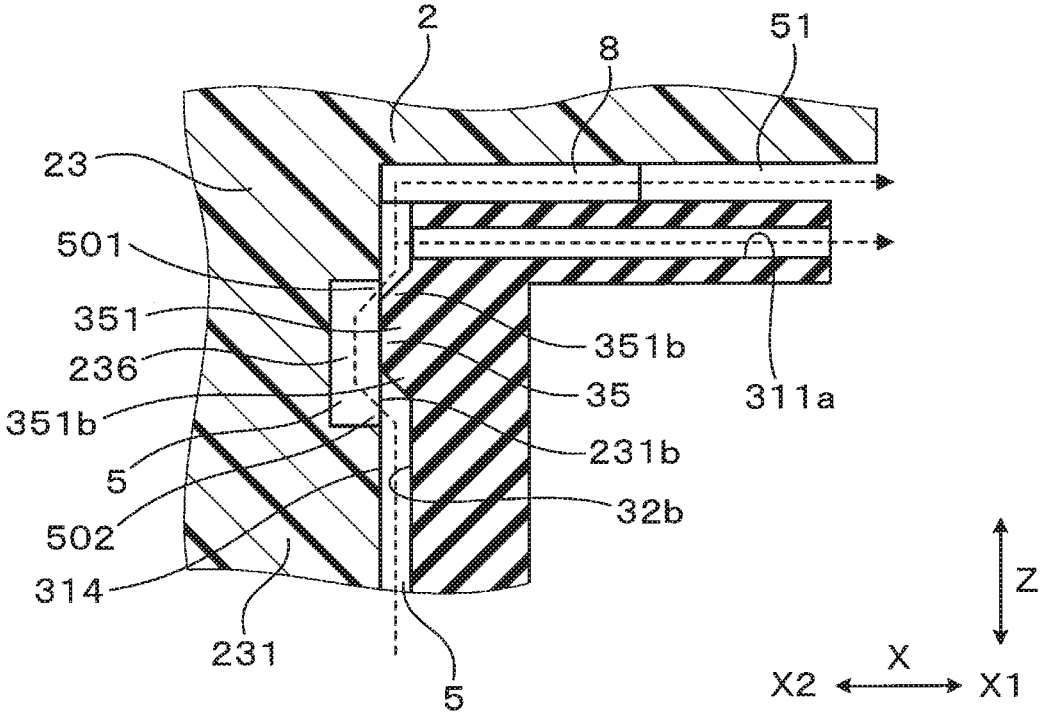
FIG. 49 is an enlarged view which illustrates a region around an in-groove rib in FIG. 48.

The in-groove rib 35 is, as clearly illustrated in FIGS. 44, 46, and 49, formed near a lower side of a portion of the intermediate groove 32*b* through which the through-hole 311*a* passes. The in-groove rib 35, as illustrated in FIGS. 44 and 49, occupies a portion of the intermediate groove 32*b* which faces the outer peripheral surface 231*b* of the tower upper portion 231 of the high-voltage tower 23.

Figure 47:
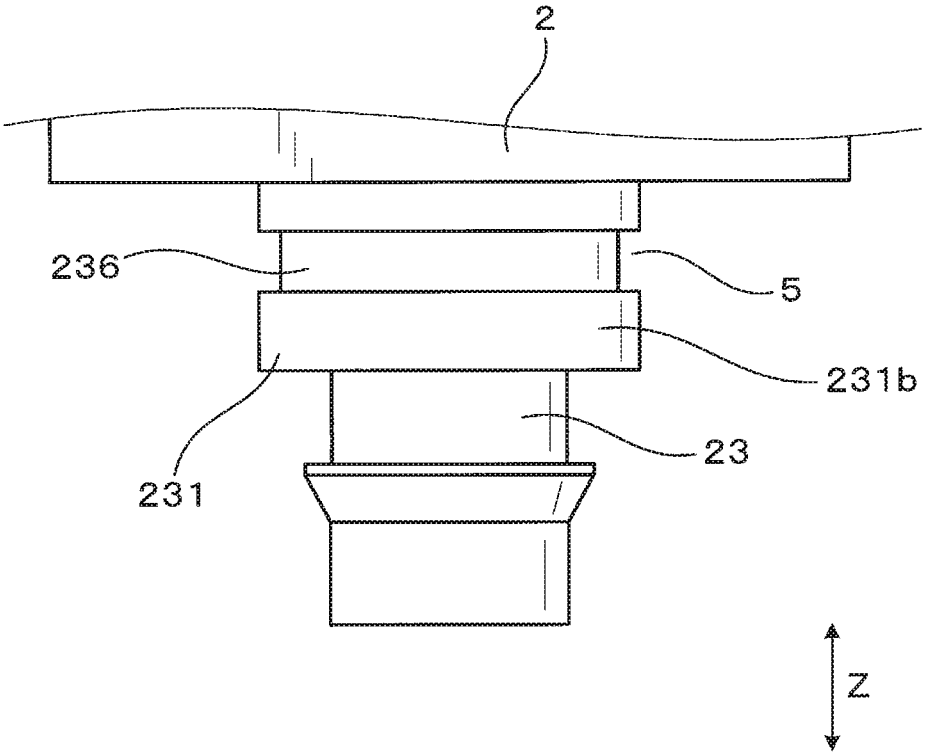
FIG. 47 is a front view which illustrates a region around a high-voltage tower of a case of an ignition coil in the tenth embodiment.

The outer peripheral surface 231*b* of the tower upper portion 231 of the high-voltage tower 23, as illustrated in FIGS. 44 and 49, has the tower recess 236 which is formed in a portion thereof at least facing the in-groove rib 35 of the joint 3 in the radial direction and recessed inwardly in the radial direction. The tower recess 236 in this embodiment, as illustrated in FIG. 47, occupies the entire circumference of the outer peripheral surface 231*b* of the tower upper portion 231 of the high-voltage tower 23. In other words, the tower recess 236 is formed in a circular annular shape.

The dimension of the tower recess 236 in the axial direction Z is, as can be seen in FIG. 49, greater than that of the central portion 351 of the in-groove rib 35 in axial direction Z. The tower recess 236 is shaped to receive the central portion 351 of the in-groove rib 35 inside ends thereof opposed to each other in the axial direction Z. In other words, the central portion 351 of the in-groove rib 35 is placed out of contact with the outer peripheral surface 231*b* of the tower upper portion 231 of the high-voltage tower 23. A clearance between the tower recess 236 and the in-groove rib 35 forms a portion of the communicating void 5. In this discussion, a portion of the clearance between the tower recess 236 and the in-groove rib 35 which lies above the central portion 351 of the in-groove rib 35 will be referred to as the first clearance 501, while a portion of the clearance which lies below the central portion 351 will be referred to as the second clearance 502. In FIG. 49, a path in which air flows is indicated by an arrow expressed by a broken line.

Figure 45:
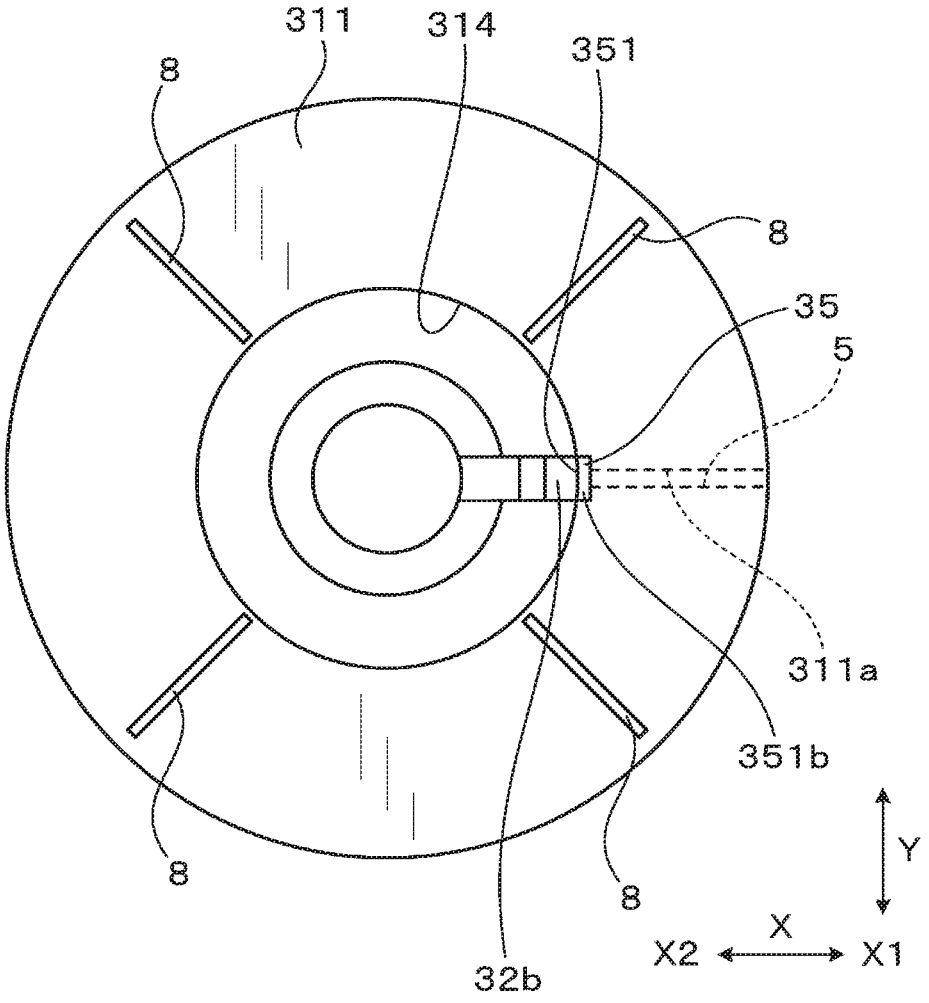
FIG. 45 is a top view of a joint in the tenth embodiment.

In this embodiment, the protrusions 8 are, as illustrated in FIGS. 44 to 46, formed on the first facing surface 311 of the joint upper end portion 31. The first facing surface 311, as clearly illustrated in FIG. 45, has the four protrusions 8 formed thereon. Each of the protrusions 8 extends straight in the radial direction and is of a convex shape elastically deformable in the axial direction Z. The protrusions 8 are arranged at an angular interval of 90° away from each other in the circumferential direction. Two of the four protrusions 8 are located closer to the flange than the center axis of the high-voltage tower 23 is (i.e., on the side X1), while the other two are arranged farther away from the flange 24 than the center axis of the high-voltage tower 23 is (i.e., on the side X2). The upper ends of the protrusions 8 are, as can be seen in FIG. 44, placed in contact with the lower bottom surface 211 of the case 2. This positions the joint 3 and the case 2 in the axial direction Z and creates the bottom wall side void 51 between the case bottom wall 21 and the joint upper end portion 31.

Next, installation of the ignition coil 1 in the internal combustion engine will be described below in FIGS. 48 to 51.

First, the joint 3 of the ignition coil 1 is, like in the second embodiment, inserted into the plug hole 105 to have the upper end of the spark plug fit in the lower end of the joint 3. The ignition coil 1 is, like in the second embodiment, then pressed toward the spark plug until the joint upper end portion 31 contacts the upper end surface 106*a* of the lip 106 of the engine head 101.

Figure 48:
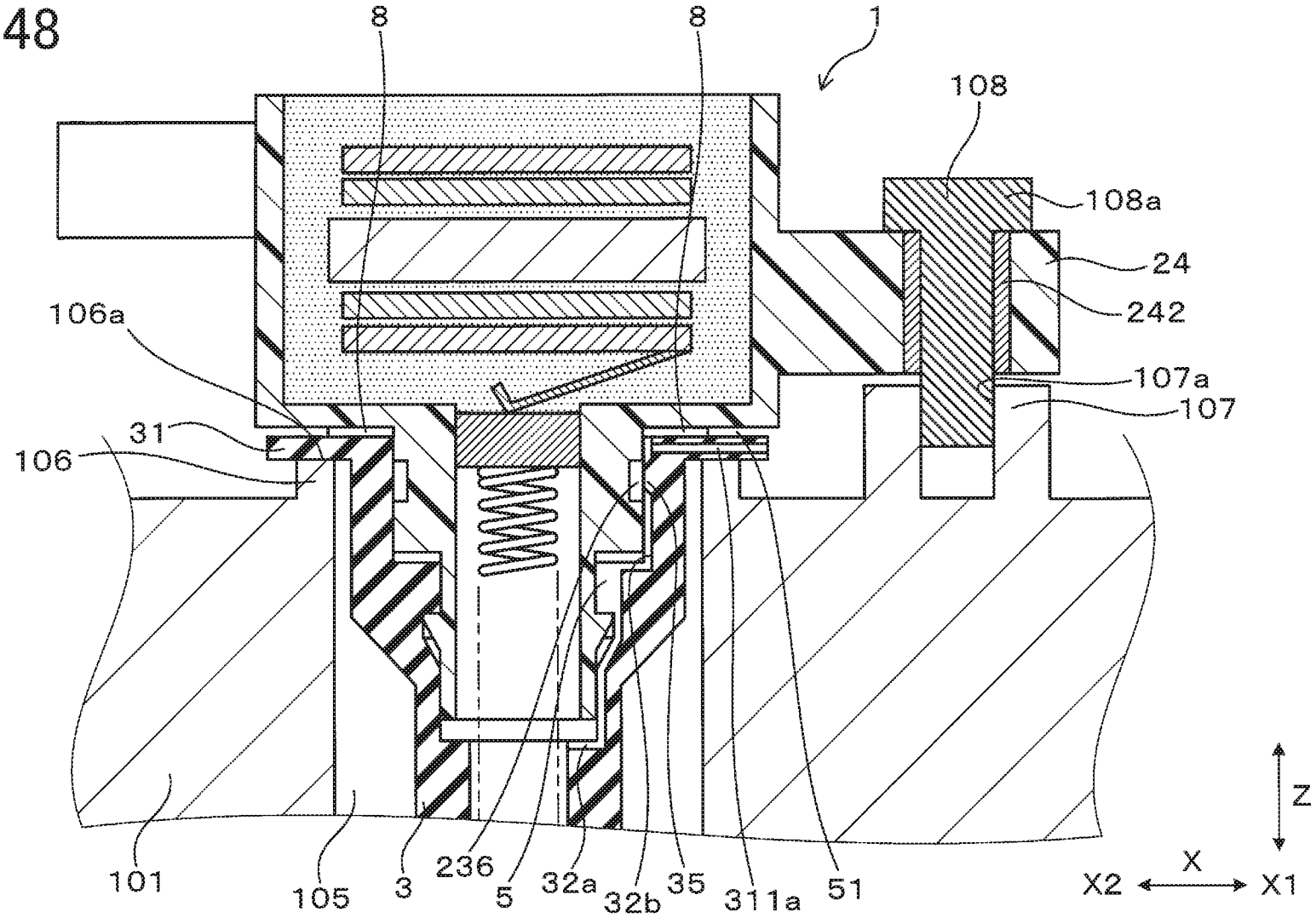
FIG. 48 is an enlarged sectional view of an ignition device before an axial force, as produced by a bolt, is exerted on a case in the tenth embodiment.

Next, the bolt 108 is put in the bush 242 of the flange 24 and then screwed into the threaded hole 107*a* of the boss 107 until the head 108*a* of the bolt 108 contacts the upper surface of the flange 24. This is illustrated in FIGS. 48 and 49. In this condition, the axial force, as produced by the bolt 108, does not act on the ignition coil 1, so that the protrusions 8 are, as illustrated in FIG. 48, not yet elastically deformed, thus keeping the bottom wall side void 51 as it is. The first and second spaces 501 and 502 are, as illustrated in FIG. 49, kept as they are between the in-groove rib 35 and the tower recess 236.

Figure 50:
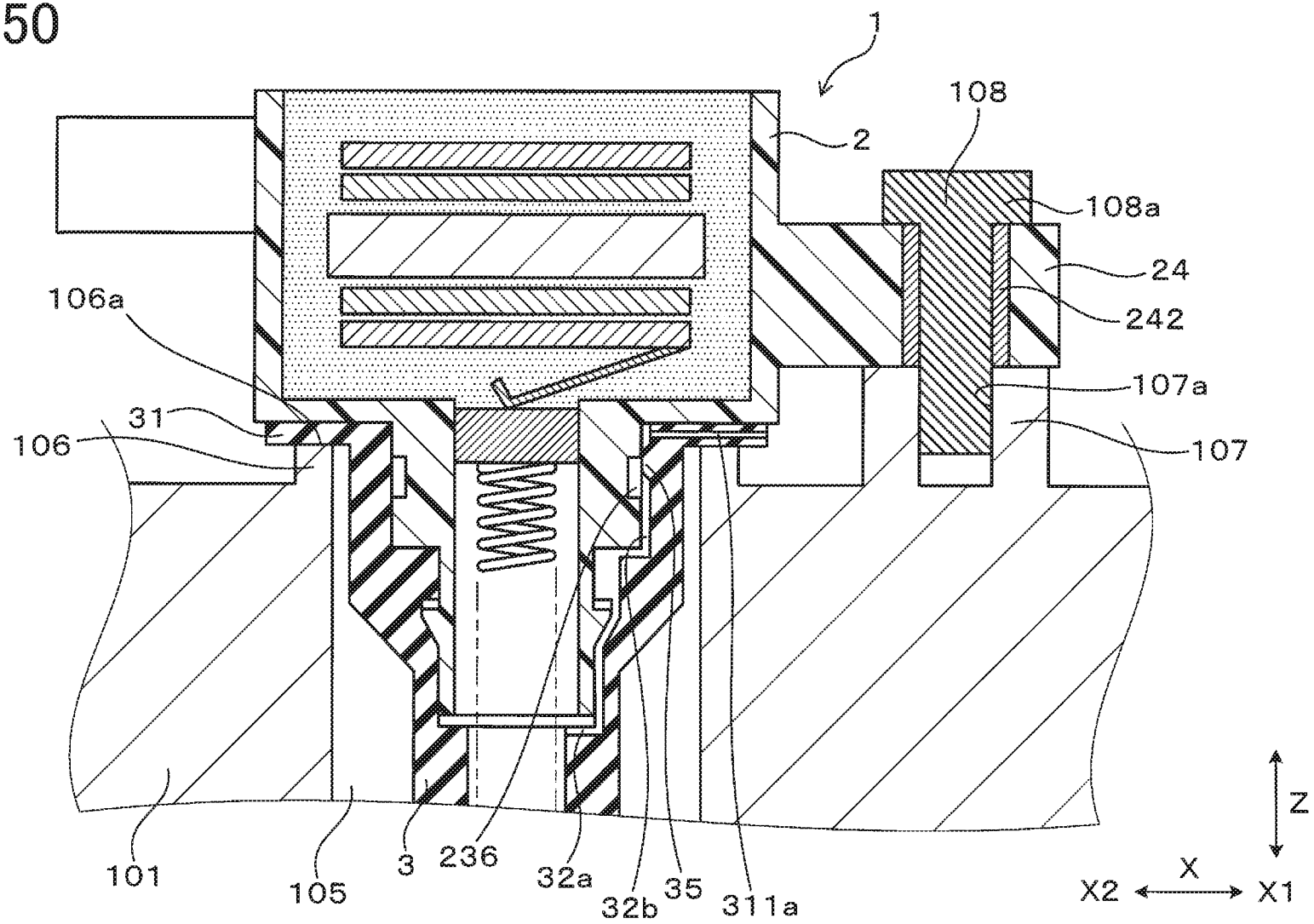
FIG. 50 is an enlarged sectional view of an ignition device equipped with an ignition coil in the tenth embodiment.
Figure 51:
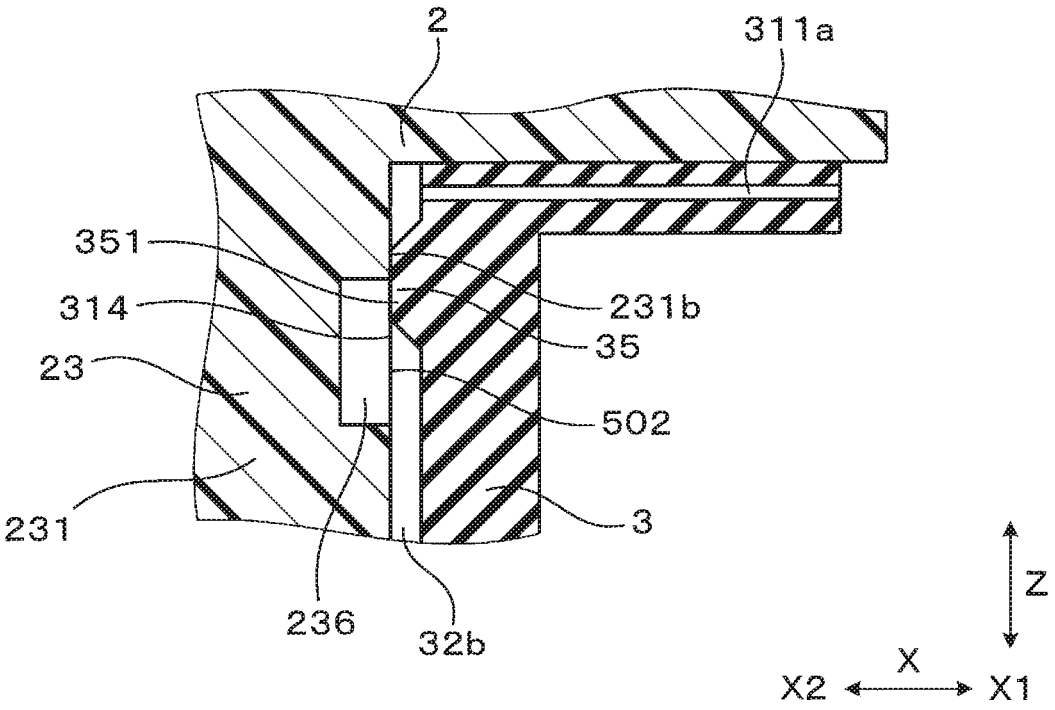
FIG. 51 is an enlarged view which illustrates a region around an in-groove rib in FIG. 50.

Subsequently, the bolt 108 is further tightened into the boss 107 from the condition in FIG. 48 or 49. This transmits the axial force from the bolt 108 to the case 2 of the ignition coil 1 to move, as illustrated in FIGS. 50 and 51, the case 2 downward toward the joint 3. The joint upper end portion 31 is, as described above, placed in contact with the lip 106, thereby stopping the joint 3 from moving downward even when the case 2 is moved downward by the axial force produced by the bolt 108. This causes the in-groove rib 35 to be stopped from moving in the axial direction Z, but the tower recess 236 to be moved downward with the screwing of the bolt 108 into the boss 107. When the bolt 18 is screwed into the boss 107 until the lower surface of the flange 24 of the case 2 contacts the upper surface of the boss 107, the inner end surface of the in-groove rig 35 in the radial direction is, as illustrated in FIG. 51, placed in surface-contact with a portion of the outer peripheral surface 231*b* of the tower upper portion 231 above the tower recess 236. This closes the first clearance 501 when the ignition coil 1 is mounted in the internal combustion engine, thereby blocking the communicating void 5.

The protrusions 8 are, like in the second embodiment, elastically deformed or compressed in the axial direction Z with the screwing of the bolt 108 into the boss 107, so that the bottom wall side void 51 is contracted. When the bolt 108 is fastened into the boss 107 until the lower surface of the flange 24 of the case 2 contacts the upper surface of the boss 107, the protrusions 8 are compressed, as illustrated in FIG. 50, until the bottom wall side void 51 to be fully or almost fully eliminated.

The fastening of the bolt 108 into the boss 107, like in the ninth embodiment, causes the joint upper end portion 31 held between the case 2 and the lip 106 to be elastically deformed in the axial direction Z. This also compresses the through-hole 311*a* in the axial direction Z with the screwing of the bolt 108 into the boss 107. In this embodiment, the through-hole 311*a* is, as clearly illustrated in FIG. 51, not compressed fully to have the internal space when the lower surface of the flange 24 of the case 2 contacts the upper surface of the boss 107. The communicating void 5 is, however, as described above, blocked by the surface-contact between the inner end surface of the in-groove rib 35 and the outer peripheral surface 231*b* of the tower upper portion 231 when the ignition coil 1 is secured to the internal combustion engine.

The removal of the ignition coil 1 from the internal combustion engine will be described below.

First, the bolt 108 is, like in the second embodiment, removed from the boss 107 and the flange 24. This causes the axial force exerted by the bolt 108 on the case 2 to disappear, so that the case 2 is moved upward by the resilience of the joint upper end portion 31 (including the protrusions 8) which has been compressed. This causes the in-groove rib 35 to be stopped from moving in the axial direction Z, but the tower recess 236 of the high-voltage tower 23 to be moved upward, so that the in-groove rib 35 is disposed inside the tower recess 236, thereby creating the first clearance 501 again between the in-groove rib 35 and the tower recess 236, which opens the communicating void 5 again. This facilitates the ease with which the ignition coil 1 is pulled out of the spark plug 13 without making the pressure in the inner chamber 41 negative.

Other arrangements are identical with those in the second embodiment.

In this embodiment, when the ignition coil 1 is installed in the internal combustion engine, the in-groove rib 35 and the outer peripheral surface 231*b* of the tower upper portion 231 of the high-voltage tower 23 are pressed against each other in the radial direction to close the communicating void 5. In other words, the communicating void 5 is closed without subjected to the axial force produced by the bolt 108. The closing of the communicating void 5 is, therefore, achieved without precisely managing the bolt 108.

While the present invention has been disclosed in terms of the preferred embodiments in order to facilitate better understanding thereof, it should be appreciated that the invention can be embodied in various ways without departing from the principle of the invention.

For instance, the second embodiment may be designed to have additional protrusions attached to a portion of the joint 3 away from the protrusions 8.

The joint in each embodiment is made of a one-piece member, but however, may be formed by an assembly of a plurality of discrete parts. For instance, the joint may be formed by a resinous mold made of PPS (Polyphenylene-sulfide), PBT (Polybutyleneterephthalate), or SPS (Syndiotactic polystyrene) and a rubber. Specifically, the joint may include rubber parts connected to the high-voltage tower and the spark plug and a resinous member joining the rubber parts together.

What is claimed is:

1. An ignition coil for an internal combustion engine comprising:

a primary coil and a secondary coil which are magnetically coupled with each other;

a case which includes a case body in which the primary coil and the secondary coil are disposed and a cylindrical high-voltage tower which protrudes from a bottom wall of the case body; and a cylindrical joint which is fit on the high-voltage tower and a spark plug, wherein the cylindrical joint has formed therein a hole and an inner space within the hole, a communicating void is formed between the high-voltage tower and the joint to communicate between the inner space, as defined by an upper end of the spark plug, an inner wall of the joint, and an upper end of the hole in the joint, and an outer space located outside the high-voltage tower and the joint.

2. An ignition coil for an internal combustion engine as set forth in claim 1, wherein at least a portion of the communicating void includes an inside of a void-forming groove formed in at least one of the case and the joint.

3. An ignition coil for an internal combustion engine as set forth in claim 1, wherein the joint includes a joint upper end which faces the case bottom wall in an axial direction, the case bottom wall and the joint upper end portion face each other through a gap in the axial direction, a bottom wall side void which is arranged adjacent the outer space is formed between the case bottom wall and the joint upper end portion, and the bottom wall side void forms a portion of the communicating void.

4. An ignition coil for an internal combustion engine as set forth in claim 3, wherein at least one of the case and the joint has a protrusion which protrudes toward the other in the axial direction and is placed in contact with the other.

5. An ignition coil for an internal combustion engine as set forth in claim 4, wherein at least one of the case bottom wall of the case and the joint upper end portion of the joint has the protrusion.

6. An ignition coil for an internal combustion engine as set forth in claim 5, wherein if a border between the bottom wall side void and a portion of the communicating void which is located closer to the inner space than the bottom wall side void is defined as a boundary portion, the protrusion is formed around the boundary portion to minimize ingress of foreign matter into the inner space from the outer space.

7. An ignition coil for an internal combustion engine as set forth in claim 4, wherein the protrusion is of a convex shape and elastically deformable in the axial direction.

8. An ignition coil for an internal combustion engine as set forth in claim 4, wherein one of the case and the joint has the protrusion formed thereon, and the other has formed therein a receiving recess contacting the protrusion in the axial direction, and wherein the protrusion is shaped to be disposed inside the receiving recess when the ignition coil is installed in an internal combustion engine.

9. An ignition coil for an internal combustion engine as set forth in claim 8, wherein as viewed in the axial direction, the receiving recess is formed in an arc-shape that is a portion of a circular ring-shape around a center axis of the high-voltage tower.

10. An ignition coil for an internal combustion engine as set forth in claim 8, wherein the protrusion has formed in an end surface thereof an easy-to-press-fit recess which is recessed in the axial direction.

11. An ignition coil for an internal combustion engine as set forth in claim 8, wherein at least one of a corner of a top end of the protrusion and a corner of an open end of the receiving recess has a tapered surface.

12. An ignition coil for an internal combustion engine as set forth in claim 4, wherein the case has a flange which protrudes in a direction perpendicular to the axial direction and is secured to an internal combustion engine, and wherein the protrusion is elastically deformable in the axial direction, and when viewed in the axial direction, the protrusion is arranged closer to the flange than a center axis of the high-voltage tower is in a direction in which the center axis of the high-voltage tower and the flange are aligned with each other.

13. An ignition coil for an internal combustion engine as set forth in claim 4, wherein one of the case bottom wall and the joint upper end portion has an engaging protrusion bulging toward the other, while the other has an engaging recess which engages the engaging protrusion, wherein the engaging protrusion and the engaging recess work to achieve alignment between the case and the joint in a circumferential direction thereof.

14. An ignition coil for an internal combustion engine as set forth in claim 4, wherein the protrusion is arranged between the high-voltage tower and the joint in the axial direction.

15. An ignition coil for an internal combustion engine as set forth in claim 14, wherein the protrusion has a dimension in the axial direction which is greater than that of the bottom wall side void in the axial direction.

16. An ignition coil for an internal combustion engine as set forth in claim 1, wherein the joint includes a joint upper end portion which faces the case bottom wall in the axial direction, wherein the joint upper end portion has a first facing surface which faces the case bottom wall, the case bottom wall having a lower bottom surface which faces the joint upper end portion, the first facing surface being placed in contact with the lower bottom surface, and wherein at least a portion of the communicating void includes a space in a throughhole formed in the joint upper end portion.

17. An ignition coil for an internal combustion engine as set forth in claim 2, wherein the void-forming groove has formed therein an in groove rib which blocks a portion of a length of the void-forming groove, wherein the high-voltage tower has a tower recess which is formed in a portion thereof at least facing the in-groove rib in the radial direction and hollowed inwardly in the radial direction, wherein a space between the in-groove rib and the tower recess forms at least a portion of the communicating void before the ignition coil is installed in an internal combustion engine, and after the ignition coil is installed in the internal combustion engine, the in-groove rib is placed in contact with the high-voltage tower in the radial direction to block at least a portion of the communicating void.

18. An ignition coil for an internal combustion engine as set forth in claim 1, wherein at least part of the inner space is defined inside the cylindrical high-voltage tower.

* * * * *